US007630662B2

(12) United States Patent
Namiki et al.

(10) Patent No.: US 7,630,662 B2
(45) Date of Patent: Dec. 8, 2009

(54) IMAGE FORMING APPARATUS FOR FIXING AN IMAGE ON A RECORDING MATERIAL AND A CURRENT DETECTION CIRCUIT THEREFOR

(75) Inventors: Teruhiko Namiki, Mishima (JP); Daizo Fukuzawa, Mishima (JP); Mahito Yoshioka, Numazu (JP); Yasuhiro Shimura, Yokohama (JP); Hiromitsu Kumada, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/203,643

(22) Filed: Sep. 3, 2008

(65) Prior Publication Data

US 2009/0003868 A1 Jan. 1, 2009

Related U.S. Application Data

(63) Continuation of application No. PCT/JP2008/056827, filed on Mar. 31, 2008.

(30) Foreign Application Priority Data

Mar. 30, 2007 (JP) ..... 2007-092441
Apr. 25, 2007 (JP) ..... 2007-115992
Mar. 28, 2008 (JP) ..... 2008-086955

(51) Int. Cl.
*G03G 15/20* (2006.01)

(52) U.S. Cl. ..... 399/68; 399/69

(58) Field of Classification Search ..... 399/67–69, 399/75, 88, 90

See application file for complete search history.

(56) References Cited

U.S. PATENT DOCUMENTS 7,187,882 B2 * 3/2007 Kawazu et al. ..... 399/69
7,254,353 B2 * 8/2007 Koyama et al. ..... 399/69
7,257,341 B2 * 8/2007 Hanamoto et al. ..... 399/67
7,289,745 B2 * 10/2007 Nara et al. ..... 399/88

(Continued)

FOREIGN PATENT DOCUMENTS

JP 58-105180 6/1983

(Continued)

OTHER PUBLICATIONS

International Search Report and Written Opinion of PCT/JP2008/056827.

*Primary Examiner*—William J Royer
(74) *Attorney, Agent, or Firm*—Fitzpatrick, Cella, Harper & Scinto

(57) ABSTRACT

The image forming apparatus includes a current detection circuit for detecting an input current from the commercial power supply to the apparatus, in which: when a current detected by the current detection circuit exceeds a predetermined value, a maximum current suppliable to a fixing portion is restricted; and when a temperature of the fixing portion falls below, in a situation where the maximum current suppliable to the fixing portion is restricted, the predetermined temperature lower than a control target temperature, a conveyance interval of a recording material conveyed to the fixing portion is extended. In the image forming apparatus, even when a consumption current of the image forming apparatus is increased during successive image formation, it is capable of controlling the consumption current so as not to exceed a maximum current of a commercial power supply, securing desired fixability, and minimizing decline of image forming performance.

5 Claims, 32 Drawing Sheets

U.S. PATENT DOCUMENTS

2007/0193998 A1 8/2007 Ichino ..... 219/216

FOREIGN PATENT DOCUMENTS

| | | |
|---|---|---|
| JP | 61-276473 | 12/1986 |
| JP | 3-073870 | 3/1991 |
| JP | 4-174457 | 6/1992 |
| JP | 6-202401 | 7/1994 |
| JP | 2002-268446 | 9/2002 |
| JP | 2005-24779 | 1/2005 |
| JP | 2005-24899 | 1/2005 |

* cited by examiner

| | | | |
|---|---|---|---|
| Dp | 60% | 60% | 60% |
| Df | 90% | 90% | 90% |
| Di | 80% | 80% | 55% |
| D | 60% | 60% | 55% |

IMAGE FORMING APPARATUS FOR FIXING AN IMAGE ON A RECORDING MATERIAL AND A CURRENT DETECTION CIRCUIT THEREFOR

This application is a continuation of International Application No. PCT/JP2008/056827, filed on Mar. 31, 2008, which claims the benefit of Japanese Patent Applications No. 2007-092441 filed on Mar. 30, 2007, No. 2007-115992 filed on Apr. 25, 2007 and No. 2008-086955 filed on Mar. 28, 2008.

BACKGROUND OF THE INVENTION

1. Field of the Invention

The present invention relates to an image forming apparatus such as a copying machine or a printer, and more particularly, to an image forming apparatus including a current detection circuit for detecting the amount of a current that flows into the image forming apparatus from a commercial power supply.

2. Description of the Related Art

A laser printer, which is an image forming apparatus employing an electrophotographic process, includes: a latent image bearing member for bearing a latent image; a developing device for visualizing the latent image as a toner image by applying developer (hereinafter, referred to as toner) to the latent image bearing member; a transfer device for transferring the toner image onto recording paper conveyed in a predetermined direction; and a fixing device for fixing the toner image onto the recording paper by heating and pressurizing, under a predetermined fixing process condition, the recording paper that the toner image has been transferred onto by the transfer device.

With the recent speed-up of image forming apparatus, motors used in the image forming apparatuses have become faster/larger, resulting in increased consumption of current for the image forming apparatuses. Further, with the development of colorization of office documents, a large number of color laser printers have been produced. The color laser printer employs a large number of motors in order to perform multiple image formations simultaneously. In addition, due to the need to fix onto the recording paper the toner image that has multiple colors overprinted, the fixing device consumes a large amount of current. Further, with image forming apparatuses becoming more sophisticated, image forming apparatuses have come to be provided with option devices, such as a sheet feed option device for accommodating multiple sizes of recording paper, a sheet discharge option device for sorting or stapling delivered recording paper for every predetermined number of sheets, and an image scanner provided with an auto sheet feeder for performing copying or electronic filing of an original. As a result, the consumption current of the image forming apparatus is more and more increasing.

A guide for the upper limit of a current that is consumable in those apparatuses is specified by the Underwriters Laboratories Inc. (UL) standard in the U.S., the Electrical Appliance and Material Safety Law in Japan, or the like. Accordingly, the image forming apparatus needs to be so designed that the upper limit does not exceed the maximum current, which is suppliable by the commercial power supply. The maximum current is, for example, 15 A in Japan and the U.S., and is 10 A in the European Union (EU). Those figures are both root mean square values.

Normally, power consumed in the image forming apparatus becomes the highest during a period (warm-up period) where the fixing device is heated up until a fixable temperature. This is because, if loads other than the fixing device start print preparation operations during the warm-up period, a large amount of power that is being consumed in the fixing device is added with the consumption power of the other loads.

Hence, conventionally, in order to prevent the maximum current of the entire image forming apparatus from exceeding 15 A, designed has been such a sequence as to restrict the current flowing into the fixing device at a timing of activation of the loads other than the fixing device. For example, upon outputting activation signals to the loads other than the fixing device, the CPU also outputs a signal for restricting an input current to a temperature control portion of the fixing device.

On the other hand, because the consumption power of the fixing device in a printing period is not so high as in the warm-up period, it has been rare for the maximum current of the entire image forming apparatus to exceed 15 A, even if the loads other than the fixing device are activated while the current is flowing in the fixing device.

However, with the speed-up/upsizing of the employed motors, resulting from the speed-up of the image forming apparatus, as well as with the colorization, resulting from the increased number of the employed motors, the consumption power of the loads other than the fixing device has been increasing. Accordingly, there has been the need to carry out a design taking into account a situation where the maximum current of the entire image forming apparatus exceeds 15 A, even in the printing period.

Therefore, for the printing period, similarly to the warm-up period, it is conceivable to design such a sequence as to restrict the current flowing into the fixing device at the timing of activation of the loads other than the fixing device in order to prevent the maximum current of the entire image forming apparatus from exceeding 15 A.

However, each of the loads has a different activation timing from one another, making it extremely difficult to design a sequence that restricts the current flowing into the fixing device at each of the timings of activation of a large number of loads other than the fixing device. In addition, the consumption power of each of the loads other than the fixing device is not necessarily constant, but will fluctuate. Consequently, if the current flowing into the fixing device is restricted with a fixed rate upon activation of the loads other than the fixing device, there is a possibility that the current flowing into the fixing device is unnecessarily restricted, though there is room for the current to be used in the entire image forming apparatus. In such a case, the processing performance of the fixing device declines unnecessarily, eventually causing the processing performance of the image forming apparatus to decline unnecessarily.

Hence, Patent Document 1 discloses restricting, by providing a current detection device for detecting an input current into the image forming apparatus, a current flowing into the fixing device so as to prevent the current from exceeding the maximum current of the commercial power supply.

Patent Document 1 Japanese Patent Application Publication No. H03-073870

SUMMARY OF THE INVENTION

However, when a current flowing into a fixing device is restricted, the temperature of the fixing device declines gradually, and thus, desired fixability cannot be secured.

In order to solve the aforementioned problems, according to the present invention, an image forming apparatus includes: an image forming portion for forming an image on a recording material; a fixing portion for fixing the image on the recording material by heating, the fixing portion being controlled to maintain a control target temperature; and a current detection circuit for detecting an input current from a commercial power supply to the apparatus. When a current detected by the current detection circuit exceeds a predetermined value, a maximum current suppliable to the fixing portion is restricted, and when a temperature of the fixing portion falls below, in a situation where the maximum current suppliable to the fixing portion is restricted, a predetermined temperature lower than the control target temperature, a conveyance interval of the recording material conveyed to the fixing portion is extended.

According to the present invention, it is possible to provide an image forming apparatus capable of suppressing an input current from the commercial power supply to the image forming apparatus to be equal to or less than a predetermined value, and suppressing decline of processing performance.

Further features of the present invention will become apparent from the following description of exemplary embodiments with reference to the attached drawings.

DESCRIPTION OF THE EMBODIMENTS

Hereinbelow, the best mode for carrying out the present invention is described according to Embodiments.

Embodiment 1

Figure 3:
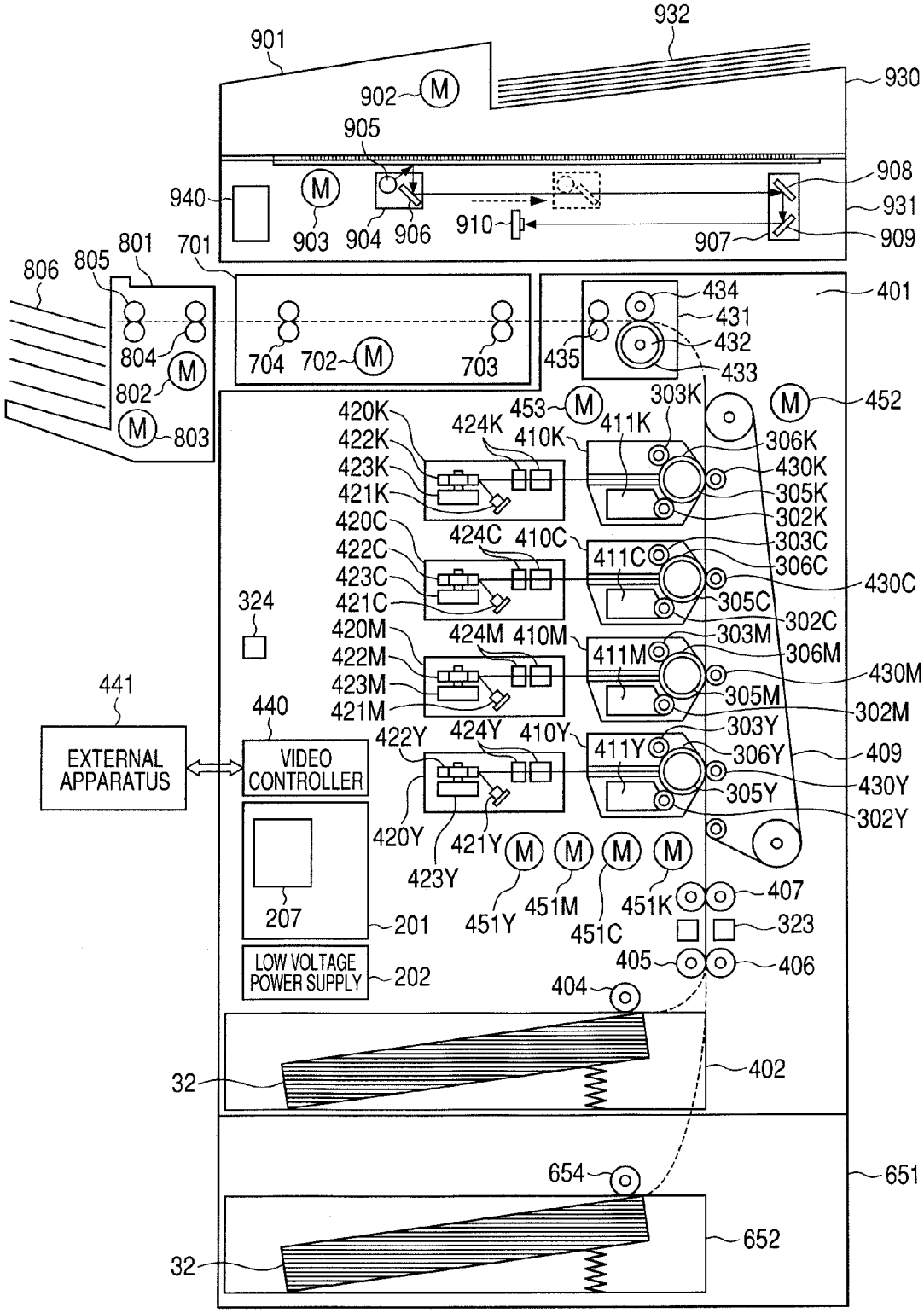
FIG. 3 is a diagram illustrating a structure of an image forming apparatus according to Embodiment 1.

FIG. 3 is a diagram illustrating a structure of an "image forming apparatus" (color laser printer provided with option devices) according to Embodiment 1.

Reference numeral 401 denotes a color laser printer, reference numeral 402 denotes a sheet feed cassette for housing recording paper 32, reference numeral 404 denotes a pick-up roller for picking up the recording paper 32 from the sheet feed cassette 402, and reference numeral 405 denotes a sheet feed roller for conveying the recording paper 32 picked up by the pick-up roller 404. Reference numeral 406 denotes a retard roller, which makes a pair with the sheet feed roller 405, for preventing double feeding of the recording paper 32, and reference numeral 407 denotes a registration roller pair.

Reference numeral 409 denotes an electrostatic attraction conveying transfer belt (hereinafter, referred to as ETB: electrical transfer belt), which conveys the recording paper 32 by means of electrostatic attraction. Reference numeral 410 (410Y, 410M, 410C, 410K) denotes a process cartridge, which is detachably provided to the color laser printer 401 and includes a photosensitive drum 305 (305Y, 305M, 305C, 305K), a cleaning device 306 (306Y, 306M, 306C, 306K) for removing toner on the photosensitive drum 305, a charge roller 303 (303Y, 303M, 303C, 303K), a developing roller 302 (302Y, 302M, 302C, 302K), and a toner container 411 (411Y, 411M, 411C, 411K).

Reference numeral 420 (420Y, 420M, 420C, 420K) denotes a scanner unit, which includes a laser unit 421 (421Y, 421M, 421C, 421K) for emitting a laser beam modulated based on respective image signals that are transmitted from a video controller 440 described later, a polygon mirror 422 (422Y, 422M, 422C, 422K) and a scanner motor 423 (423Y, 423M, 423C, 423K) for causing the laser beams from the respective laser units 421 to scan the respective photosensitive drums 305, and an imaging lens group 424 (424Y, 424M, 424C, 424K). It should be noted that the process cartridges 410 and the scanner units 420 are provided for four colors (yellow Y, magenta M, cyan C, and black B).

Reference numeral 431 denotes a fixing device, which includes a fixing roller 433 provided with a heater 432 for heating therein, a pressure roller 434, and a fixing sheet discharge roller pair 435 for conveying the recording paper 32 from the fixing roller 433.

Reference numerals 451 (451Y, 451M, 451C, 451K), 452, and 453 denote DC brushless motors: reference numeral 451 denotes a main motor for driving the process cartridge 410; reference numeral 452 denotes the ETB 409 motor for driving an ETB; and reference numeral 453 denotes a fixing motor for driving the fixing device 431.

Reference numeral 201 denotes a DC controller, which is a control portion of the laser printer 401 and includes a microcomputer 207 and various types of input/output control circuit (not shown).

Reference numeral 202 denotes a low voltage power supply circuit, which steps down a primary AC current after smoothing and supplies power to the respective DC brushless motors 451, 452, and 453, the DC controller 201, and the like.

Reference numeral 440 denotes the video controller, which expands, upon reception of image data transmitted from a host computer (external apparatus) 441, e.g. a personal computer, the image data into bitmap data, and generates an image signal for image formation.

Reference numeral 323 denotes a basic weight determination device, which irradiates light onto the recording paper 32 and determines the basic weight of the recording paper 32 based on the amount of transmitted light of the recording paper 32. Reference numeral 324 denotes a temperature detection sensor for detecting a circumferential temperature of the image forming apparatus.

Reference numeral 651 denotes a sheet feed unit, which is an option device for accommodating different recording paper 32 and includes a sheet feed cassette 652 for housing the recording paper 32 and a pick-up roller 654 for picking up the recording paper 32 from the sheet feed cassette 652.

Reference numeral 801 denotes a sheet discharge unit, which is an option device for sorting the recording paper 32 delivered from the color laser printer 401 for every predetermined number of sheets and includes a motor 802 for driving convey roller pairs 804 and 805 and a motor 803 for causing a sheet discharge tray 806 to perform an up-and-down operation.

Reference numeral 701 denotes a conveying unit, which is an option device for conveying the recording paper 32 delivered from the color laser printer 401 to the sheet discharge unit 801 that is an option device, and includes a motor 702 for driving convey roller pairs 703 and 704.

Reference numeral 901 denotes an image scanner, which is an option device including an original conveying portion 930 and an original reading portion 931. Reference numeral 902 denotes an original conveying motor for conveying an original 932, reference numeral 904 denotes an exposure unit, reference numeral 905 denotes an exposure device, reference numeral 906 denotes a mirror, reference numeral 903 denotes a scanner driving motor for horizontally moving the exposure unit 904, reference numeral 907 denotes a reflecting device, and reference numerals 908 and 909 denote mirrors. Reference numeral 910 denotes a light receiving device, and reference numeral 940 denotes an image scanner controller unit for controlling an operation of the image scanner 901 and converting a signal received by the light receiving device 910 into image data.

Next, an image forming operation is described.

First, image data is transmitted from the host computer 441 to the video controller 440. The video controller 440 transmits a PRINT signal that instructs the DC controller 201 to start image formation, and converts the received image data into bitmap data. The DC controller 201, which has received the PRINT signal, starts to drive the scanner motor 423, the main motor 451, the ETB motor 452, and the fixing motor 453 at predetermined timings, and also drives the pick-up roller 404, the sheet feed roller 405, and the retard roller 406 to thereby pick up the recording paper 32 from the sheet feed cassette 402. Then, the basic weight determination device 323 determines the thickness of the recording paper 32, and an image forming speed and an image forming condition are selected according to the recording paper 32. When the image forming speed needs to be changed as a result of the determination with regard to the recording paper 32, the rotational speeds of the main motor 451, the ETB motor 452, and the fixing motor 453 are changed.

Further, the circumferential temperature (environmental temperature) of the image forming apparatus 401 is detected by the temperature detection sensor 324, and, according to the detection result, the selected image forming condition is corrected. The recording paper 32 is conveyed up to the registration roller pair 407 to be stopped temporarily. Subsequently, according to an image signal dependent on the bitmap data, ON/OFF control is performed to the laser unit 421. A laser beam emitted from the laser unit 421 is irradiated onto the photosensitive drum 305 via the polygon mirror 422 and the imaging lens group 424, thereby forming an electrostatic image on the photosensitive drum 305 charged to a predetermined electric potential by the charge roller 303. Then, the toner is supplied to the electrostatic latent image from the developing roller 302, and a toner image is developed. The aforementioned toner image forming operation is performed for yellow Y, magenta M, cyan C, and black K at predetermined timings.

On the other hand, the recording paper 32, which is temporarily stopped at the registration roller pair 407, is fed to the ETB 409 at a predetermined timing that corresponds to the toner image forming operation, sequentially transferring the toner image formed on the photosensitive drum 305 onto the recording paper 32 by the transfer roller 430 (430Y, 430M, 430C, 430K) to form a color image. As described above, a structure for forming the toner image on the recording paper 32, which includes the photosensitive drum 305, the charge roller 303, the laser unit 421, the developing roller 302, the transfer roller 430, and the like, is referred to as an image forming portion. The color toner image formed on the recording paper 32 is conveyed to the fixing device 431, and then, is subjected to heating and pressurization (application of pressure) by the fixing roller 433 heated to a predetermined temperature and the pressure roller 434. As a result, the color toner image is fixed on the recording paper 32, and then delivered to an outside of the image forming apparatus 401 by the fixing sheet discharge roller pair 435.

The delivered recording paper 32 is conveyed to the sheet discharge unit 801 via the conveying unit 701. In the sheet discharge unit 801, the recording paper 32 is delivered to the sheet discharge tray 806 for every predetermined number of sheets.

Next, an operation of the image scanner 901 is described. After the original 932 is set to the original conveying portion 930, one of a copy mode and a scanner mode for converting read data into an electronic file is selected via a panel (not shown).

When the copy mode is selected, the original 932 is conveyed to the original reading portion 931 at a predetermined timing by the original conveying motor 902. Then, the exposure unit 904 is horizontally moved by the scanner driving motor 903, thereby irradiating light of the exposure device 905 onto the original 932. The reflected light from the original 932 is received by the light receiving device 910 via the mirror 906, and the mirrors 908 and 909 in the reflecting device 907. Then, the received light signal is transmitted to the image scanner controller unit 940.

The image scanner controller unit 940 converts the received signal into image data, and transmits the image data to the video controller 440. Then, the image formation on the recording paper 32 is performed with the same operation as the image formation from the host computer 441.

On the other hand, when the scanner mode is selected, the image scanner controller unit 940 converts the received signal into an electronic file in a predetermined file format, and transmits the electronic file to the host computer 441 via the video controller 440. In the case of the scanner mode, the image formation on the recording paper 32 is not executed.

It should be noted that, normally, the operation of the image scanner is performed separately from the image forming operation of the color laser printer 401.

Figure 4:
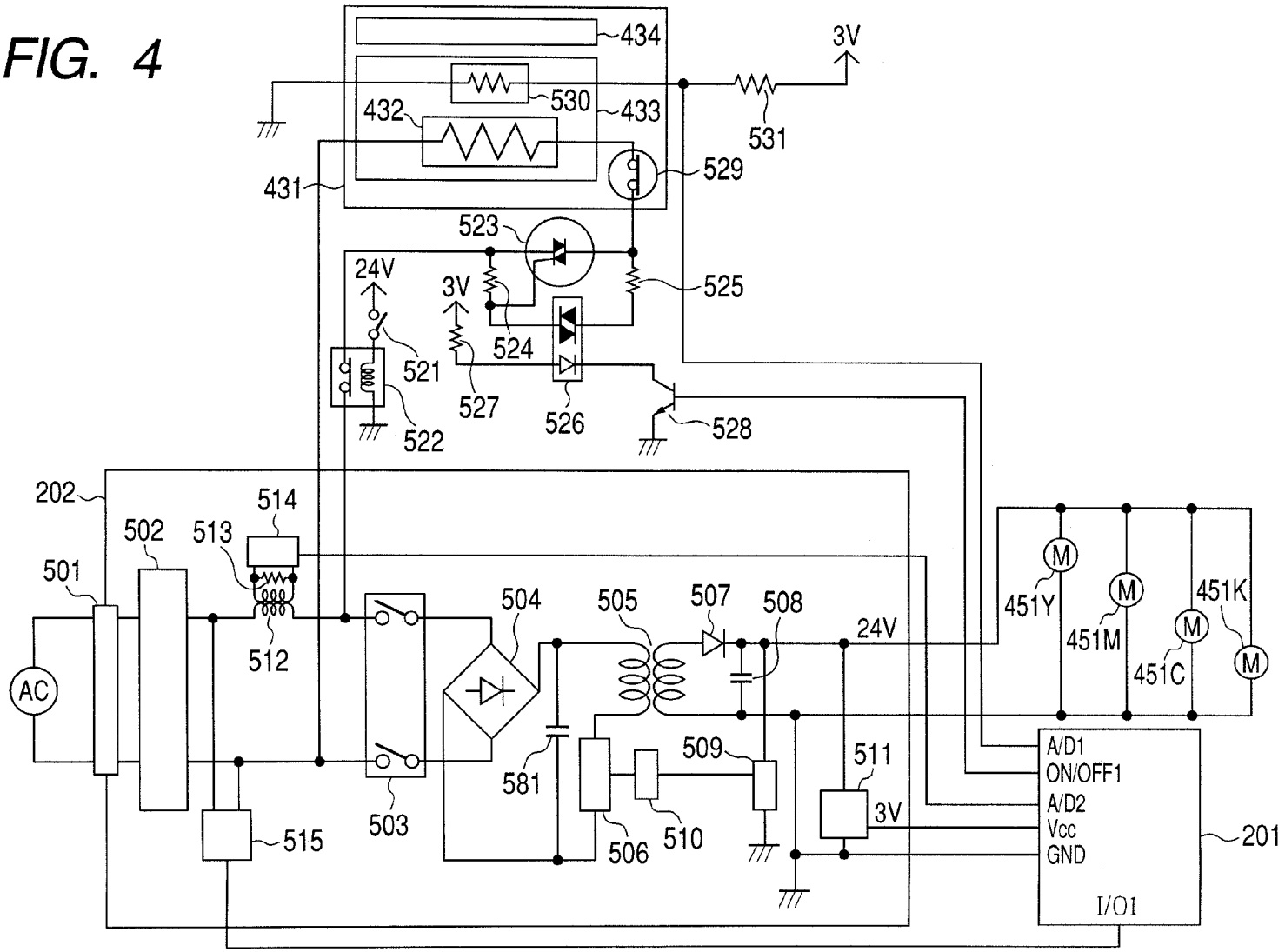
FIG. 4 is a diagram illustrating a circuit of the image forming apparatus according to Embodiment 1.

FIG. 4 is a circuit diagram of the image forming apparatus according to this embodiment. Reference numeral 202 denotes a low voltage power supply, reference numeral 501 denotes an inlet, reference numeral 502 denotes an AC filter for removing noise from a commercial power supply or noise from the low voltage power supply, reference numeral 503 denotes a main switch, reference numeral 504 denotes a diode bridge, reference numeral 505 denotes a converter with an output of 24 V, and reference numeral 506 denotes a converter control circuit. Reference numeral 507 denotes a diode, reference numeral 508 denotes a capacitor, reference numeral 509 denotes a constant voltage control circuit, reference numeral 510 denotes a photo-coupler, reference numeral 511 denotes a DC/DC converter for converting 24 V into 3 V, reference numeral 512 denotes a current transformer, reference numeral 513 denotes a resistor, reference numeral 514 denotes a current detection circuit (first current detection circuit) for detecting an input current (primary total current) from the commercial power supply to the image forming apparatus, and reference numeral 515 denotes a zero-cross detection circuit.

Reference numeral 521 denotes an interlock switch for opening/closing in synchronization with a door of the image forming apparatus, reference numeral 522 denotes a relay, reference numeral 523 denotes a triac, reference numerals 524, 525, and 527 denote resistors, reference numeral 526 denotes a photo-triac-coupler, and reference numeral 528 denotes a transistor. Further, reference numeral 431 denotes the fixing device (fixing portion), reference numeral 433 denotes the fixing roller, reference numeral 434 denotes the pressure roller, reference numeral 432 denotes the heater, reference numeral 529 denotes a thermoswitch, reference numeral 530 denotes a thermistor (temperature detection element) for detecting temperature of the fixing roller 433, reference numeral 531 denotes a resistor, and reference numeral 581 denotes a capacitor.

Next, an operation of the circuit is described.

When the main switch 503 is switched on, a commercial current flows via the inlet 501 and the AC filter 502, and then, is subjected to full-wave rectification at the diode bridge 504 and the capacitor 581. Then, the converter 505 is switched on by the converter control circuit 506, and a pulsating current is excited on the secondary side of the converter 505. The pulsating current is rectified by the diode 507 and the capacitor 508. The voltage after the rectification is detected by the constant voltage control portion 509, and the converter control circuit 506 is controlled via the photo-coupler 510 in order to keep the voltage constant (24 V in this embodiment). The rectified voltage of 24 V is supplied to the DC brushless motors 451 and the like, and is also supplied to the DC/DC converter 511 to be converted into 3 V. The converted voltage of 3 V is supplied to the DC controller 201, and used for controlling the image forming apparatus 401.

Figure 5:
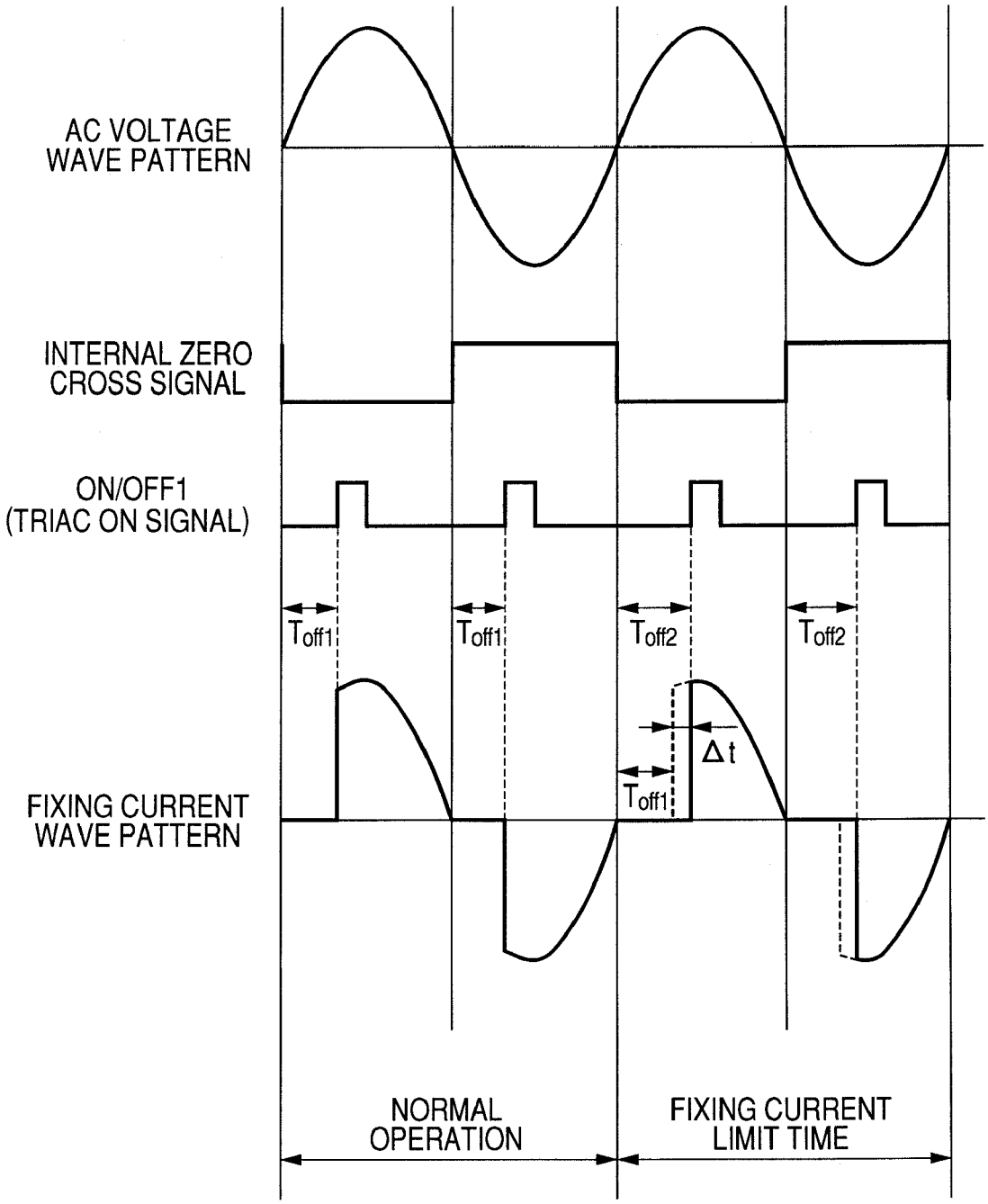
FIG. 5 is a diagram illustrating a fixing current wave pattern according to Embodiment 1.

Next, a temperature control operation of the fixing device 431 is described. FIG. 5 is a diagram for describing a fixing current wave pattern that flows in the fixing device 431.

The DC controller 201 detects a divided voltage between the thermistor 530 and the resistor 531 via the A/D port 1. The thermistor 530 has such a characteristic that the value of resistance declines as the temperature increases. The DC controller 201 detects the temperature of the fixing roller 433 based on the divided voltage of the A/D port 1. The commercial power supply is supplied to the heater 432 in the fixing device 431 via the relay 522, the triac 523, and the thermoswitch 529. The DC controller 201 detects, via the zero-cross detection circuit 515, a timing at which the commercial power supply is changed between the positive and the negative, that is, a zero-cross, and generates an internal zero-cross signal. Then, when a predetermined time period (hereinafter, referred to as $T_{OFF}$) has elapsed after the detection of the zero-cross, the DC controller 201 outputs a triac ON signal from an ON/OFF port 1, and transistor 528 is turned on. When the transistor 528 is turned on, a current flows into the photo-triac-coupler 526 via the resistor 527, thereby turning on the photo-triac-coupler 526. When the photo-triac-coupler 526 is turned on, a gate current flows into the triac 523 via the resistors 524 and 525, thereby turning on the triac 523. Then, the current flows into the heater 432, causing the heater 432 to generate heat. Then, the triac 523 is turned off when the gate current becomes zero, that is, at the timing of the next zero-cross. The DC controller 201 controls the fixing roller 433 to be at a predetermined temperature by controlling the time period $T_{OFF}$.

Next, described is a fixing current wave pattern when a current that flows into the fixing device 431 is restricted.

First, the primary total current that flows into the image forming apparatus 401 is subjected to current-voltage conversion by the current transformer 512 and the resistor 513. Subsequently, a root mean square value is calculated by the current detection circuit 514 from the result of the current-voltage conversion, and the resultant value is output to an A/D port 2 of the DC controller 201. The DC controller 201 detects the primary total current based on the voltage value of the A/D port 2. When the detected primary total current exceeds a predetermined current value Ilimit, the triac ON signal, which is output from the ON/OFF port 1, is delayed ($\Delta t$) according to the exceeding current value. As a result, a fixing current is more restricted compared with the fixing current (broken lines of FIG. 5) that flows when the fixing current restriction is not performed, leading to the primary total current being equal to or less than Ilimit (adjustment operation at first step). In this embodiment, the delay time (Δt) is set so that the primary total current does not exceed Ilimit−Ip (see FIG. 6) after the current restriction.

Figure 1:
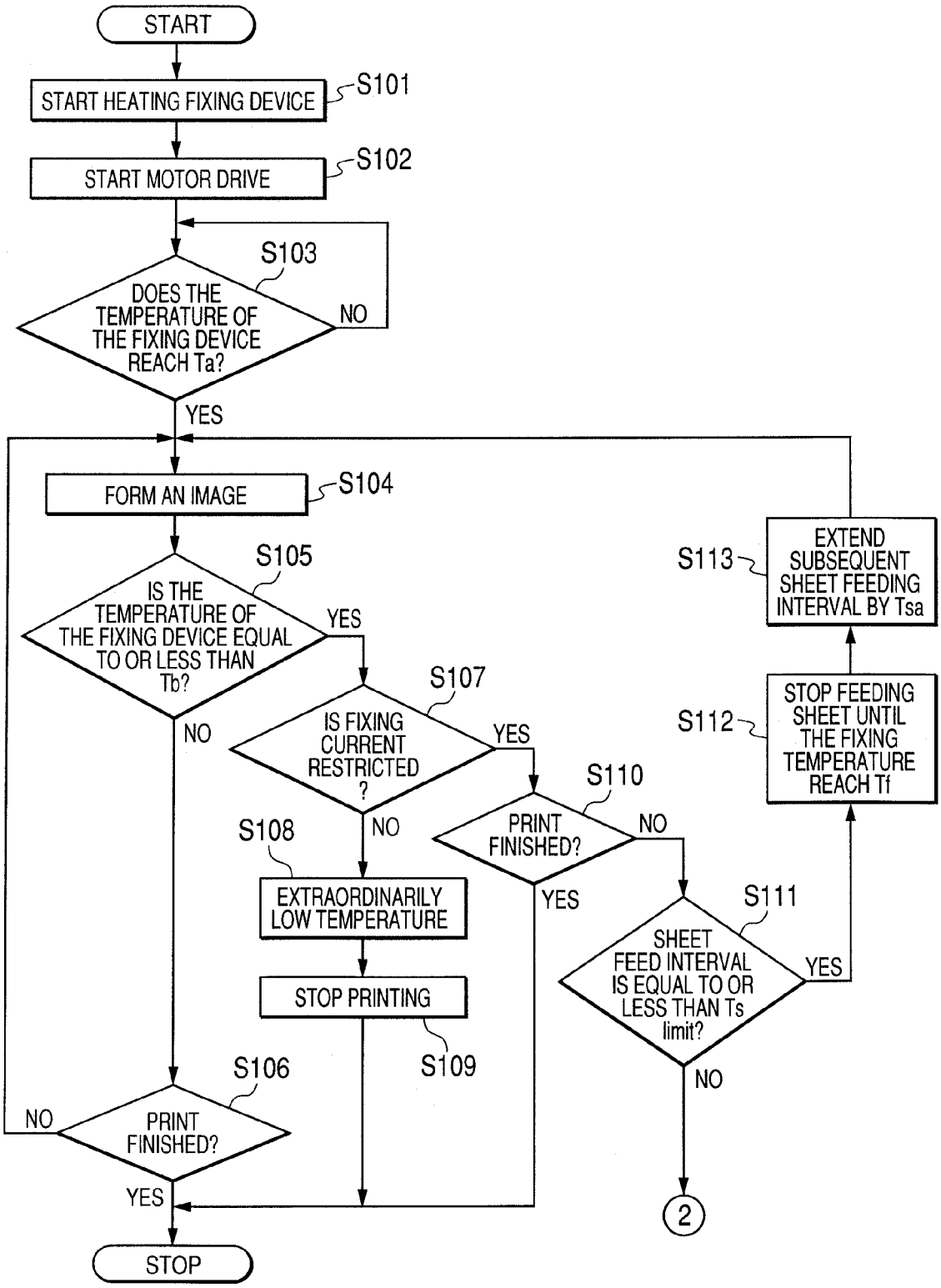
FIG. 1 is a diagram illustrating a flow chart (part 1) for describing an image forming operation according to Embodiment 1.
Figure 2:
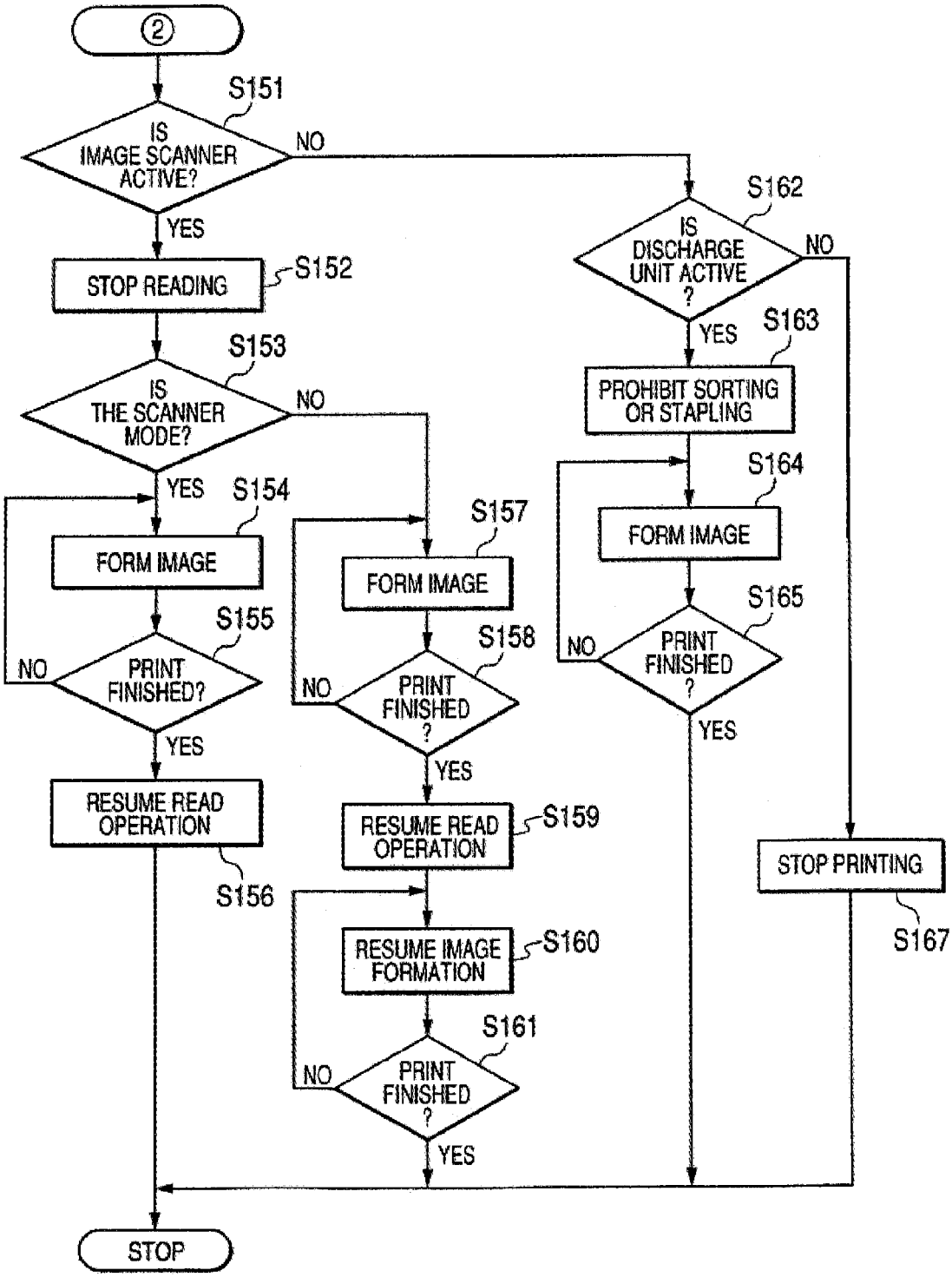
FIG. 2 is a diagram illustrating a flow chart (part 2) for describing the image forming operation according to Embodiment 1.

FIG. 1 and FIG. 2 are flow charts for describing the image forming operation according to this embodiment. Hereinafter, referring to FIG. 1 and FIG. 2, current suppression during successive image formation is described.

First, referring to FIG. 1, described is an adjustment operation at a second step for securing fixability while suppressing a current.

Upon start of the image formation, first, in S101, heating of the fixing roller 433 is started using the aforementioned method. In S102, drive of the motors including the main motor 451, the ETB motor 452, and the fixing motor 453 is started. In S103, it is determined whether or not the temperature of the fixing device 431 (detection temperature of the thermistor 530) has reached Ta, and when the temperature has reached Ta, the image formation is started in S104, feeding the recording paper 32 from the sheet feed cassette 402 at a predetermined timing. During the image formation, the current flowing into the fixing device 431 is controlled so that the temperature of the fixing device 431 maintains a control target temperature Tf. In this embodiment, the temperature Ta is set to be a temperature lower than the control target temperature Tf of the fixing device 431 during printing, but the temperature Ta may be set to be the same temperature as the control target temperature Tf, and may be set as required.

In S105, the temperature of the fixing device 431 is monitored, and when the temperature of the fixing device 431 is equal to or more than a predetermined temperature Tb (<Tf), the image formation is continued until the printing is finished in S106. In this embodiment, the temperature Tb is a fixable lower limit temperature, at which fixability of a toner image is secured. On the other hand, when the temperature of the fixing device 431 is detected to be equal to or less than Tb in S105, it is determined whether or not the fixing current is restricted in S107. When the fixing current is not restricted, it is determined that the fixing device 431 is at an extraordinarily low temperature in S108, and the printing is stopped in S109. When it is determined that the fixing current is restricted in S107, it is determined whether or not the image formation is to be continued in S110. When the last image formation is being performed, the image formation is ended when finished.

Figure 6:
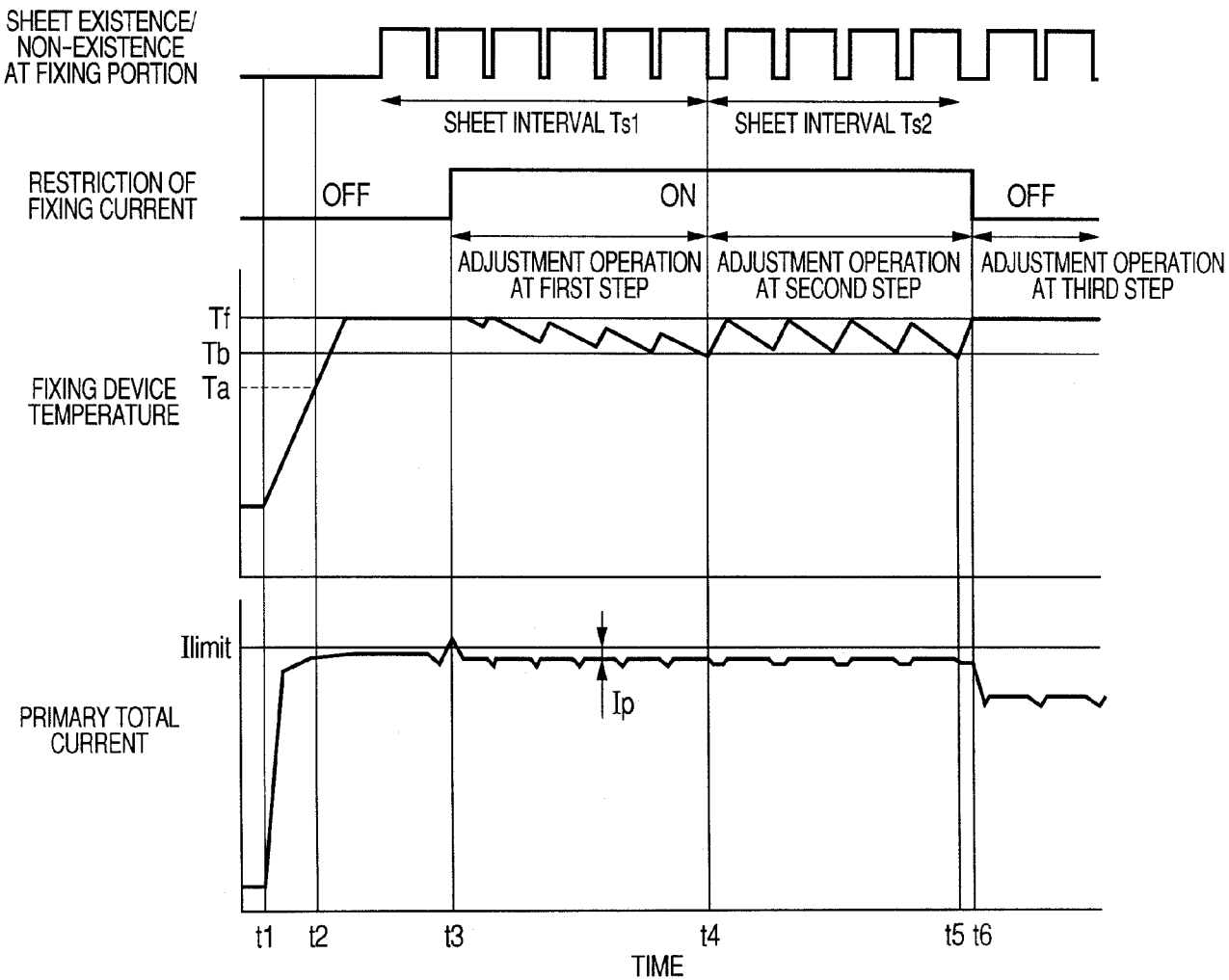
FIG. 6 is a diagram for describing a current suppressing operation according to Embodiment 1.

On the other hand, when the image formation is to be continued, a determination is made with regard to a sheet feed interval in S111. When the sheet feed interval is equal to or less than Tslimit, the image formation is temporarily stopped until the temperature (detection temperature of the thermistor 530) of the fixing device 431 increases to Tf in S112, and the subsequent sheet feed interval is extended by Tsa from the present sheet feed interval in S113. Thus, the sheet feed interval is changed from Ts1 to Ts2 (=Ts1+Tsa) (FIG. 6). Then, the image formation is continued in S104. In other words, a conveyance interval of a recording material to be conveyed to the fixing device 431 is widened. The extension of the sheet feed interval enables the temperature of the fixing device 431 to increase during the sheet feed interval, thereby mitigating temperature decline of the fixing device 431 even in the situation where a fixing current is suppressed (adjustment operation at second step).

When the temperature (detection temperature of the thermistor 530) of the fixing device 431 is equal to or less than Tb even after the sheet feed interval is extended, the image formation is continued through S107, S110, and S111 until the sheet feed interval reaches Tslimit (limit) while extending the sheet feed interval by Tsa for each time. In other words, when the temperature of the fixing portion has fallen below the predetermined temperature Tb in a situation where the conveyance interval of the recording material to be conveyed to the fixing portion is widened, the conveyance interval of the recording material to be conveyed to the fixing portion is further expanded. When the temperature (detection temperature of the thermistor 530) of the fixing device 431 is equal to or less than Tb despite the sheet feed interval being Tslimit (S111), an adjustment operation at a third step illustrated in FIG. 2 is performed. In other words, when the temperature of the fixing portion has fallen below the predetermined temperature Tb in the situation where the conveyance interval of the recording material to be conveyed to the fixing portion is widened up to a predetermined limit, at least one of operations of multiple option devices, which are provided to the apparatus, is restricted.

Next, referring to FIG. 2, the adjustment operation at the third step is described.

TABLE 1

| Image scanner | Sheet discharge option | Adjustment operation at third step |
|---|---|---|
| active | — | copy mode: stop reading → stop printing → resume reading → resume printing<br>scanner mode: stop reading → finish printing → resume reading |
| stopped or not available | active | prohibit a sorting and stapling operation |
| stopped or not available | stopped or not available | prohibit printing |

The adjustment operation at the third step suppresses the primary total current by restricting the image forming operation according to an operation state of the image forming apparatus as illustrated in Table 1 (stopping part of operations of multiple driving members (loads)).

As described above, the image forming apparatus according to this embodiment has the scanner mode, in which the image scanner 901 just reads an image of an original and converts the image into an electronic file, and the copy mode, in which the image scanner 901 reads an image of an original, and, according to the image information, the laser printer 401 forms an image on recording paper. Further, the image forming apparatus has the printer mode, in which the laser printer 401 forms an image on recording paper according to image information transmitted from the external device 441 such as the host computer. The printer mode is executable when an original is even being read in the scanner mode. Besides, the scanner mode is executable even when the image formation is being performed in the printer mode.

First, in S151, it is determined whether or not the image scanner 901 is active. If the image scanner 901 is active, this means that the scanner mode or the copy mode is being performed. When the image scanner 901 is active, a read operation is stopped in S152 (when a sheet of an original is being read with the read operation, the read operation is stopped after the original has been read completely), and it is determined which of the scanner mode and the copy mode is being performed in S153. When the scanner mode is being performed, the image formation is continued until the printing is finished in S154 and S155. After the printing is finished, the read operation is resumed in S156. It is in a case where an image is being formed with the printer mode that the image formation is performed in S154 despite the scanner mode being performed. In S154, the printer mode is an allowed state, and if new image information is transmitted from the external device 441, the image formation according to the image information is executable. In other words, what should be done is to avoid a situation where the laser printer 401 and the image scanner 901 are active at the same time. On the other hand, when it is determined that the scanner mode is not being performed in S153, that is, when the copy mode is being performed, after the image formation (image formation according to the image information that has already been read before the read operation is stopped in S152) of an original that has already been read is performed in S157 and S158, the read operation of a remaining original is performed in S159. Then, the printing of the remaining original, which has been read, is performed in S160 and S161.

When the image scanner 901 is not active, an operating state of the sheet discharge unit 801 is checked in S162. When the sheet discharge unit 801 is active, sorting and stapling operations are prohibited (recording paper in the process of sorting or stapling is completed until the end, and then, the operation is prohibited) in S163, and the image formation is continued until the printing is finished in S164 and S165. In S164, the printer mode is in the enabled state, and hence, the image formation in S164 means the image formation in the printer mode. Accordingly, if new image information is transmitted from the external device 441, the image formation according to the image information is executable. On the other hand, when the sheet discharge unit 801 is not active, it is determined that an abnormal current is flowing in the image forming apparatus, and the printing is stopped in S167.

FIG. 6 is a diagram illustrating a relation between the primary total current and the fixing device temperature in the case of the current suppression illustrated in FIG. 1 and FIG. 2. Referring to FIG. 6, a current suppression effect according to this embodiment is described.

Upon start of the image formation at t1, heating of the fixing device 431 is started, and also, drive of the motors, including the main motor 451, the ETB motor 452, the fixing motor 453, and the like is started. When the fixing device temperature reaches Ta at t2, the image formation is started, and the recording paper 32 is fed from the sheet feed cassette 402 at a predetermined timing. During the image formation, the fixing device temperature is controlled in such a manner as to keep the control target temperature Tf. However, because the primary total current exceeds Ilimit at t3, the fixing current is restricted by the method illustrated in FIG. 5, controlling the primary total current so as not to exceed Ilimit (adjustment operation at first step). Due to the restriction of the maximum value of the fixing current, however, the fixing device temperature gradually declines, and at t4, the fixing device temperature becomes equal to or less than the predetermined temperature Tb (temperature Tb lower by a predetermined value than the target temperature Tf at a steady-state). Thus, the image formation is temporarily stopped until the fixing device temperature increases to Tf, and the subsequent sheet feed interval is extended to Ts2 (adjustment operation at second step). The extension of the sheet feed interval enables the temperature of the fixing device 431 to increase during the sheet feed interval, mitigating the decline of the temperature of the fixing device 431 even in a situation where the fixing current is suppressed. In the adjustment operation at the second step, every time the fixing device temperature becomes equal to or less than Tb, the sheet feed interval is extended by the distance Tsa, which is executable until the sheet feed interval Ts2 eventually reaches the predetermined sheet feed interval upper limit Tslimit. Further, in a case where the image formation is continued, it is conceivable that the fixing device temperature becomes equal to or less than Tb again at t5. At that point of time, the sheet feed interval has already reached Tslimit. Therefore, as illustrated in Table 1, part of operations of the multiple driving members is restricted at t6. In this manner, the image formation is continued while the primary total current is held equal to or less than Ilimit, and the fixing device temperature is suppressed to be equal to or more than Tb (adjustment operation at third step).

As a result, the primary total current can be controlled so as not to exceed Ilimit, while occurrence of insufficient fixing of a toner image is prevented.

As described above, according to this embodiment, even in a case where a consumption current of the image forming apparatus has increased during successive image formation, the consumption current is controlled so as not to exceed the maximum current of the commercial power supply, desired fixability is secured, and decline of the image forming performance is minimized.

Embodiment 2

An "image forming apparatus" according to Embodiment 2 is described.

This embodiment is different from Embodiment 1 in that: not only the primary total current but also a current flowing into the fixing device 431 is detected; it is determined whether or not the increased primary total current is caused by increase of the current flowing into the fixing device 431; and the adjustment operation at the third step is set according to the determination result.

The entire structure of this embodiment is the same as the structure illustrated in FIG. 3 of Embodiment 1, and hence, by incorporating the description thereof, the redescription is herein omitted.

Figure 7:
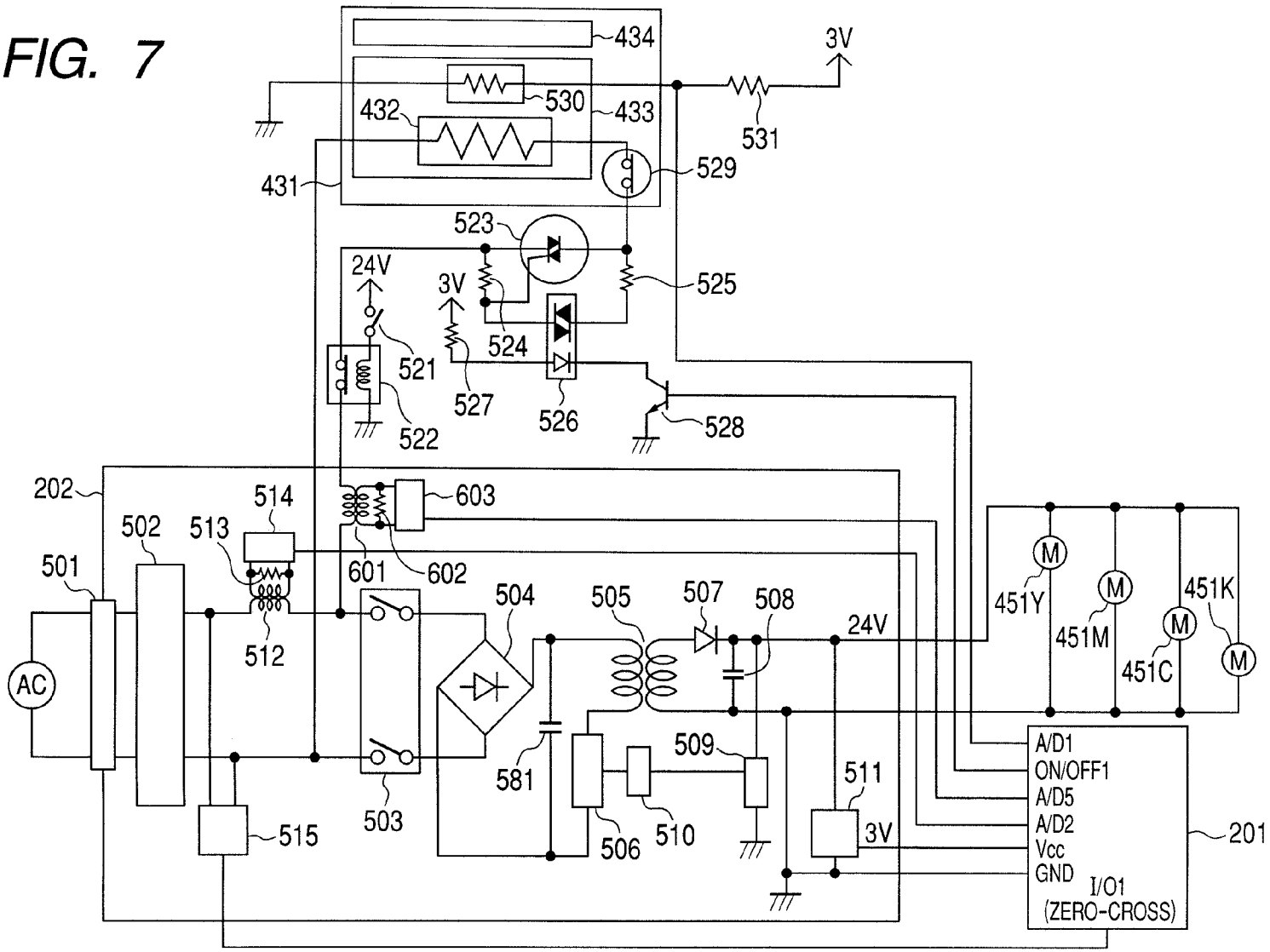
FIG. 7 is a diagram illustrating a circuit of an image forming apparatus according to Embodiment 2.

FIG. 7 is a circuit diagram of the image forming apparatus according to this embodiment. The components illustrated in FIG. 4 of Embodiment 1 are denoted by the same reference numerals, and the description thereof is omitted.

Reference numerals 601 and 602 denote a current transformer and a resistor, respectively, which cause the fixing current flowing into the heater 432 to be subjected to current-voltage conversion. A root mean square value is calculated by a fixing current detection circuit (second current detection circuit) 603 from the result of the current-voltage conversion, and the resultant value is output to an A/D port 5 of the DC controller 201. The DC controller 201 detects the fixing current based on the voltage value of the A/D port 5.

Figure 8:
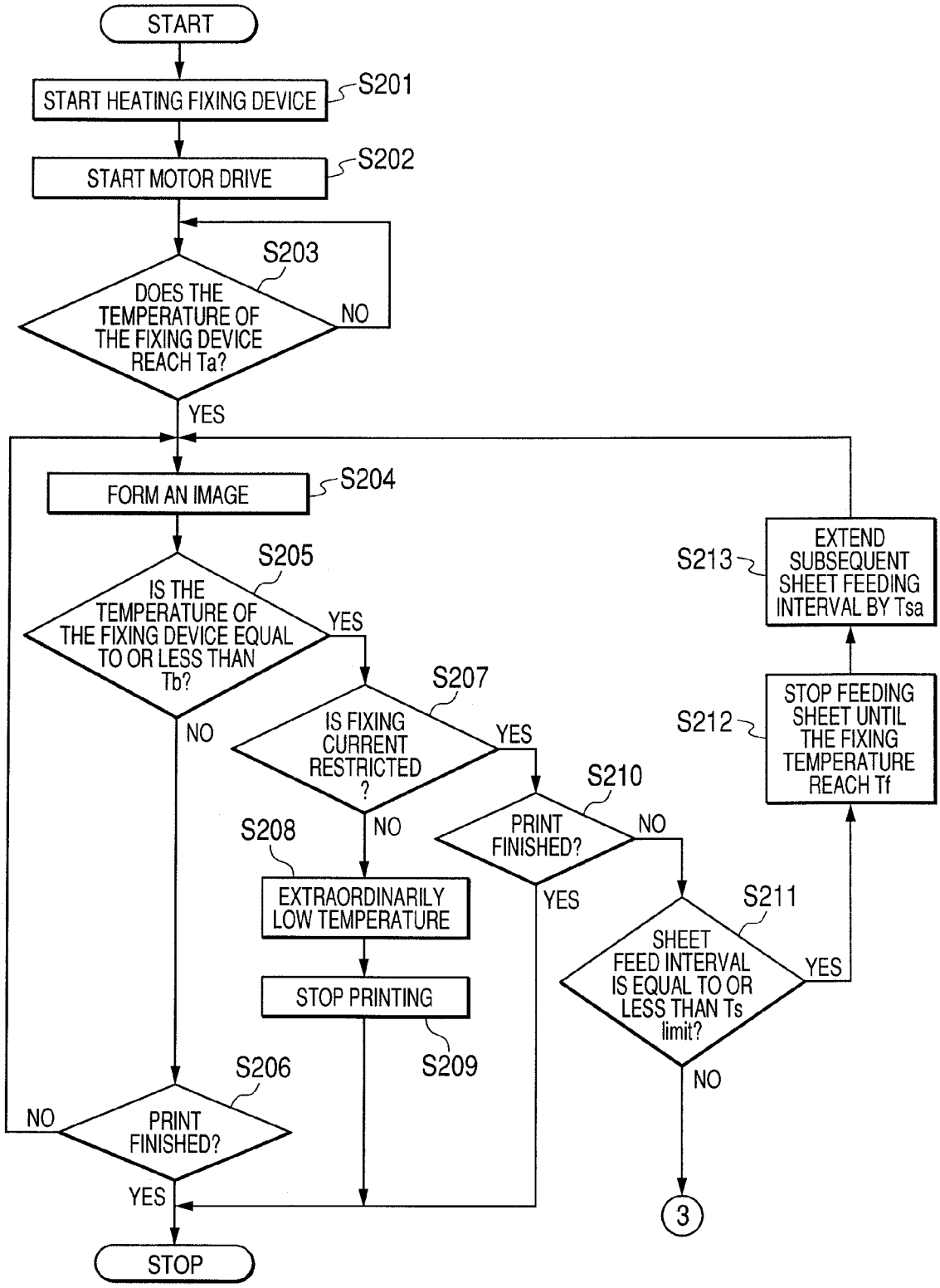
FIG. 8 is a diagram illustrating a flow chart (part 1) for describing an image forming operation according to Embodiment 2.
Figure 9:
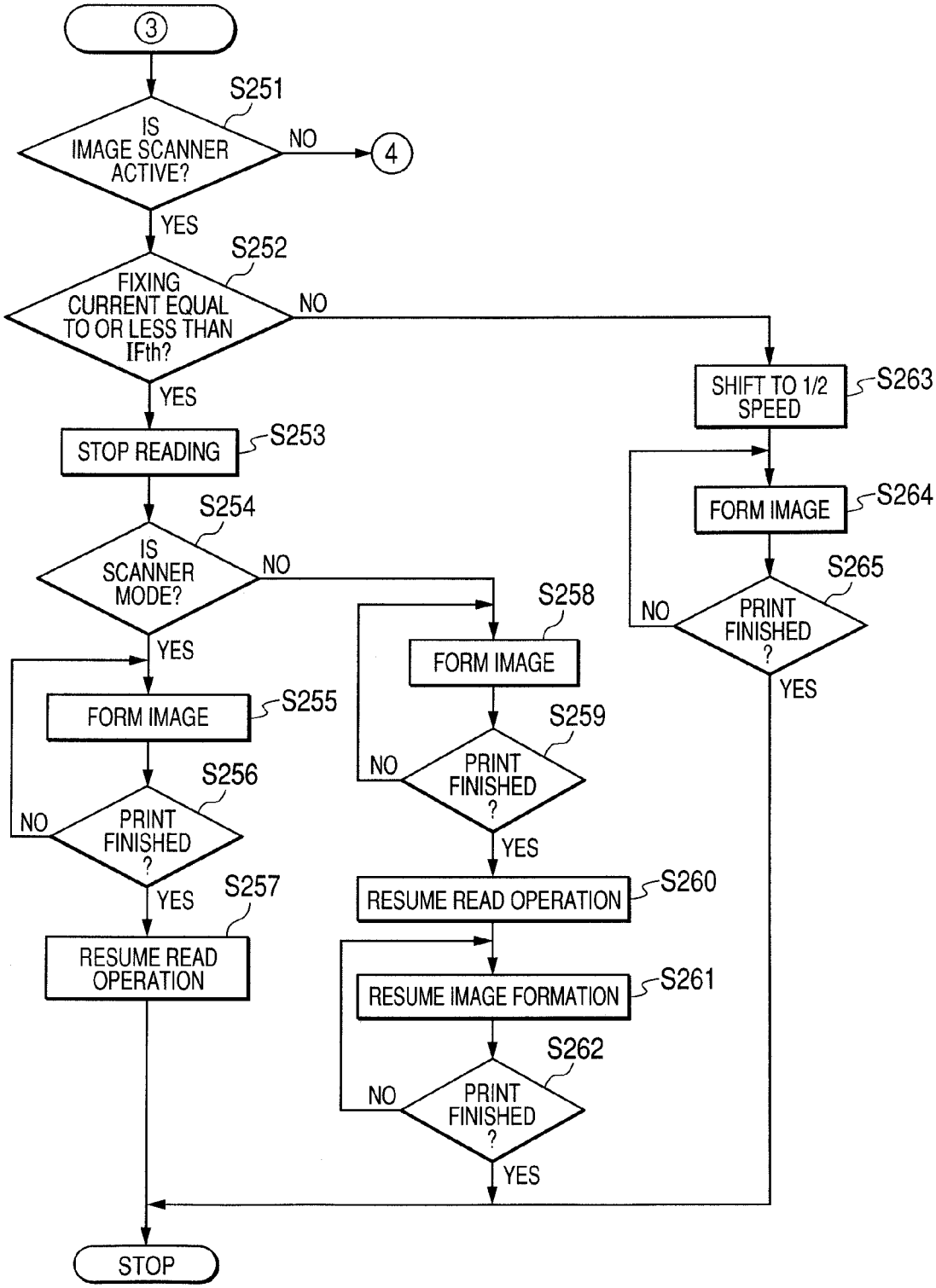
FIG. 9 is a diagram illustrating a flow chart (part 2) for describing the image forming operation according to Embodiment 2.
Figure 10:
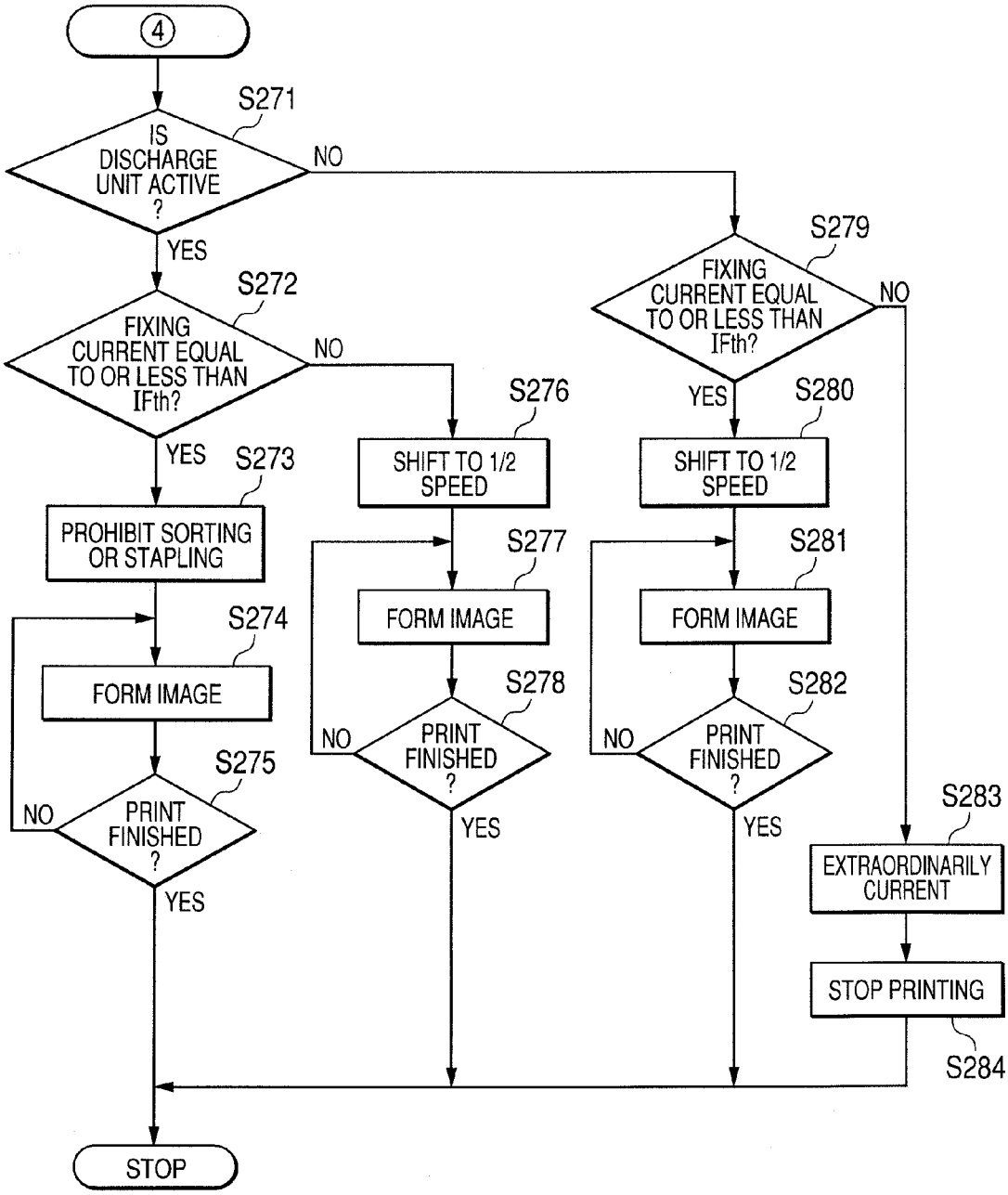
FIG. 10 is a diagram illustrating a flow chart (part 3) for describing the image forming operation according to Embodiment 2.

FIG. 8, FIG. 9, and FIG. 10 are flow charts illustrating an image forming operation according to this embodiment.

Hereinbelow, referring to FIGS. 8 to 10, an adjustment operation during successive image formation is described. First, referring to FIG. 8, an adjustment operation at a first step (current suppression operation) is described.

Upon start of the image formation, first, in S201, heating of the fixing roller 433 is started using the aforementioned method. In S202, drive of the motors including the main motor 451, the ETB motor 452, the fixing motor 453, and the like is started. In S203, it is determined whether or not the fixing device temperature has reached Ta, and when the fixing device temperature has reached Ta, the image formation is started in S204, feeding the recording paper 32 from the sheet feed cassette 402 at a predetermined timing. During the image formation, control is performed so that the temperature of the fixing device 431 maintains the control target temperature Tf.

In S205, the fixing device 431 temperature is monitored, and when the temperature of the fixing device 431 is equal to or more than the predetermined temperature Tb, the image formation is continued until the printing is finished in S206. On the other hand, when the temperature of the fixing device 431 is detected to be equal to or less than Tb in S205, it is determined whether or not the fixing current is restricted (adjustment operation at first step described above) in S207. When the fixing current is not restricted, it is determined that the fixing device 431 is at an extraordinarily low temperature in S208, and the printing is stopped in S209. When it is determined that the fixing current is restricted in S207, it is determined whether or not the image formation is to be continued in S210. When the last image formation is being performed, the image formation is ended when finished. On the other hand, when the image formation is to be continued, a determination is made with regard to the sheet feed interval in S211. When the sheet feed interval is equal to or less than Tslimit, the image formation is temporarily stopped until the temperature of the fixing device 431 increases to Tf in S212, and the subsequent sheet feed interval is extended by Tsa from the present sheet feed interval in S213 (adjustment operation at second step). Then, the image formation is continued in S204. The extension of the sheet feed interval enables the temperature of the fixing device 431 to increase during the sheet feed interval, thereby mitigating temperature decline of the fixing device 431 even in the situation where the fixing current is suppressed.

When the temperature of the fixing device 431 is equal to or less than the predetermined temperature Tb even after the sheet feed interval is extended, the image formation is continued through S207, S210, and S211 until the sheet feed interval reaches Tslimit while extending the sheet feed interval by the distance Tsa for each time. The operation so far is the same as the operation up until the adjustment operation at the second step of Embodiment 1.

When the temperature of the fixing device 431 is equal to or less than Tb despite the sheet feed interval having reached Tslimit (S211), an adjustment operation at a third step illustrated in FIG. 9 is performed.

Next, referring to FIG. 9 and FIG. 10, the adjustment operation at the third step of Embodiment 2 is described.

The adjustment operation at the third step of this embodiment suppresses the primary total current by restricting the image forming operation according to the operation state of the image forming apparatus and the fixing current, as illustrated in Table 2.

TABLE 2

| Image scanner | Sheet discharge option | Fixing current | Determination result | Adjustment operation at third step |
|---|---|---|---|---|
| active | — | less than IFth | motor current is large | copy mode: stop reading → stop printing → resume reading → resume printing scanner mode: stop reading → finish printing → resume reading |
| active | — | equal to or more than IFth | fixing current is large | down ½ speed |
| stopped or not available | active | less than IFth | motor current is large | prohibit a sorting or stapling operation |
| stopped or not available | active | equal to or more than IFth | fixing current is large | down ½ speed |
| stopped or not available | stopped or not available | less than IFth | motor current is large | prohibit printing |
| stopped or not available | stopped or not available | equal to or more than IFth | fixing current is large | down ½ speed |

First, in S251 of FIG. 9, it is determined whether or not the image scanner 901 is active. When the image scanner 901 is active, the fixing current is detected in S252. When the fixing current is less than IFth (detection value of the fixing current detection unit is less than a predetermined value), it is determined that a motor driving current is large (current that flows into loads other than the fixing device 431 is large), and the read operation is stopped in S253 (when a sheet of an original is being read in the read operation, the read operation is stopped after the original has been read completely). Subsequently, it is determined which of the scanner mode and the copy mode is being performed in S254. When the scanner mode is being performed, the image formation is continued until the printing is finished in S255 and S256 (image formation in the printer mode is allowed), and after the printing is finished, the read operation is resumed in S257. On the other hand, in the case of the copy mode, after the image formation of the original that has already been read is performed in S258 and S259, the remaining original is read in S260. Then, in S261 and S262, the printing of the read remaining original is performed.

In S252, when the fixing current is equal to or more than IFth (equal to or more than the predetermined value), it is determined that a toner image, which is formed on recording paper having a high heat capacity per unit volume (hereinafter, referred to as basic weight), is in the process of fixing. Therefore, a fixing speed is shifted to ½ speed in S263. In general, when fixing is performed on sheets of recording paper of the same basic weight, the fixing current becomes lower as the fixing speed becomes slower. In the case of the image forming apparatus of this embodiment, the fixing speed cannot be shifted alone, and hence, the image forming speed of the image forming portion is shifted to ½ speed at the same time. Then, the image formation is performed until the printing is finished in S264 and S265.

Next, referring to FIG. 10, an operation in a case where the image scanner 901 is not active is described. First, in S271, the operation state of the sheet discharge unit 801 is checked. When the sheet discharge unit 801 is active, the fixing current is detected in S272. When the fixing current is less than IFth, it is determined that the motor driving current is large (current that flows into loads other than the fixing device 431 is large), and the sorting and stapling operations are prohibited in S273 (recording paper in the process of sorting or stapling is completed until the end, and then, the operation is prohibited). Then, the image formation is performed in S274 until the printing is finished in S275 (an image formation in the printer mode is allowed).

In S272, when the fixing current is equal to or more than IFth, it is determined that the toner image, which is formed on the recording paper having a high basic weight, is in the process of fixing, and the image forming speed is shifted to ½ speed in S276. Then, the image formation is performed in S277 until the printing is finished in S278 (an image formation in the printer mode is allowed).

On the other hand, when it is determined that the sheet discharge unit 801 is not active in S271, the fixing current is detected in S279. When the fixing current is equal to or more than IFth, it is determined that the toner image, which is formed on the recording paper having a high basic weight, is in the process of fixing in S279, and the image forming speed is shifted to ½ speed in S280. The image formation is performed in S281 until the printing is finished in S282 (An image formation in the printer mode is allowed). When the fixing current is less than IFth, it is determined that an abnormal current is flowing in the image forming apparatus in S283, and the printing is stopped in S284.

As described above, according to this embodiment, even in a case where a consumption current of the image forming apparatus has increased during successive image formation, the consumption current is controlled so as not to exceed the maximum current of the commercial power supply, desired fixability is secured, and decline of the image formation performance is minimized.

Embodiment 3

An "image forming apparatus" according to Embodiment 3 is described. In this embodiment, not only the primary total current but also the basic weight of the recording paper and the circumferential temperature (environmental temperature) of the image forming apparatus are detected. Besides, it is determined whether or not the increased primary total current is due to increase of the current that flows into the fixing device 431, and the adjustment operation at the third step is selected according to the determination result. The entire structure of this embodiment is the same as the structure of Embodiment 1, and hence, by incorporating the description thereof, the redescription is herein omitted.

Figure 11:
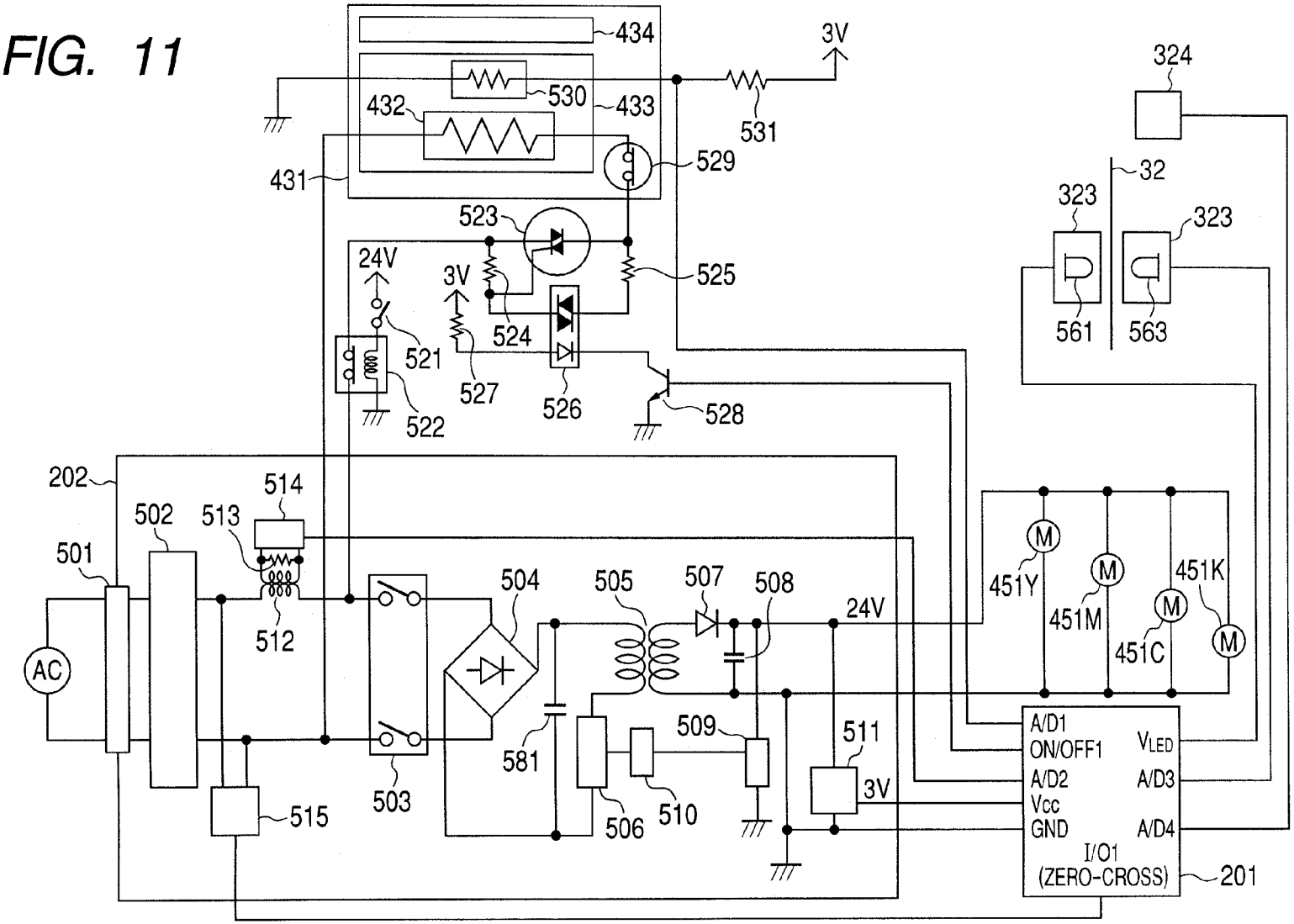
FIG. 11 is a diagram illustrating a circuit diagram of an image forming apparatus according to Embodiment 3.

FIG. 11 is a circuit diagram of the image forming apparatus according to this embodiment. The components illustrated in FIG. 4 of Embodiment 1 are denoted by the same reference numerals, and the description thereof is omitted.

Reference numeral 323 denotes a basic weight determination device (basic weight detection unit), which includes a light irradiation element 561 and a transmitted light amount detection element 563. The DC controller 201 turns on the light irradiation element 561 at a predetermined timing, at which the recording paper 32 reaches the basic weight determination device 323. The transmitted light amount detection element 563 generates an output, according to a received light amount, to an A/D port 3 of the DC controller 201, and the DC controller 201 detects the basic weight of the recording paper 32 based on the voltage value of the A/D port 3.

Reference numeral 324 denotes a temperature detection sensor (environmental temperature detection unit) for detecting the circumferential temperature of the image forming apparatus, which generates an output according to the detection temperature to an A/D port 4 of the DC controller 201. The DC controller 201 detects the circumferential temperature of the image forming apparatus based on the voltage value of the A/D port 4.

Figure 12:
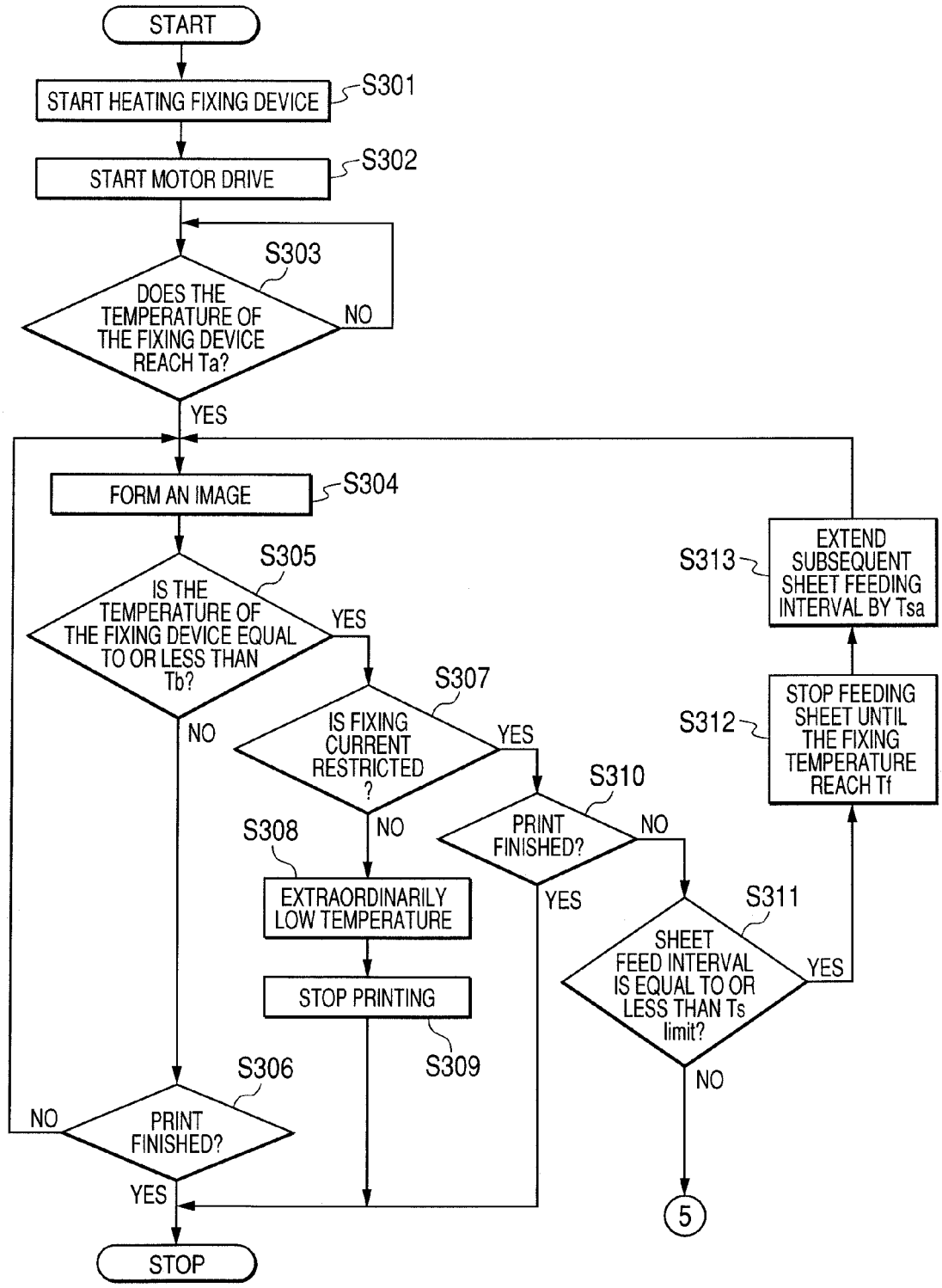
FIG. 12 is a diagram illustrating a flow chart (part 1) for describing an image forming operation according to Embodiment 3.
Figure 13:
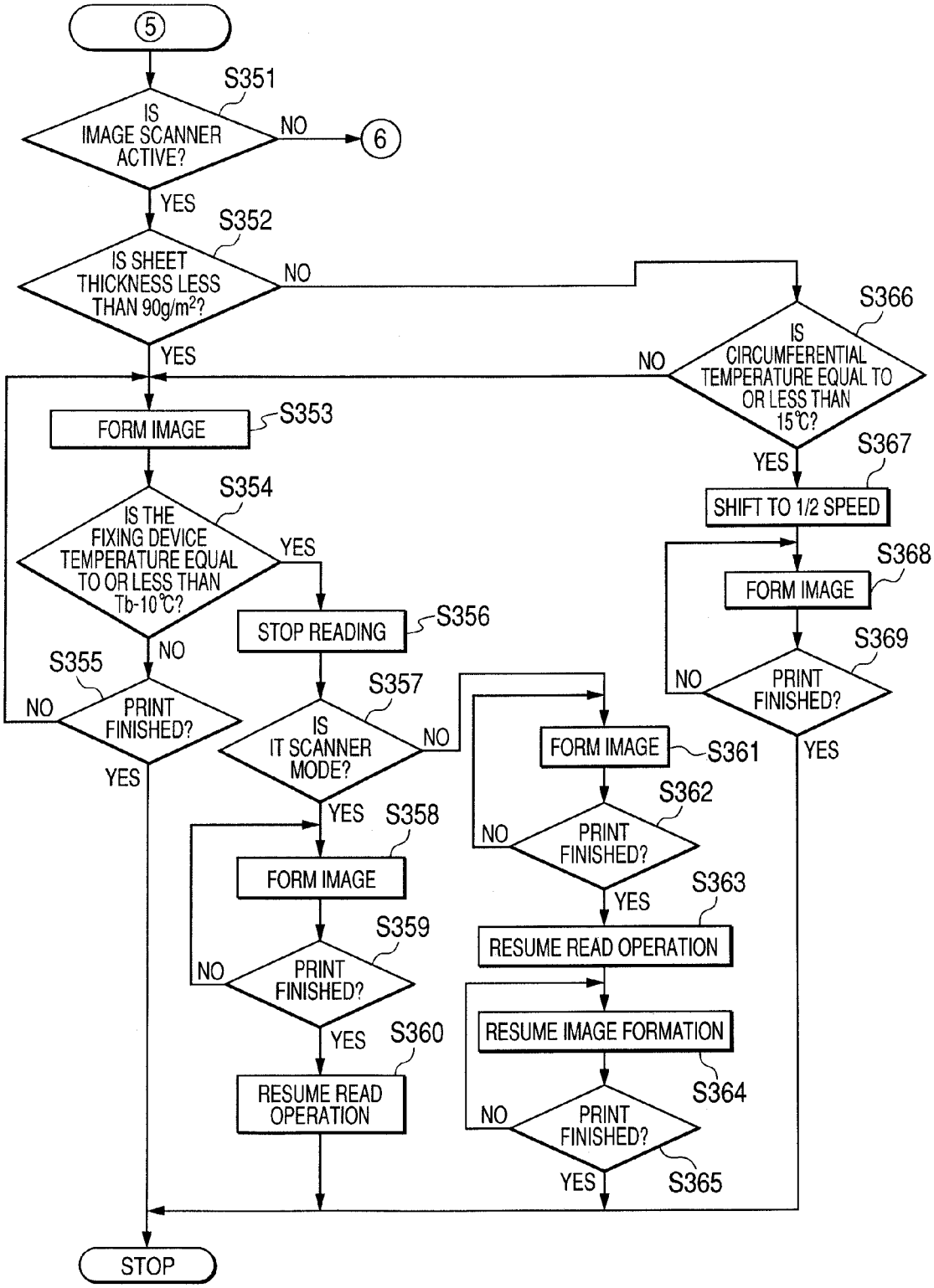
FIG. 13 is a diagram illustrating a flow chart (part 2) for describing the image forming operation according to Embodiment 3.
Figure 14:
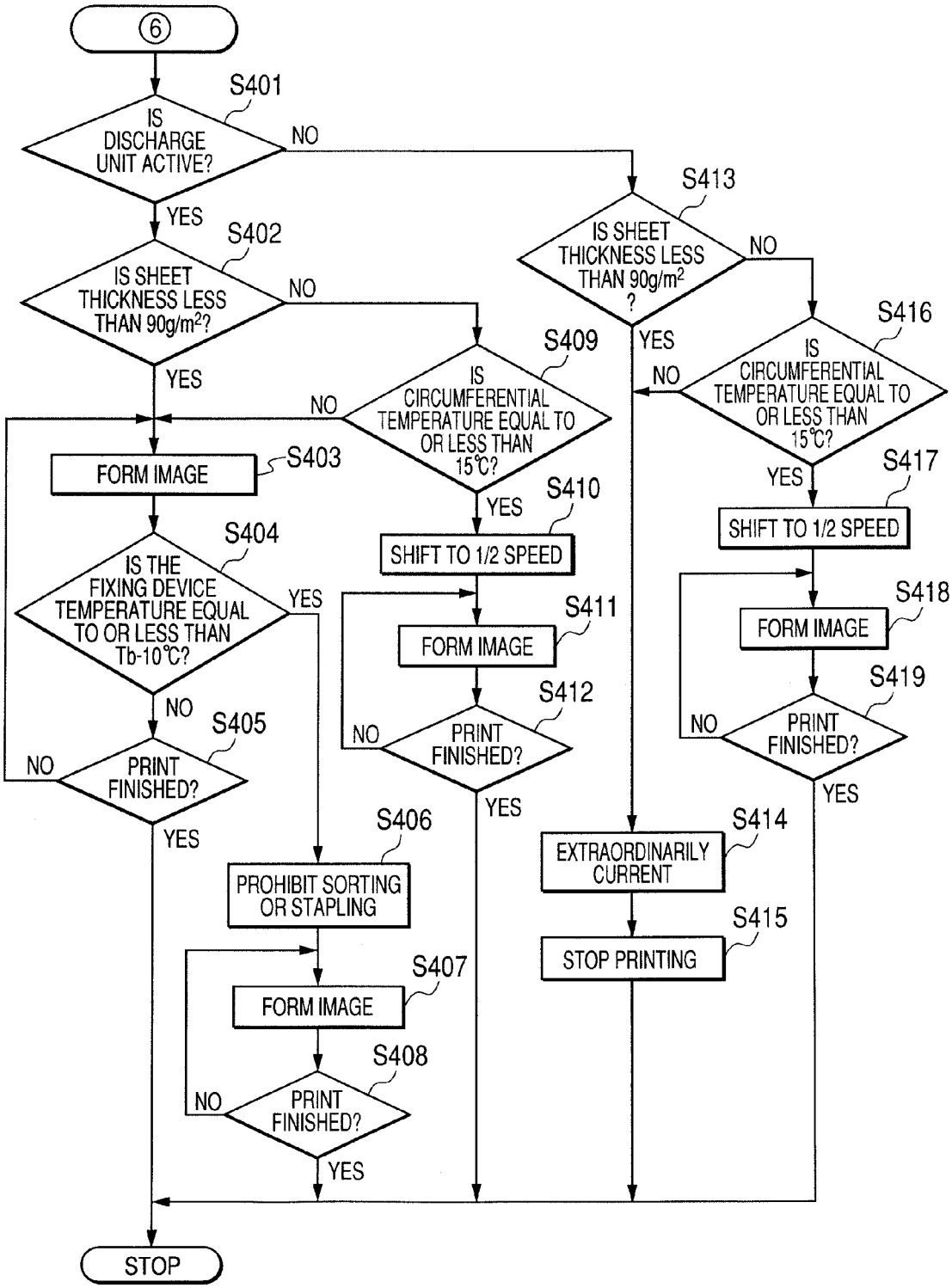
FIG. 14 is a diagram illustrating a flow chart (part 3) for describing the image forming operation according to Embodiment 3.

FIG. 12, FIG. 13, and FIG. 14 are flow charts illustrating an image forming operation of this embodiment. Hereinbelow, referring to FIGS. 12 to 14, a current suppression operation during successive image formation is described. First, referring to FIG. 12, an adjustment operation at a second step (extension of the sheet feed interval) is described.

Upon start of the image formation, first, in S301, heating of the fixing roller 433 is started using the aforementioned method, and in S302, drive of the motors including the main motor 451, the ETB motor 452, the fixing motor 453, and the like is started. In S303, it is determined whether or not the temperature of the fixing device 431 has reached Ta, and when the temperature of the fixing device 431 has reached Ta, the image formation is started in S304, feeding the recording paper 32 from the sheet feed cassette 402 at a predetermined timing. During the image formation, control is performed so that the control target temperature Tf is maintained. In S305, the temperature of the fixing device 431 is monitored, and when the temperature of the fixing device 431 is equal to or more than the predetermined temperature Tb, the image formation is continued until the printing is finished in S306.

On the other hand, when the temperature of the fixing device 431 is detected to be equal to or less than Tb in S305, it is determined whether or not the fixing current is restricted in S307 (whether or not the adjustment operation at the first step described above is being executed). When the fixing current is not restricted, it is determined that the fixing device 431 is at an extraordinarily low temperature in S308, and the printing is stopped in S309. When it is determined that the fixing current is restricted in S307, it is determined whether or not the image formation is to be continued in S310. When the last image formation is being performed, the image formation is ended when finished. On the other hand, when the image formation is to be continued, a determination is made with regard to the sheet feed interval in S311. When the sheet feed interval is equal to or less than Tslimit, the image formation is temporarily stopped until the temperature of the fixing device 431 increases to Tf in S312, and the subsequent sheet feed interval is extended by Tsa from the present sheet feed interval in S313 (adjustment operation at second step). Then, the image formation is continued in S304. The extension of the sheet feed interval enables the temperature of the fixing device 431 to increase during the sheet feed interval, thereby mitigating temperature decline of the fixing device 431 even in the situation where the fixing current is suppressed.

When the temperature of the fixing device 431 is equal to or less than the predetermined temperature Tb even after the sheet feed interval is extended, the image formation is continued through S307, S310, and S311 until the sheet feed interval reaches Tslimit while extending the sheet feed interval by Tsa for each time. When the fixing device temperature is equal to or less than Tb despite the sheet feed interval having reached Tslimit (S311), an adjustment operation at a third step illustrated in FIG. 13 and FIG. 14 is performed.

Next, referring to FIG. 13 and FIG. 14, the adjustment operation at the third step is described.

The adjustment operation at the third step controls the primary total current by restricting the image forming operation according to the operation state of the image forming apparatus, the basic weight of the recording paper, and the circumferential temperature, as illustrated in Table 3.

TABLE 3

| Sheet | Circum- | Determi- |
|---|---|---|

| Image scanner | discharge option | Basic weight | ferential temperature | nation result | Adjustment operation at third step |
|---|---|---|---|---|---|
| active | — | less than 90 g/m$^2$ | — | motor current is large | (1) decrease the fixing temperature for operating the second current suppression unit by 10° C.<br>(2) fixing temperature is equal to or less than Tb-10° C.<br>copy mode: stop reading → stop printing → resume reading → resume printing<br>scanner mode: stop reading → finish printing → resume reading |
| | | equal to or more than 90 g/m$^2$ | equal to or more than 15° C. | | |
| | | equal to or more than 90 g/m$^2$ | less than 15° C. | fixing current is large | down ½ speed |
| stopped or not available | active | less than 90 g/m$^2$ | — | motor current is large | (1) decrease the fixing temperature for operating the second current suppression unit by 10° C.<br>(2) fixing temperature is equal to or less than Tb-10° C.<br>→ prohibit a sorting and stapling operation |
| | | equal to or more than 90 g/m$^2$ | equal to or more than 15° C. | | |
| | | equal to or more than 90 g/m$^2$ | less than 15° C. | fixing current is large | down ½ speed |
| stopped or not available | stopped or not available | less than 90 g/m$^2$ | — | motor current is large | prohibit printing |
| | | equal to or more than 90 g/m$^2$ | equal to or more than 15° C. | | |
| | | equal to or more than 90 g/m$^2$ | less than 15° C. | fixing current is large | down ½ speed |

First, in S351 of FIG. 13, it is determined whether or not the image scanner 901 is active. When the image scanner 901 is active, the basic weight of the recording paper is detected in S352. When the basic weight is less than 90 g/m$^2$, it is determined that the fixing is possible even though the fixing device temperature is Tb, and the image formation is performed in S353. Then, when the fixing device temperature is higher than Tb−10° C., the image formation is continued until the printing is finished in S353, S354, and S355.

When the fixing device temperature is equal to or less than Tb−10° C. (S354), the read operation is stopped in S356. Subsequently, in S357, it is determined which of the scanner mode and the copy mode is being performed. When the scanner mode is being performed, the image formation is continued until the printing is finished in S358 and S359, and after the printing is finished, the read operation is resumed in S360. On the other hand, when the copy mode is being performed, after the image formation of the original that has already been read is performed in S361 and S362, the reading of the remaining original is performed in S363. Then, in S364 and S365, the printing of the read remaining original is performed.

In S352, when the basic weight is equal to or more than 90 g/m$^2$, the circumferential temperature is detected in S366. In general, the circumferential temperature and the temperature of the recording paper are equal. Thus, the fixing device temperature needs to be higher as the recording paper temperature becomes lower. In S366, when it is determined that the circumferential temperature is equal to or more than 15° C., it is determined that the fixing is possible even if the fixing device temperature is low, and the processing returns to S353 to perform the aforementioned operation. On the other hand, when the circumferential temperature is less than 15° C., it is determined that the fixing device temperature needs to be kept equal to or more than Tb, and the image forming speed is shifted to ½ speed in S367. Then, the image formation is performed until the printing is finished in S368 and S369.

Next, referring to FIG. 14, an operation in a case where the image scanner 901 is not active in S351 is described. First, the operation state of the sheet discharge unit 801 is checked in S401. When the sheet discharge unit 801 is active, the basic weight of the recording paper 32 is detected in S402. When the basic weight is less than 90 g/m$^2$, it is determined that the fixing is possible even if the fixing device temperature is Tb, and the image formation is performed in S403. Then, when the fixing device temperature is higher than Tb−10° C., the image formation is continued until the printing is finished in S403, S404, and S405. When the fixing device temperature is equal to or less than Tb−10° C. (S404), a sorting and stapling operation is prohibited in S406. Then, the image formation is performed until the printing is finished in S407 and S408.

In S402, when the basic weight of the recording paper 32 is equal to or more than 90 g/m$^2$, the circumferential temperature is detected in S409. When the circumferential temperature is equal to or more than 15° C., it is determined that the fixing is possible even if the fixing device temperature is low, and the processing returns to S403 to perform the aforementioned operation. On the other hand, when the circumferential temperature is less than 15° C., it is determined that the fixing device temperature needs to be kept equal to or more than Tb, and the image forming speed is shifted to ½ speed in S410. Then, the image formation is performed until the printing is finished in S411 and S412.

On the other hand, when it is determined that the sheet discharge unit 801 is not active in S401, the basic weight of the recording paper 32 is detected in S413. When the basic weight is less than 90 g/m$^2$, it is determined that the reason why the primary total current is large in S414 is that an abnormal current is flowing in the image forming apparatus, and the printing is stopped in S415. When the basic weight is equal to or more than 90 g/m$^2$, the circumferential temperature is detected in S416. When the circumferential temperature is equal to or more than 15° C., it is determined that the reason why the primary total current is large is that an abnormal current is flowing in the image forming apparatus, and the processing returns to S415 to stop the printing. When the circumferential temperature is less than 15° C., it is determined that the fixing device temperature needs to be kept equal to or more than Tb, and the image forming speed is shifted to ½ speed in S417. Then, the image formation is performed until the printing is finished in S418 and S419.

As described above, according to this embodiment, by performing the aforementioned control, even in a case where a consumption current of the image forming apparatus has increased during successive image formation, the consumption current is controlled so as not to exceed the maximum current of the commercial power supply, desired fixability is secured, and decline of the image formation performance is minimized.

It should be noted that, in Embodiments 1 to 3, the description is made using the color laser printer, but the image forming apparatus is not limited to the color laser printer, and may be a monochrome laser printer.

Further, the execution of the adjustment operation at the third step may be determined according to the operation state of the optional sheet feed unit.

In Embodiments 1 to 3, the description is made, assuming that the predetermined temperatures for reference are Tb both in the case where the adjustment operation at the second step (extension of the sheet feed interval) is executed and in the case where the adjustment operation at the third step (prohibition of driving loads other than the fixing device 431) is executed. However, the reference temperatures may be different from each other for the respective adjustment operations.

In Embodiment 2, the primary total current and the current flowing into the fixing device 431 are detected, and it is determined whether or not the increase of the primary total current results from the increase of the current flowing into the fixing device 431. However, the determination as to whether or not the increase of the primary total current results from the increase of the current flowing into the fixing device 431 may be made, for example, based on a difference between the primary total currents when the fixing device 431 is turned on and when the fixing device 431 is turned off, by detecting the primary total current alone.

Further, in Embodiments 1 to 3 described above, the image forming apparatus, to which the adjustment operations from the first step to the third step are set, is described, but at least setting the adjustment operations at the first step and the second step may be sufficient for the image forming apparatus. With such a structure, it is possible to provide an image forming apparatus capable of suppressing decline of the processing performance while suppressing an input current from the commercial power supply to the image forming apparatus to be equal to or less than a predetermined value.

Next, in the following Embodiments 4 to 7, described are other embodiments of the image forming apparatus capable of suppressing the decline of the processing performance while suppressing an input current from the commercial power supply to the image forming apparatus to be equal to or less than a predetermined value. A difference from Embodiments 1 to 3 is a method of deciding an upper limit value of a current that is suppliable to the fixing device 431 in the aforementioned adjustment operation at the first step (current restriction to the fixing device 431). Using Embodiments 4 to 7 as the adjustment operation at the first step, the decline of the processing performance of the image forming apparatus can be further suppressed.

Embodiment 4

Figure 15:
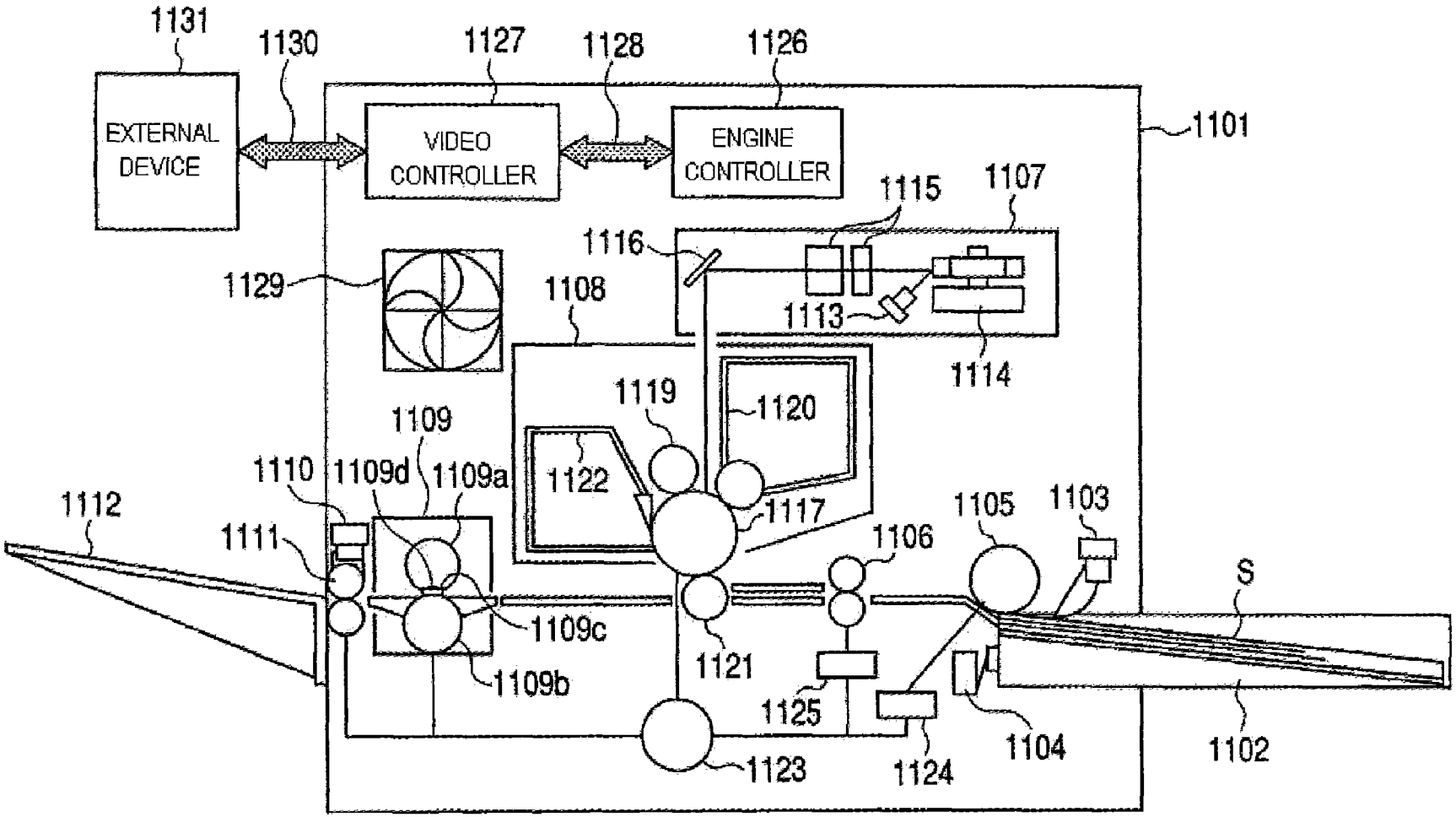
FIG. 15 is a schematic structural diagram of an image forming apparatus (laser printer) using an electrophotographic process according to Embodiments 4 to 7.

FIG. 15 is a schematic structural diagram of an image forming apparatus using an electrophotographic process (laser printer) according to Embodiments 4 to 7.

A laser printer main body 1101 (hereinafter, referred to as main body 1101), to which a cassette 1102 for housing a recording sheet S can be attached, forms an image on the recording sheets S provided from the cassette 1102. Reference numeral 1103 denotes a cassette existence/non-existence sensor for detecting existence/non-existence of the recording sheet S in the cassette 1102. Reference numeral 1104 denotes a cassette size sensor for detecting a size of the recording sheet S housed in the cassette 1102, which is, for example, configured of multiple microswitches. Reference numeral 1105 denotes a sheet feed roller for picking up and conveying the recording sheet S from the cassette 1102. Downstream of the sheet feed roller 1105, provided is a registration roller pair 1106 for conveying the recording sheet S synchronously. Further, downstream of the registration roller pair 1106, provided is an image forming portion 1108 for forming a toner image on the recording sheet S based on a laser beam from a laser scanner portion 1107. Further, downstream of the image forming portion 1108, provided is a fixing device 1109 for heat-fixing the toner image formed on the recording sheet S. Further, downstream of the fixing device 1109, provided are a sheet discharge sensor 1110 for detecting a conveying state of a sheet discharge portion, a sheet discharge roller pair 1111 for discharging the recording sheet S, and a stacking tray 1112 for stacking and housing the recording sheets S, on which images are formed and fixed. It should be noted that, herein, a conveyance reference of the recording sheet S is set in a manner that the conveyance reference is substantially in the center of a length direction perpendicular to the conveyance direction of the recording sheet S, that is, substantially in the center of the width of the recording sheet S.

The laser scanner portion 1107 also includes a laser unit 1113 that emits a modulated laser beam based on an image signal (image signal VDO) transmitted from the external device 1131. The laser beam from the laser unit 1113 is reflected by a polygon mirror that is rotatably driven by a polygon motor 1114, and then reflected by imaging lenses 1115, a reflecting mirror 1116, and the like, thereby scanning a photosensitive drum 1117.

The image forming portion 1108 includes the photosensitive drum 1117, a primary charge roller 1119, a developing device 1120, a transferring charge roller 1121, a cleaner 1122, and the like, which are necessary for a well-known electrophotographic process. The fixing device 1109 includes a fixing film 1109*a*, a pressure roller 1109*b*, a ceramic heater 1109*c* for heating, which is provided inside the fixing film 1109*a*, and a thermistor 1109*d* for detecting a surface temperature of the ceramic heater 1109*c*.

A main motor 1123 provides rotation force to the sheet feed roller 1105 via a sheet feed roller clutch 1124. The main motor 1123 also provides rotation force to the registration roller pair 1106 via a registration roller clutch 1125. Further, the main motor 1123 provides drive force to the respective units of the image forming portion 1108 including the photosensitive drum 1117, the fixing device 1109, and the sheet discharge roller pair 1111.

Reference numeral 1126 denotes an engine controller, which performs control including control of the electrophotographic process by the laser scanner portion 1107, the image forming portion 1108, and the fixing device 1109, and conveyance control of the recording sheet S in the main body 1101. Reference numeral 1127 denotes a video controller, which is connected to the external device 1131 such as a personal computer by means of a general-purpose interface (e.g. Centronics or RS232C) 1130. The video controller 1127 converts image information, which is transmitted via the general-purpose interface 1130, into bit data, and transmits 1128 the bit data to the engine controller 1126 as a VDO signal. The air fan 1129 evacuates air in the apparatus.

Figure 16:
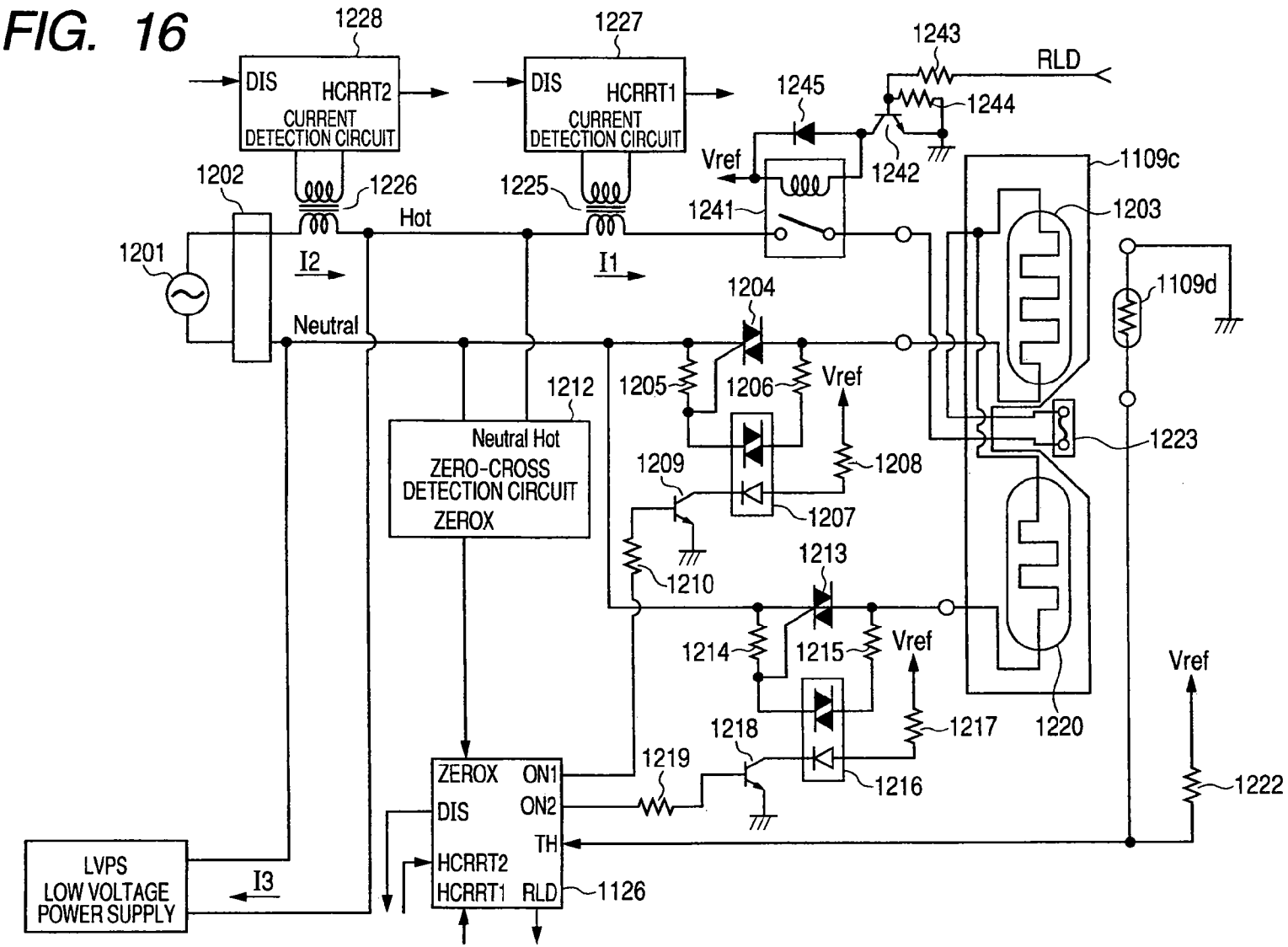
FIG. 16 is a block diagram illustrating a structure of a heater control circuit for controlling electrification drive of a ceramic heater.

FIG. 16 is a block diagram illustrating a structure of a heater control circuit (power supply control circuit) for controlling electrification drive of the ceramic heater 1109*c* according to the embodiment mode of the present invention.

Reference numeral 1201 denotes an alternating-current power supply (commercial power supply), to which the image forming apparatus is connected. The image forming apparatus provides the alternating-current power supply 1201 to a heating member 1203 and a heating member 1220 of the ceramic heater 1109*c* via an AC filter 1202 and a relay 1241, thereby heating the heating member 1203 and the heating member 1220 constituting the ceramic heater 1109*c*. Power supply to the heating member 1203 is controlled by electrification and cutoff of a triac 1204 (electrification switching control). Resistors 1205 and 1206 are bias resistors of the triac 1204, and a photo-triac-coupler 1207 is a device for securing a creepage distance between the primary side and the secondary side. By electrifying a light emitting diode of the photo-triac-coupler 1207, the triac 1204 is turned on. A resistor 1208 is a resistor for restricting a current that flows into the photo-triac-coupler 1207, and electrification of the photo-triac-coupler 1207 is switched on/off by a transistor 1209. The transistor 1209 operates according to a signal (ON1) supplied from the engine controller 1126 via a resistor 1210.

Further, electric power supply to the heating member 1220 is controlled by electrification and cutoff of a triac 1213. Resistors 1214 and 1215 are bias resistors of the triac 1213, and a photo-triac-coupler 1216 is a device for securing a creepage distance between the primary side and the secondary side. By electrifying a light emitting diode of the photo-triac-coupler 1216, the triac 1213 can be switched on. A resistor 1217 is a resistor for restricting a current that flows into the photo-triac-coupler 1216. A transistor 1218 switches on/off the electrification of the photo-triac-coupler 1216 according to a signal (ON2) supplied from the engine controller 1126 via a resistor 1219.

The alternating-current power supply 1201 is input to a zero-cross detection circuit 1212 via the AC filter 1202. The zero-cross detection circuit 1212 notifies, using a pulse signal, the engine controller 1126 that the voltage of the alternating-current power supply 1201 is equal to or less than a threshold. Hereinafter, the signal transmitted to the engine controller 1126 is referred to as a ZEROX signal. The engine controller 1126 detects a pulse edge of the ZEROX signal, and performs ON/OFF control of the triac 1204 or 1213 by means of phase control or wave number control.

A heater current, which electrifies the heating members 1203 and 1220 through activating the triacs 1204 and 1213, is subjected to voltage conversion by a current transformer 1225, and is input to a current detection circuit (second current detection circuit) 1227. The current detection circuit 1227 converts the heater current wave pattern, which has been subjected to the voltage conversion, into a root mean square value or a square value thereof, which value is then input to the engine controller 1126 as an HCRRT1 signal. The HCRRT1 signal thus input is subjected to A/D conversion by the engine controller 1126, and managed as a digital value.

Besides, a current, which is input from the alternating-current power supply 1201 via the AC filter 1202, is subjected to voltage conversion by a current transformer 1226, and is input to a current detection circuit (first current detection circuit) 1228. In the current detection circuit 1228, a combined current wave pattern of the voltage-converted heater current wave pattern and a low voltage power supply current wave pattern is converted into a root mean square value or a square value thereof, which value is then input to the engine controller 1126 as an HCRRT2 signal. The HCRRT2 signal thus input is subjected to A/D conversion by the engine controller 1126, and managed as a digital value. The first current detection circuit 1228 is a circuit for detecting an input current (primary total current) from the commercial power supply to the image forming apparatus, whereas the second current detection circuit 1227 is a circuit for detecting a current that flows into the fixing device 1109.

The thermistor (temperature detection element) 1109*d* is an element for detecting a temperature of the ceramic heater 1109*c* in which the heating members 1203 and 1220 are formed. The thermistor 1109*d* is so disposed on the ceramic heater 1109*c* through the intermediary of an insulator having a withstand voltage that an insulation distance can be secured with respect to the heating members 1203 and 1220. The temperature detected by the thermistor 1109*d* is detected as a divided voltage between the resistor 1222 and the thermistor 1109*d*, and is input to the engine controller 1126 as a TH signal. The TH signal thus input is subjected to A/D conversion by the engine controller 1126, and managed as a digital value.

The temperature of the ceramic heater 1109*c* is monitored by the engine controller 1126 as the TH signal. Then, by a comparison with a preset temperature (control target temperature) of the ceramic heater 1109*c*, which is set in the engine controller 1126, a power ratio (duty), which is to be supplied to the heating members 1203 and 1220 constituting the ceramic heater 1109*c*, is calculated. A phase angle (phase control) or a wave number (wave number control), which corresponds to the power ratio to be supplied, is calculated, and, according to the control condition, the engine controller 1126 transmits an ON1 signal to the transistor 1209 or an ON2 signal to the transistor 1218. In this manner, the temperature of the ceramic heater 1109*c* is controlled. In calculating the power ratio to be supplied to the heating members 1203 and 1220, based on the HCRRT1 signal and the HCRRT2 signal notified by the current detection circuit 1227 and the current detection circuit 1228, an upper limit power ratio is accurately calculated, and control is performed so that power equal to or less than the upper limit power is provided. For example, in the case of the phase control, such a control table as described below is provided to the engine controller 1126, which performs the control based on the control table.

TABLE 4

| Power ratio duty D (%) | Phase angle α(°) |
|---|---|
| 100 | 0 |
| 97.5 | 28.56 |
| . | . |
| . | . |
| . | . |
| 75 | 66.17 |

TABLE 4-continued

| Power ratio duty D (%) | Phase angle α(°) |
|---|---|
| . | . |
| . | . |
| . | . |
| 50 | 90 |
| . | . |
| . | . |
| . | . |
| 25 | 113.83 |
| . | . |
| . | . |
| . | . |
| 2.5 | 151.44 |
| 0 | 180 |

Further, in case that a circuit, which supplies power to and controls the heating members 1203 and 1220, breaks down, causing thermal runaway of the heating members 1203 and 1220, an excess temperature increase prevention portion 1223 is provided to the ceramic heater 1109*c* as means to prevent excess temperature increase. The excess temperature increase prevention portion 1223 includes, for example, a thermal fuse and a thermoswitch. When the thermal runaway of the heating members 1203 and 1220 has occurred, causing the excess temperature increase prevention portion 1223 to be equal to or more than a predetermined temperature, the excess temperature increase prevention portion 1223 becomes in an open state, cutting off the current flowing into the heating members 1203 and 1220.

In addition, for the purpose of controlling the temperature of the ceramic heater 1109*c*, which is monitored as the TH signal, apart from the preset temperature for controlling the temperature, an extraordinary temperature value for detecting an extraordinarily high temperature is set in the engine controller 1126. Accordingly, when temperature information indicated by the TH signal becomes equal to or larger than the extraordinary temperature value, the engine controller 1126 sets an RLD signal to a low level. Then, a transistor 1242 becomes an off state, opening the relay 1241. In this manner, the current flowing into the heating members 1203 and 1220 is cut off. Normally, during the temperature control, the engine controller 1126 constantly outputs the RLD signal at high level, keeping the transistor 1242 switched on, and keeping the relay 1241 switched on (conduction state). Reference numeral 1243 denotes a current restriction resistor, and a resistor 1244 is a bias resistor for the transistor 1242 between the base and the emitter. A diode 1245 is an absorption element for absorbing counter electromotive force at the time of the relay 1241 being in the off state.

Figure 17A:
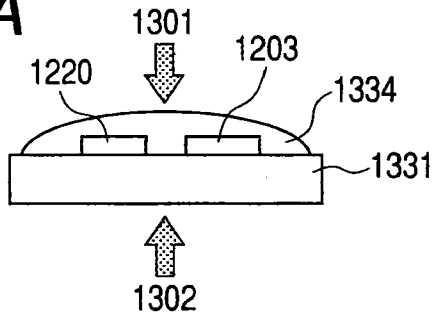
FIGS. 17A and 17B are diagrams describing an overview of the ceramic heater.
Figure 17B:
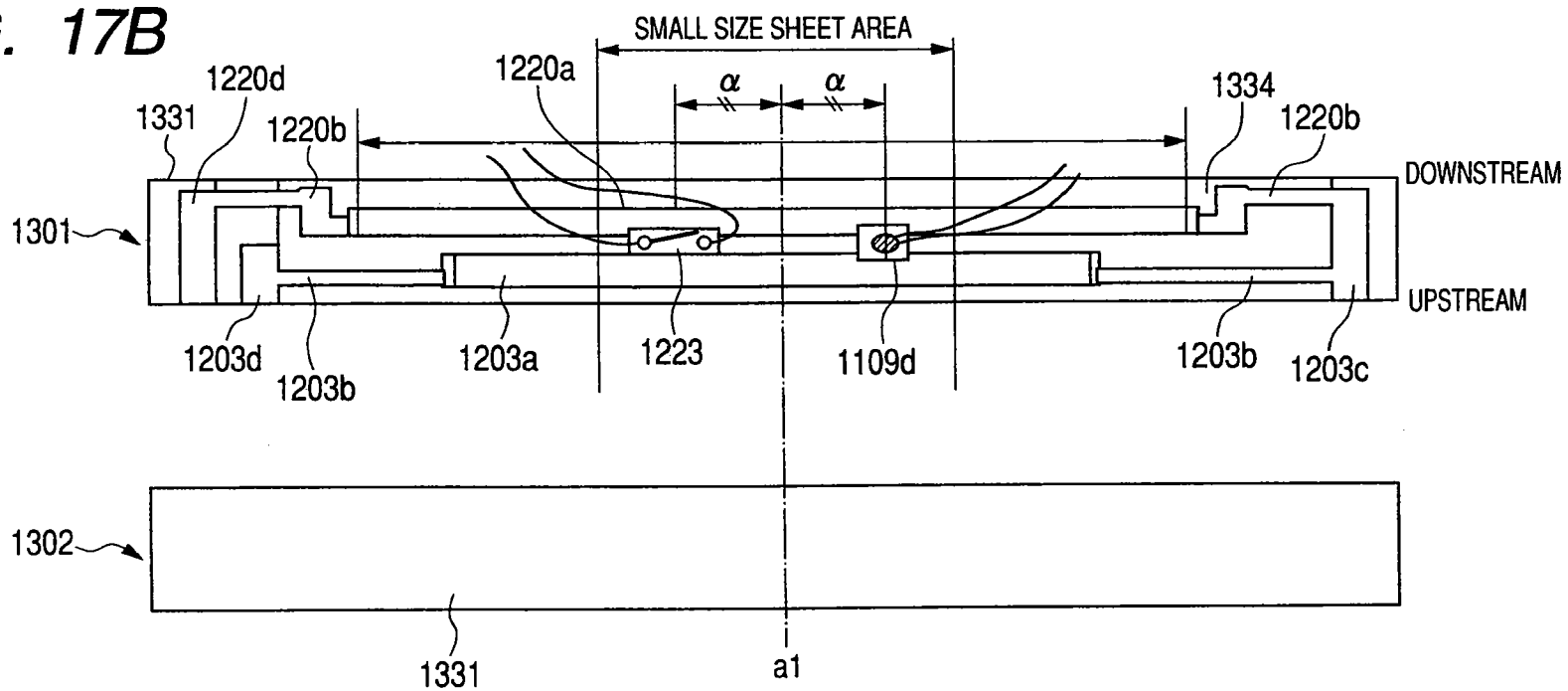

FIGS. 17A and 17B are diagrams schematically describing the ceramic heater 1109*c* according to the embodiment mode of the present invention. FIG. 17A is a cross section of the ceramic face heater; reference numeral 1301 of FIG. 17B denotes a surface, on which the heating members 1203 and 1220 are formed; and reference numeral 1302 of FIG. 17B denotes a surface opposite to the surface denoted by reference numeral 1301 (see FIG. 17A).

The ceramic face heater 1109*c* includes a base material 1331 made of ceramics, such as SiC, AlN, and $Al_2O_3$, the heating members 1203 and 1220 formed on the surface of the base material 1331 by paste printing or the like, and a protective layer 1334, such as glass, for protecting the two heating members. On the protective layer 1334, disposed are the thermistor 1109*d* for detecting a temperature of the ceramic face heater 1109*c* and the excess temperature increase prevention portion 1223. The thermistor 1109*d* and the excess temperature increase prevention portion 1223 are arranged symmetrically with respect to the conveyance reference of the recording sheet, that is, the center of the length direction of heating portions 1203*a* and 1220*a*, and are also arranged within a minimum recording sheet width that allows conveying a sheet.

The heating member 1203 includes the portion 1203*a* that generates heat when power is supplied, electrode portions 1203*c* and 1203*d*, to which the power is supplied via connectors, conductive portions 1203*b* that connect the electrode portions 1203*c* and 1203*d* with the heating member 1203. Further, the heating member 1220 includes the portion 1220*a* that generates heat when power is supplied, the electrode portions 1203*c* and 1220*d*, to which the power is supplied via connectors, conductive portions 1220*b* that is connected to the electrode portions 1203*c* and 1220*d*. The electrode portion 1203*c* is commonly connected to the two heating members 1203 and 1220, serving as a common electrode for the heating members 1203 and 1220. In some cases, a glass layer is formed on an opposed surface side of the base material 1331 where the heating members 1203 and 1220 are printed, in order to enhance slidability.

The common electrode 1203*c* is connected from a HOT side terminal of the alternating-current power supply 1201 via the excess temperature increase prevention portion 1223. The electrode portion 1203*d* is connected to the triac 1204 that controls the heating member 1203, and connected to a Neutral terminal of the alternating-current power supply 1201. The electrode portion 1220*d* is electrically connected to the triac 1213 that controls the heating member 1220, and connected to the Neutral terminal of the alternating-current power supply 1201. The ceramic heater 1109*c* is supported by a film guide 1062, as illustrated in FIGS. 18A and 18B.

Figure 18A:
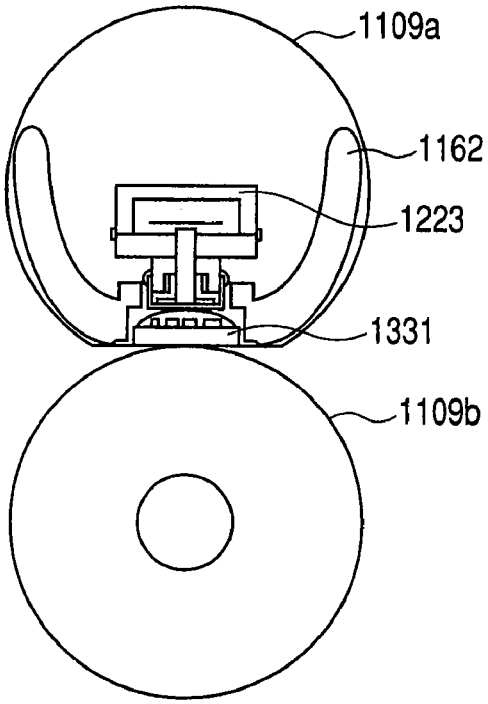
FIGS. 18A and 18B are diagrams illustrating a schematic structure of a heat fixing device.
Figure 18B:
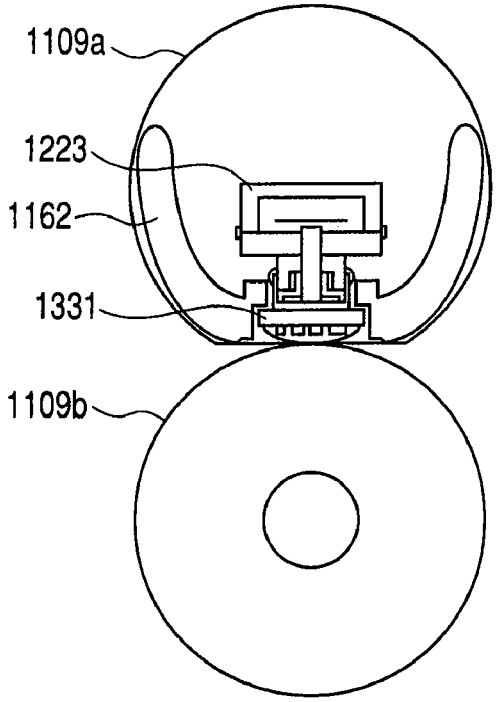

FIGS. 18A and 18B are diagrams illustrating a schematic structure of the heat fixing device 1109 according to the embodiment mode. FIG. 18A illustrates a case where the heating members 1203 and 1220 are located on the opposite side of a fixing nip portion (area in which the fixing film 1109*a* and the pressure roller 1109*b* come into contact with each other) with respect to the base material 1331. Further, FIG. 18B illustrates a case where the heating members 1203 and 1220 are located on the fixing nip portion side with respect to the base material 1331.

The fixing film 1109*a* is fabricated into a rolled shape, using a heat-resistant material (e.g. polyimide) as a material, and is externally engaged with the film guide 1062 supporting the ceramic heater 1109*c* on the lower side thereof. Then, the ceramic heater 1109*c* on the lower side of the film guide 1062. The elastic pressure roller 1109*b* as a pressure member is brought into contact by pressure through the intermediary of the fixing film 1109*a*. In this manner, the fixing nip portion having a predetermined width is formed as a heating portion. Further, the excess temperature increase prevention portion 1223, e.g. a thermostat, is placed on the surface of the base material 1331 of the ceramic heater 1109*c* or the surface of the protective layer 1334. The excess temperature increase prevention portion 1223 is correctly aligned by the film guide 1062, allowing a heat-sensitive surface of the excess temperature increase prevention portion 1223 to be placed on the surface of the ceramic heater 1109*c*. Similarly, the thermistor 1109*d* is placed on the surface of the ceramic heater 1109*c*, which is not illustrated in FIGS. 18A and 18B. It should be noted that the heating members 1203 and 1220 of the ceramic heater 1109*c* may be on the opposite side of the nip portion, as illustrated in FIG. 18A, or the heating members 1203 and 1220 may be on the nip portion side, as illustrated in FIG.

18B. Further, in order to enhance slidability of the fixing film 1109*a*, grease having slidability may be applied to a boundary surface between the fixing film 1109*a* and the ceramic heater 1109*c*.

Figure 19:
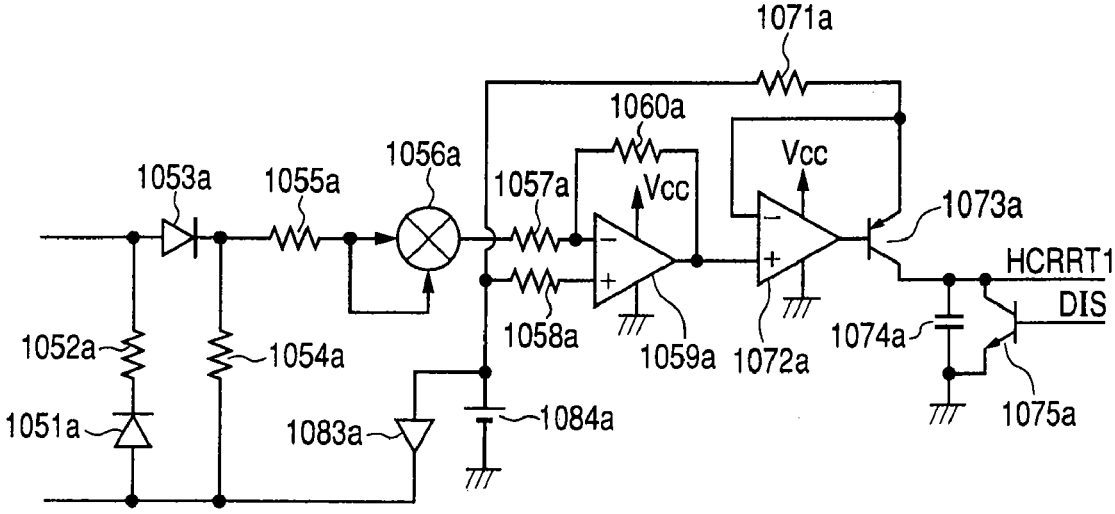
FIG. 19 is a block diagram describing a structure of a current detection circuit 1227.
Figure 21:
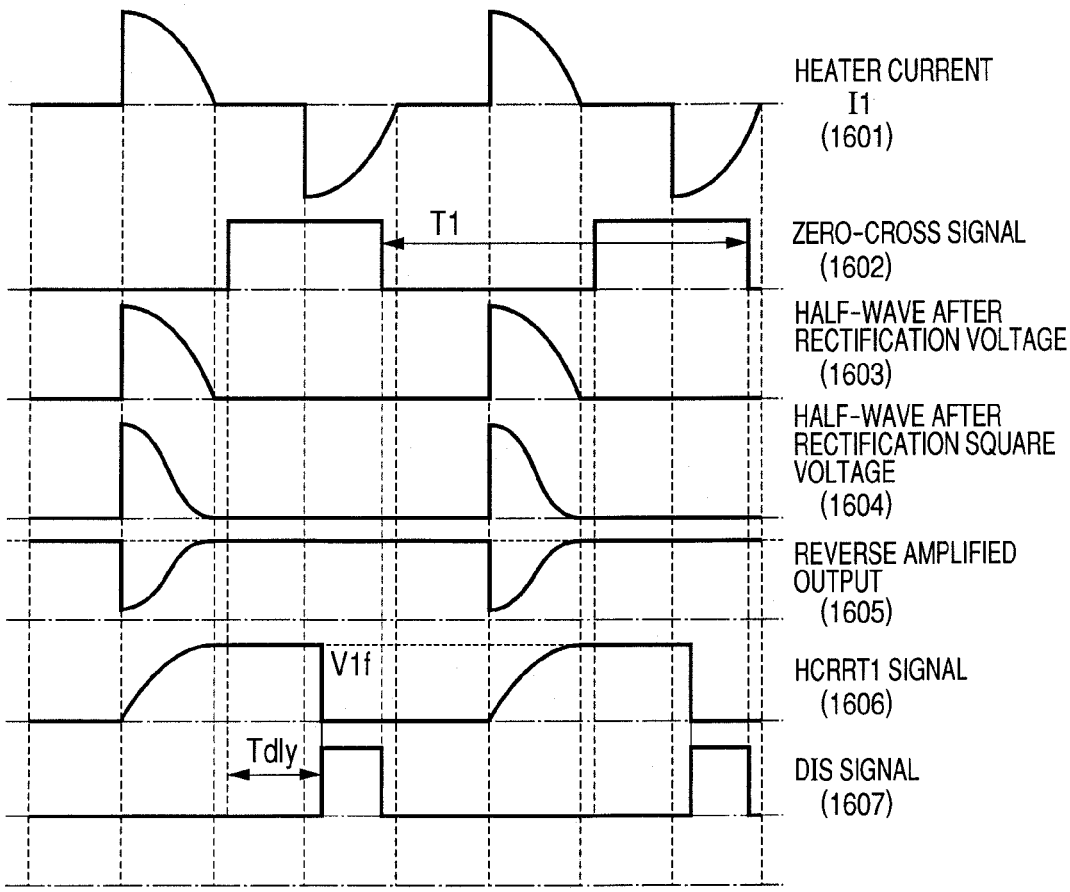
FIG. 21 is a wave pattern diagram for describing an operation of the current detection circuit 1227.

FIG. 19 is a block diagram illustrating a structure of the current detection circuit (second current detection circuit) 1227 according to the embodiment mode of the present invention. FIG. 21 is a wave pattern diagram for describing an operation of the current detection circuit 1227. The current detection circuit 1227 inputs a secondary current of a load current (fixing current) of a detection target (fixing device 1109), and holds a voltage corresponding thereto in a voltage hold circuit (capacitor 1074*a*) to output the voltage.

In 1601 of FIG. 21, when a current I1 is applied to the heating member 1203, the current wave pattern thereof is subjected to voltage conversion by the current transformer 1225 on the secondary side. A half-wave rectification circuit for rectifying a voltage output of the current transformer 1225 by means of diodes 1051*a* and 1053*a* is configured, to which resistors 1052*a* and 1054*a* are connected as load resistors. In 1603, illustrated is a wave pattern that has been subjected to half-wave rectification by the diode 1053*a*. The voltage wave pattern is input to a multiplier 1056*a* via a resistor 1055*a*. The multiplier 1056*a* functions as a squaring circuit that outputs a squared voltage pattern as illustrated in 1604. The squared wave pattern is input to a negative terminal of an operational amplifier 1059*a* via a resistor 1057*a*. A reference voltage 1084*a* is input to a positive terminal of the operational amplifier 1059*a* via a resistor 1058*a*, and is reverse-amplified by a feedback resistor 1060*a* (functioning as an amplifier circuit). The buffer 1083*a* separates affections by the reference voltage 1084*a* and the impedance of half-wave rectification circuit. It should be noted that the operational amplifier 1059*a* is provided with power supply from a single power supply.

Illustrated in 1605 is a wave pattern that is reverse-amplified with the reference voltage 1084*a* being the reference. The output from the operational amplifier 1059*a* is input to a positive terminal of an operational amplifier 1072*a* that constitutes an integration circuit. The operational amplifier 1072*a* controls a transistor 1073*a* in such a manner that a current which is determined based on the reference voltage 1084*a* a voltage difference of the wave pattern input to the positive terminal, and a resistor 1071*a*, flows into a capacitor 1074*a*. In this manner, the capacitor 1074*a* is charged with the current that is determined based on the reference voltage 1084*a*, the voltage difference of the wave pattern input to the positive terminal thereof, and the resistor 1071*a*.

When a period of the half-wave rectification by the diode 1053*a* is finished, a charging current does not flow into the capacitor 1074*a* any more, and thus, a voltage value at that time is peak-held (voltage hold circuit). Then, as illustrated in 1606, a transistor 1075*a* is switched on by a DIS signal during the period of the half-wave rectification by the diode 1051*a*. As a result, the charged voltage of the capacitor 1074*a* is discharged. As illustrated in 1607, the transistor 1075*a* is switched on/off by the DIS signal from the engine controller 1126, and the on/off control of the transistor 1075*a* is performed based on the ZEROX signal illustrated in 1602. The DIS signal is switched on after a predetermined time Tdly from a rising edge of the ZEROX signal, and is switched off at the same timing as a trailing edge of the ZEROX signal or immediately therebefore. Accordingly, control can be performed without interfering with an electrification period of the heater, which is the period of half-wave rectification by the diode 1053*a*.

In other words, a peak hold voltage V1*f* of the capacitor 1074*a* is an integration value of square values for a half cycle of the wave pattern obtained by voltage-converting the current wave pattern by the current transformer 1225 on the secondary side. In this manner, the voltage value that is peak-held at the capacitor 1074*a* is transmitted as the HCRRT1 signal from the current detection circuit 1227 to the engine controller 1126. That is, the voltage V1*f* corresponds to the current (current that flows into the heater of the fixing device) detected in the current detection circuit (second current detection circuit) 1227.

Figure 20:
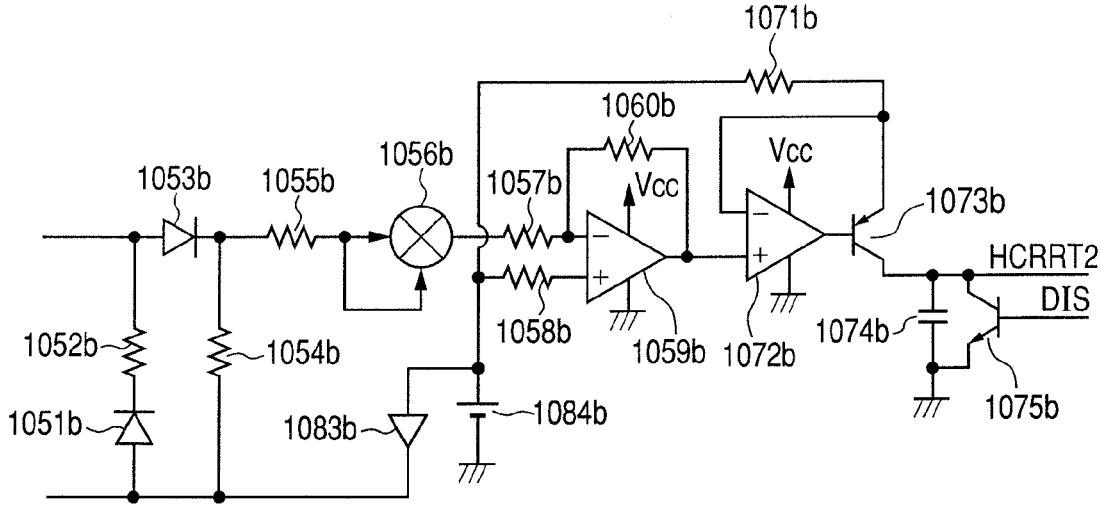
FIG. 20 is a block diagram describing a structure of a current detection circuit 1228.
Figure 22:
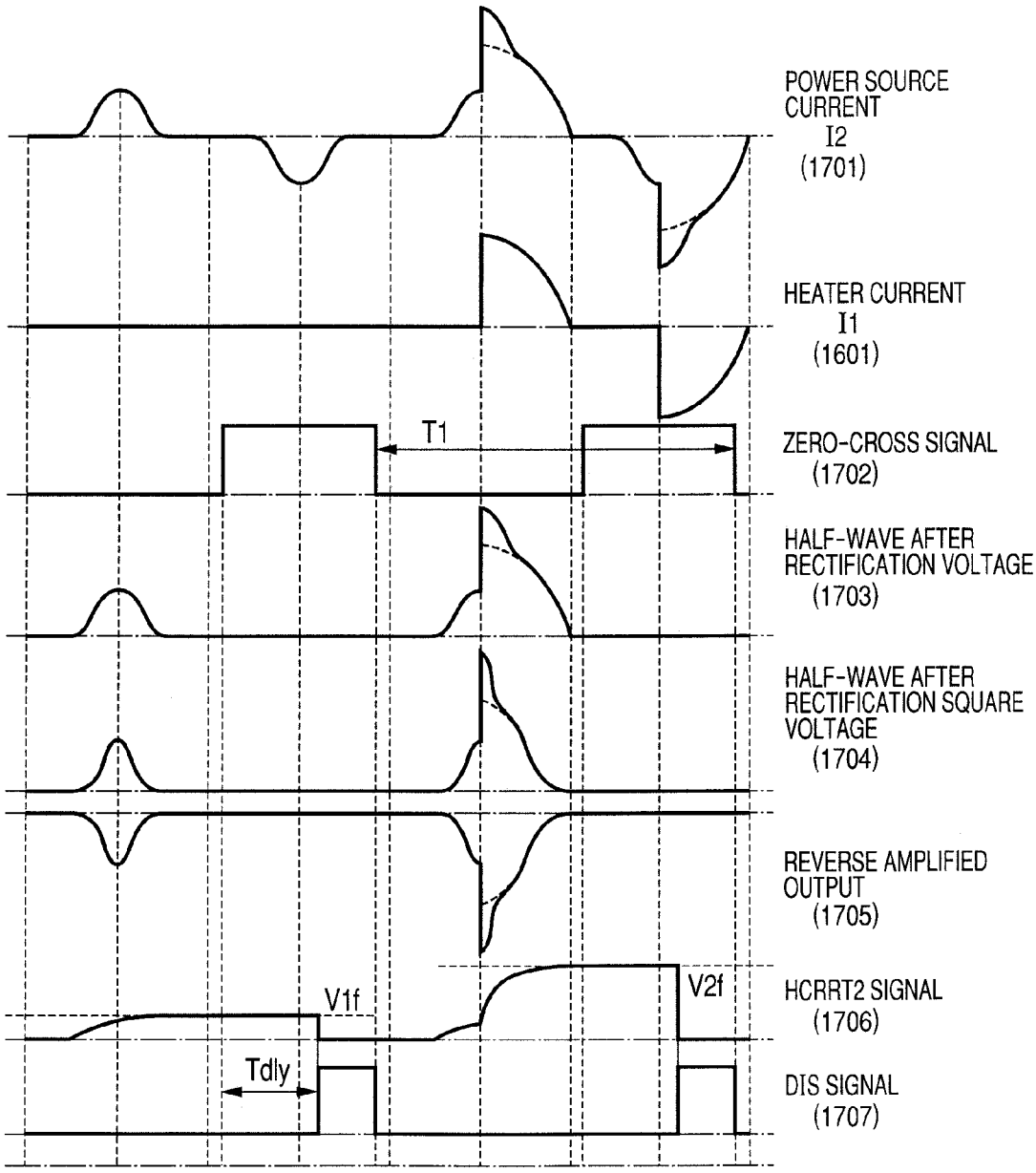
FIG. 22 is a wave pattern diagram for describing an operation of the current detection circuit 1228.

FIG. 20 is a block diagram illustrating a structure of the current detection circuit (first current detection circuit) 1228 according to the embodiment mode of the present invention. FIG. 22 is a wave pattern diagram for describing an operation of the current detection circuit 1228. This circuit similarly inputs a secondary current of a power supply current (input current from commercial power supply to image forming apparatus) to be detected, and holds a voltage corresponding thereto in a voltage hold circuit (capacitor 1075*b*) to output the voltage.

Illustrated in 1701 is a power supply current I2 that is supplied via the AC filter 1202, and the power supply current I2 is subjected to voltage conversion by the current transformer 1226 on the secondary side. The power supply current I2 is a total of the current I1 (1601) that flows into the heater 1109*c* (heating members 1203 and 1220) and a low voltage power supply (LVPS) current I3.

The voltage output from the current transformer 1226 is rectified by the diodes 1051*b* and 1053*b*, and the resistors 1052*b* and 1054*b* are connected as load resistors. In 1703, illustrated is a voltage wave pattern that has been subjected to half-wave rectification by the diode 1053*b*. The wave pattern is input to the multiplier 1056*b* via the resistor 1055*b*. In 1704, illustrated is a wave pattern squared by the multiplier 1056*b*. The squared voltage wave pattern is input to a negative terminal of the operational amplifier 1059*b* via the resistor 1057*b*. On the other hand, the reference voltage 1084*b* is input to a positive terminal of the operational amplifier 1059*b* via the resistor 1058*b*, and is reverse-amplified by the feedback resistor 1060*b*. The buffer 1083*b* separates affections by the reference voltage 1084*b* and the impedance of half-wave rectification circuit. It should be noted that the operational amplifier 1059*b* is provided with power supply from a single power supply. In this manner, a wave pattern 1705 that has been reverse-amplified with the reference voltage 1084*b* being the reference, that is, the output from the operational amplifier 1059*b* is input to a positive terminal of the operational amplifier 1072*b*.

The operational amplifier 1072*b* controls a transistor 1073*b* in such a manner that a current determined based on the reference voltage 1084*b*, a voltage difference of the wave pattern input to the positive terminal, and the resistor 1071*b* flows into the capacitor 1074*b*. In this manner, the capacitor 1074*b* is charged with the current that is determined based on the reference voltage 1084*b*, the voltage difference of the wave pattern input to the positive terminal, and the resistor 1071*b*. When a period of half-wave rectification by the diode 1053*b* is finished, a charging current does not flow into the capacitor 1074*b* any more, and thus, a voltage value at that time is peak-held. By switching on the transistor 1075*b* during the period of half-wave rectification by the diode 1051*b*, the voltage charged in the capacitor 1074*b* is discharged. The transistor 1075*b* is switched on/off by the DIS signal, illustrated in 1707, from the engine controller 1126, and the transistor 1075*b* is controlled based on the ZEROX signal illustrated in 1702. The DIS signal is switched on after the predetermined time Tdly from the rising edge of the ZEROX signal, and is switched off at the time of the trailing edge of the ZEROX signal or immediately therebefore. Accordingly, the control can be performed without interfering with the electrification period of the heater, which is the period of half-wave rectification by the diode 1053*b*.

In other words, a peak hold voltage V2*f* of the capacitor 1074*b* is an integration value of squared values for a half cycle of the wave pattern obtained by voltage-converting the current wave pattern by the current transformer 1226 on the secondary side. In 1706, the voltage of the capacitor 1074*b* is transmitted as the HCRRT2 signal illustrated in 1706 from the current detection circuit 1228 to the engine controller 1126. That is, the voltage V2*f* corresponds to the current (input current to image forming apparatus) detected in the current detection circuit (first current detection circuit) 1228.

Next, described is a control sequence for the fixing device 1109, which is performed by the engine controller 1126 of the image forming apparatus according to Embodiment 4 of the present invention.

Figure 23:
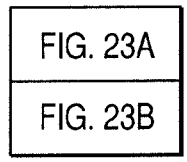
FIG. 23 including
Figure 23A:
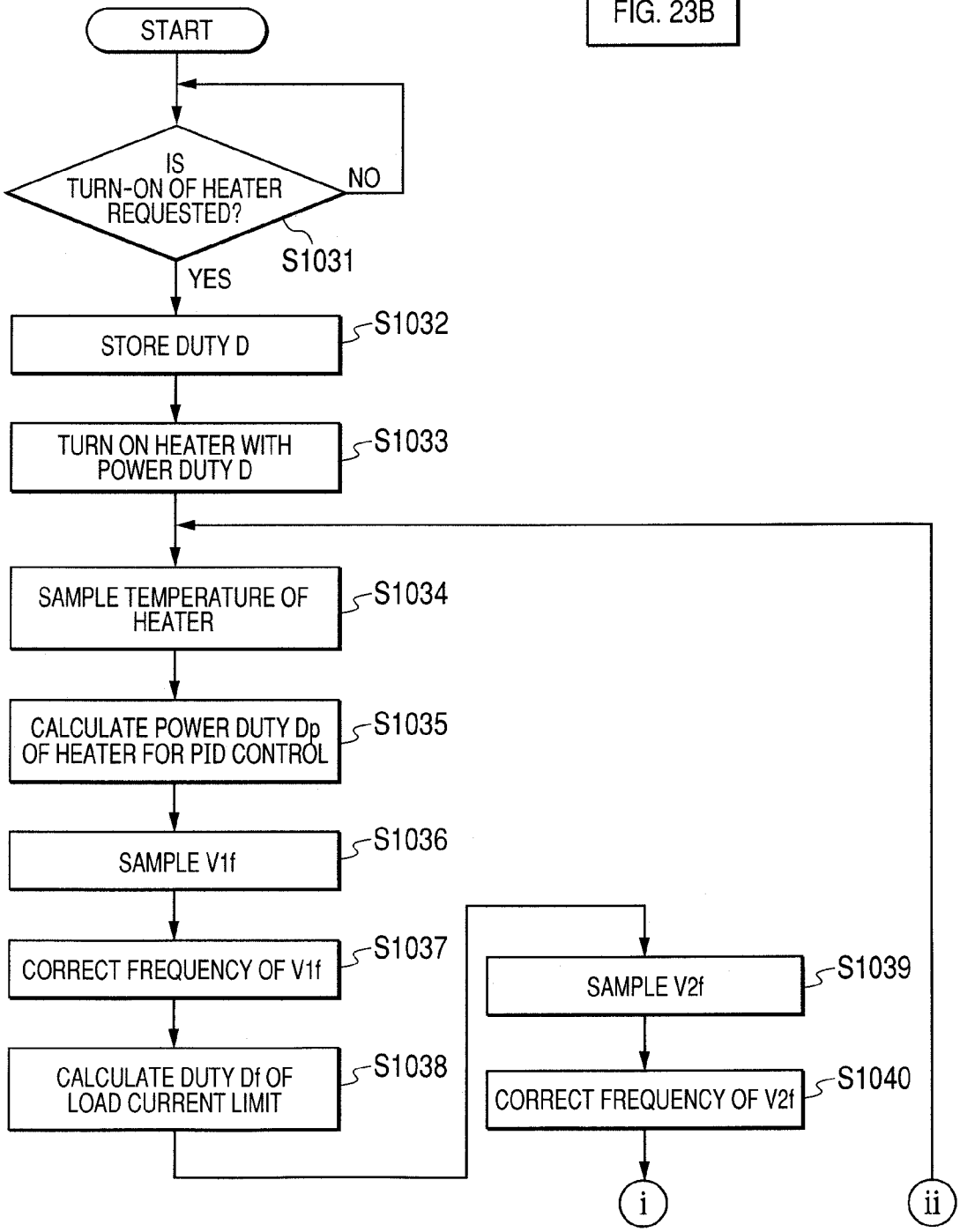
FIGS. 23A and 23B are flow charts describing a control sequence for a fixing device, which is performed by an engine controller according to Embodiment 4.
Figure 23B:
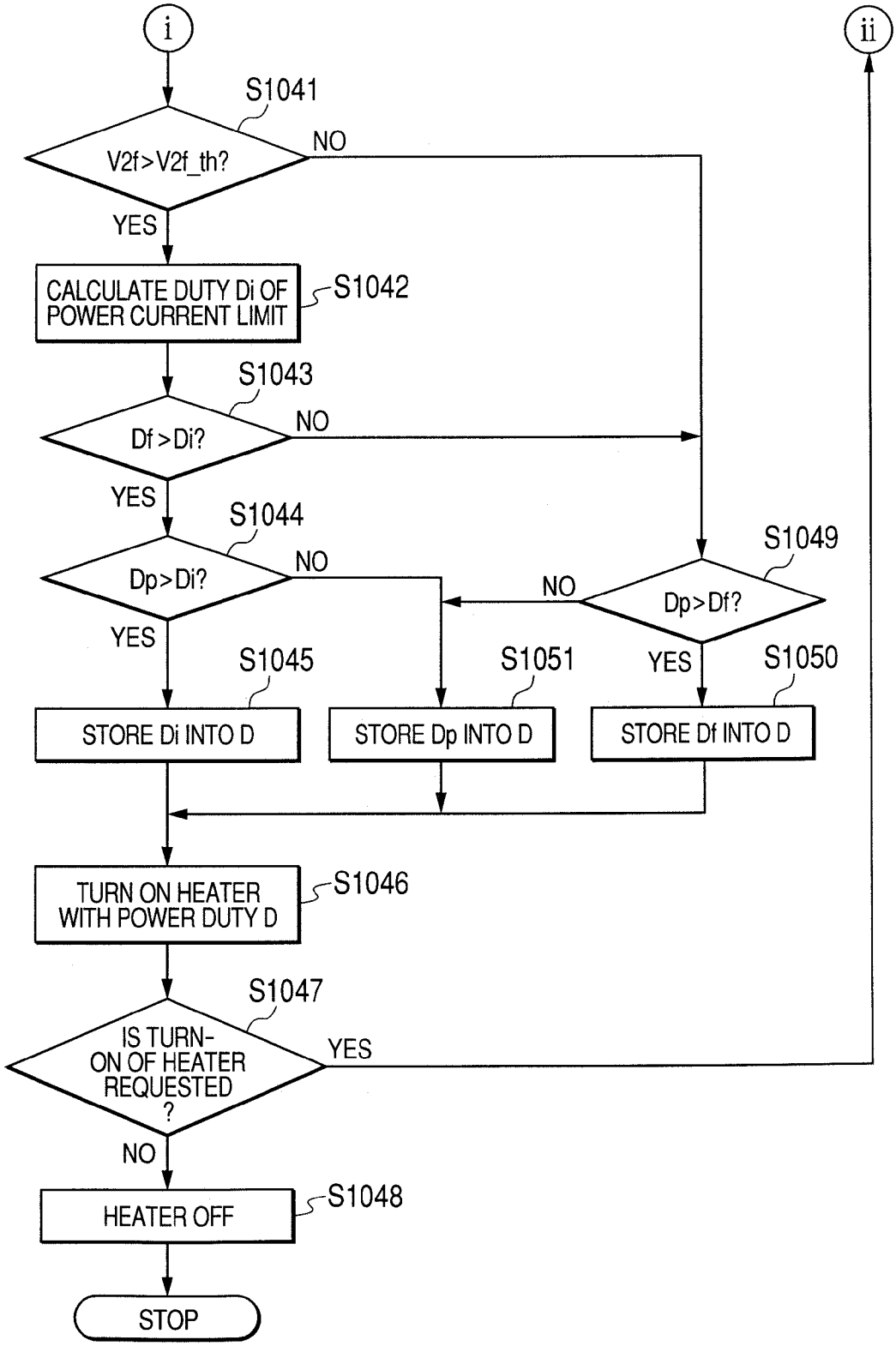
Figure 24:
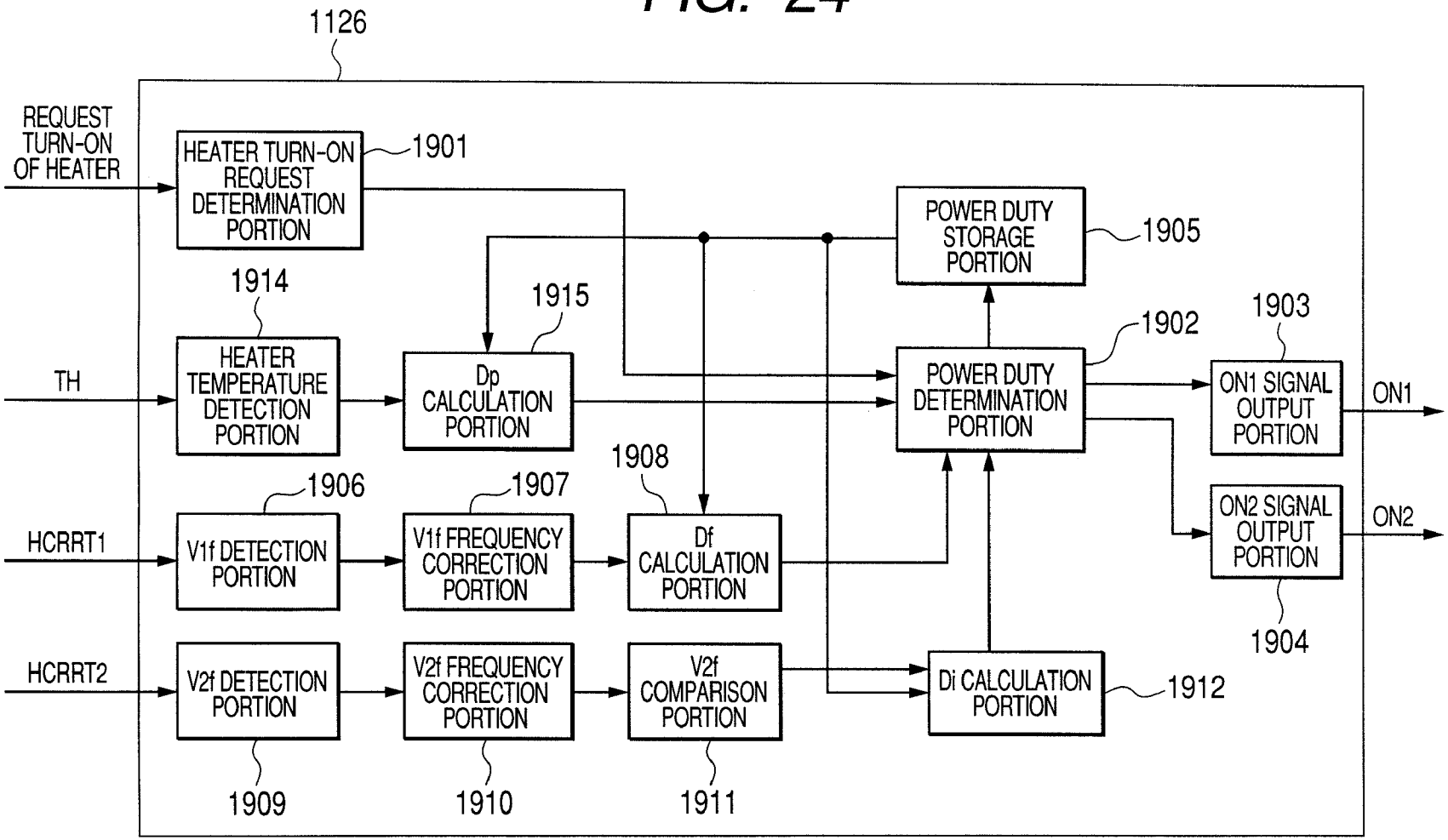
FIG. 24 is a block diagram illustrating a functional structure of the engine controller according to Embodiment 4.

FIGS. 23A and 23B are flow charts illustrating a control sequence for the fixing device 1109, which is performed by the engine controller 1126 according to Embodiment 4 of the present invention. Further, FIG. 24 is a block diagram illustrating a functional structure of the engine controller 1126 according to Embodiment 4. Hereinbelow, referring to FIGS. 23A and 23B, and FIG. 24, processing according to Embodiment 4 is described in detail.

First, in Step S1031, a heater turn-on request determination portion 1901 of the engine controller 1126 determines whether or not a heater turn-on request for turning on the heater 1109*c* is input. When the heater turn-on request is not input, Step S1031 is executed, but when the heater turn-on request is input, the processing proceeds to Step S1032, and a power duty D with a preset initial is stored in a power duty storage portion 1905. Next, the processing proceeds to Step S1033, and a power duty determination portion 1902 determines the power duty D stored in the power duty storage portion 1905 as a power duty with which the heater 1109*c* is turned on. Then, based on the power duty D, an ON1 signal output portion 1903 and an ON2 signal output portion 1904 output the ON1 signal and the ON2 signal, respectively, thereby electrifying the heating members 1203 and 1220 of the heater 1109*c*. Here, on-pulses of the ON1 signal and the ON2 signal are transmitted from the engine controller 1126, using the ZEROX signal as a trigger, with a phase angle $\alpha$l corresponding to the power duty D stored in the power duty storage portion 1905 in Step S1032. Accordingly, a current with the phase angle $\alpha$1 is supplied to the heating members 1203 and 1220. It should be noted that the power duty D is set to a value that does not exceed an allowable current, considering an assumed range of an input voltage, the resistance value of the heater 1109*c*, or the like. In other words, the power duty D is set, assuming a case where the input voltage is maximum, the resistance value of the heater is minimum, and the low voltage power supply (LVPS) current is maximum.

Next, the processing proceeds to Step S1034, and a heater temperature detection portion 1914 detects a temperature of the heater 1109*c* based on the TH signal. Subsequently, the processing proceeds to Step S1035, and a Dp calculation portion 1915 calculates a power duty Dp of the heater (first calculation unit). In other words, the duty Dp is a duty (input power ratio) determined based on the detection temperature of the heater temperature detection portion 1914.

Next, the processing proceeds to Step S1036, and a V1*f* detection portion 1906 acquires the voltage V1*f* with use of the HCRRT1 signal transmitted from the current detection circuit (second current detection circuit) 1227 (FIG. 16), with the heating members 1203 and 1220 being electrified with the duty D. This voltage V1*f* corresponds to the voltage value V1*f* that is peak-held at the aforementioned capacitor 1074*a* (FIG. 19). In other words, this voltage V1*f* is the peak hold value of the HCRRT1 signal illustrated in FIG. 21, and corresponds to the current that flows into the fixing device 1109. After this voltage V1*f* is acquired, in Step S1037, a V1*f* frequency correction portion 1907 corrects the voltage V1*f* according to the frequency of the alternating-current power supply 1201. The reason why the voltage V1*f* is corrected according to the frequency is that the voltage value V1*f* peak-held at the capacitor 1074*a* is a value dependent on the frequency of the alternating-current power supply. Accordingly, when there is no particular description, the detection current of the second current detection circuit 1227 indicates the voltage V1*f* that has been corrected with the alternating-current power supply frequency. Subsequently, the processing proceeds to Step S1038, and, based on the voltage V1*f* that has been frequency-corrected by the V1*f* frequency correction portion 1907, a Df calculation portion 1908 calculates a duty Df (second upper limit value) of load (fixing device) current limit according to the following expression (Expression 1) (second calculation unit).

$$Df=(V1f_lim/V1f)\times D \qquad \text{(Expression 1)}$$

Herein, D represents a present duty, and Df represents a power duty that is controlled in such a manner that a load current I1*f* becomes equal to or less than a preset current value I1*f*_lim. The current value I1*f*_lim is a current value that is large enough to supply power required for printing or warm-up, but is not so large as to cause the thermal runaway when supplied to the load. In other words, the duty Df is the upper limit value for the duty, for preventing the heater from falling into an abnormal heating state. It should be noted that the voltage value V1*f*_lim is a voltage value corresponding to the current value I1*f*_lim.

Next, the processing proceeds to Step S1039, and a V2*f* detection portion 1909 acquires the voltage V2*f* with use of the HCRRT2 signal transmitted from the current detection circuit (first current detection circuit) 1228 (FIG. 16), with the heating members 1203 and 1220 being electrified with the duty D. This voltage V2*f* corresponds to the voltage value V2*f* that is peak-held at the aforementioned capacitor 1074*b* (FIG. 20). In other words, this voltage V2*f* is the peak hold value of the HCRRT2 signal illustrated in FIG. 22, and corresponds to the input current from the commercial power supply to the image forming apparatus.

In Embodiment 4, using the ZEROX signal as the trigger, the peak hold value is acquired during the period Tdly, a period from the rising edge of the ZEROX signal until the DIS signal is transmitted. The period Tdly is set to be long enough for the engine controller 1126 to detect the peak hold voltage value V2*f*. In this manner, after the voltage value V2*f* is acquired, the processing proceeds to Step S1040, and a V2*f* frequency correction portion 1910 corrects the voltage V2*f* according to the frequency of the alternating-current power supply 1201. The reason why the voltage V2*f* is corrected with the frequency of the alternating-current power supply is the same as the case of the second current detection circuit. Accordingly, when there is no particular description, the detection current of the first current detection circuit 1228 indicates the voltage V2*f* that has been corrected with the alternating-current power supply frequency.

Next, the processing proceeds to Step S1041, and a V2*f* comparison portion 1911 determines whether or not the corrected voltage V2*f* exceeds a predetermined voltage (threshold voltage) V2*f*_th. In this embodiment, the predetermined voltage (threshold voltage) V2*f*_th is a value that corresponds to a current of 15 A (ampere). Here, when the voltage V2*f* exceeds the threshold voltage V2*f*_th, the processing proceeds to Step S1042. Then, a Di calculation portion 1912 calculates, using the preset voltage V2*f*_lim and the voltage V2*f* that has been frequency-corrected in Step S1040, a duty Di (first upper limit value) of power current limit according to the following expression (Expression 2) (third calculation unit).

$$Di=(V2f_\mathrm{lim}/V2f)\times D \qquad \text{(Expression 2)}$$

Herein, in this embodiment, the voltage value V2*f*_lim corresponds to a current value that is less than the current value 15 A which is set as a standard for an input current suppliable from the commercial power supply to the image forming apparatus. In this embodiment, the voltage V2*f*_lim is set to a value corresponding to 14.7 A. The reason why the voltage V2*f*_th and the voltage V2*f*_lim are respectively set as described above is to prevent the input current flowing into the image forming apparatus from frequently exceeding 15 A. Therefore, the voltage V2*f*_th and the voltage V2*f*_lim may be set to the same value (for example, value corresponding to 15 A or value corresponding to 14.7 A).

As described above, the duty Di is the upper limit value for the duty, for preventing the current from exceeding the predetermined input current suppliable from the commercial power supply to the image forming apparatus. The duty Di varies depending on a difference between the voltage V2*f* (i.e., detection current of the first current detection circuit 1228) and V2*f*_lim (i.e., predetermined input current).

After the duty Di of the power current limit is obtained as described above, next, processing where a power duty determination portion 1902 determines the power duty D is described.

First, the processing proceeds to Step S1043, and it is determined which of the duty Di of the power current limit obtained in Step S1042 and the duty Df of the load current limit obtained in Step S1042 is larger. When Df is larger than Di, that is, when the load current limit is larger than the power current limit, the processing proceeds to Step S1044, and it is determined which of the power duty Dp of the heater and the duty Di of the power current limit is larger. When Dp is larger than Di, that is, when the power of the heater is larger than the power current limit, the processing proceeds to Step S1045, and the duty Di of the power current limit, which is the smaller of the two, is stored in a power duty storage portion 1905.

On the other hand, when Df is smaller than Di in Step S1043, that is, when the load current limit is larger than the power current limit, the processing proceeds to Step S1049, and it is determined which of the power duty Dp of the heater and the duty Df of the load current limit is larger. When Dp is larger than Df, the processing proceeds to Step S1050, where the duty Df of the load current limit, which is the smaller of the two, is stored in the power duty storage portion 1905, and then the processing proceeds to Step S1046. On the other hand, when Dp is smaller than Di in Step S1044, or when Dp is smaller than Df in Step S1049, the processing proceeds to Step S1051, where the power duty Dp of the heater, which is the smaller of the two, is stored in the power duty storage portion 1905, and then the processing proceeds to Step S1046. In this manner, when the voltage V2*f* exceeds the threshold voltage V2*f*_th, the smaller power duty D is obtained, and then stored in the power duty storage portion 1905.

As described above, comparing the duty Dp, the duty Df, and the duty Di, the smallest duty is determined as the duty D for electrifying the heater. Illustrated in FIG. 31 is variation of the input current (inlet current) from the commercial power supply to the image forming apparatus in a case where such a duty determination algorithm is used.

Figure 31:
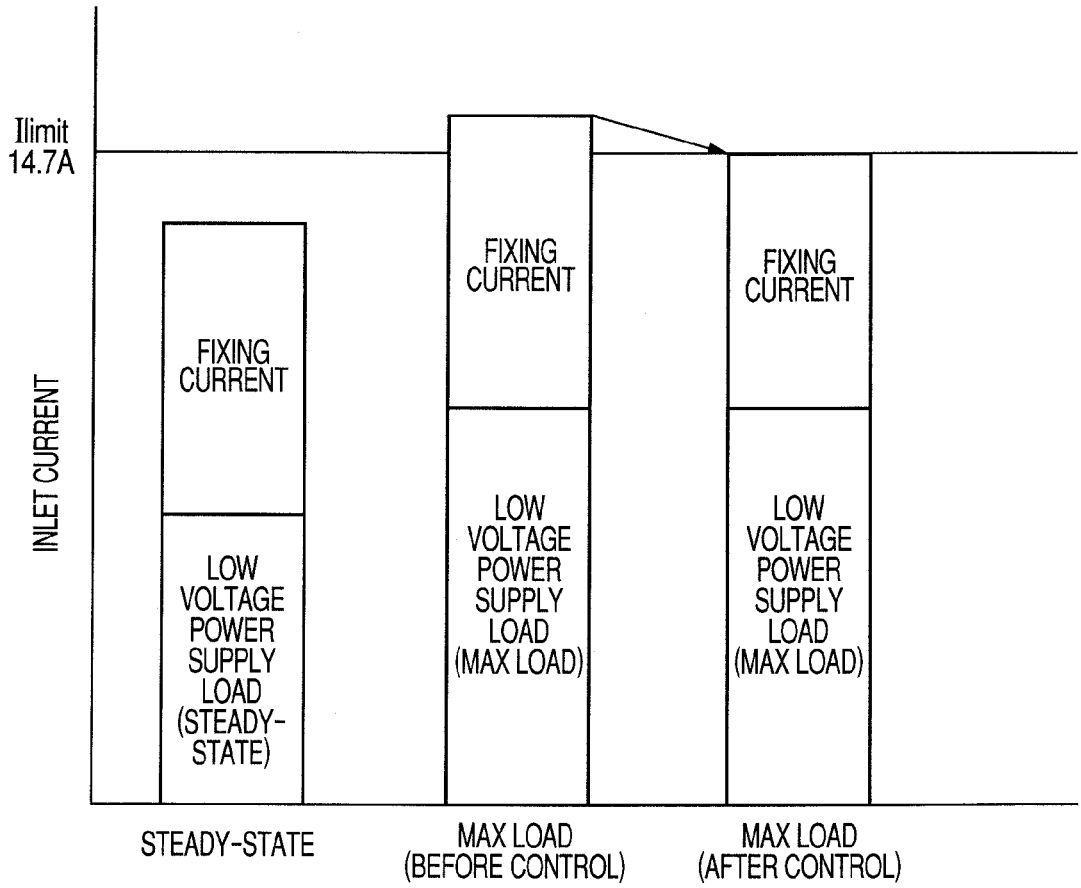
FIG. 31 is a diagram illustrating variation of an input current (inlet current) from a commercial power supply to the image forming apparatus when a duty determination algorithm according to Embodiment 4 is used.

FIG. 31 illustrates a case where the duty Dp, which is determined using the detection temperature of the heater temperature detection portion 1914 and the control target temperature, is determined as 60% and the duty Df is determined as 90%. In a case of a steady-state where a current that flows into loads (low voltage power supply loads) of the image forming apparatus (including option devices) other than the heater is low, the duty D suppliable to the heater is determined as Dp by the aforementioned duty determination algorithm. However, if the current that flows into the low voltage power supply loads is increased (at maximum) during the electrification of the heater with D=60%, the input current to the image forming apparatus sometimes exceeds the current Ilimit (14.7 A) ("BEFORE CONTROL" of FIG. 31). Accordingly, if the first current detection circuit 1228 detects a value equal to or more than the current Ilimit in FIG. 23A and in STEP S1039 of FIG. 23B, in the case of FIG. 31, the duty Di is determined as 55%. Because the duty Di is smaller than the duty Dp, the duty D of the heater is changed to 55%, allowing the input current to the image forming apparatus to fall within the current Ilimit (14.7 A), as illustrated in "AFTER CONTROL" of FIG. 31. As described above, when the detection current of the first current detection circuit, which detects the input current from the commercial power supply to the apparatus, is equal to or less than a predetermined value (predetermined input current), the fixing device is electrified with the duty that corresponds to the detection temperature of the temperature detection element for detecting the temperature of the fixing device (heater). When the detection current of the first current detection circuit, which detects the input current from the commercial power supply to the apparatus, exceeds the predetermined value, the fixing device 1109 is electrified with the smallest duty of the three: the duty Dp set according to the detection temperature of the temperature detection element; the duty Di set according to the output of the first current detection circuit that detects the input current from the commercial power supply to the apparatus; and the duty Df set according to the output of the second current detection circuit. Setting the duty Di as the duty D means that the current that flows into the fixing device (heater) is restricted.

It should be noted that, in this embodiment, of the three duties (Dp, Df, and Di), the smallest duty is determined as the duty to be used for the heater. However, at least if the smaller one of the duty Dp and the duty Di is determined as the duty D, it is possible to provide an image forming apparatus that is capable of suppressing the input current from the commercial power supply to the image forming apparatus to be equal to or less than a predetermined value, and suppressing decline of the processing performance. In other words, when the detection current of the first current detection circuit is equal to or less than the predetermined value (predetermined input current), the fixing device 1109 may be electrified with the duty according to the detection temperature of the temperature detection element that detects the temperature of the fixing device (heater). When the detection current exceeds the predetermined value, the fixing device 1109 may be electrified with the smaller duty of the duty Dp set according to the detection temperature of the temperature detection element and the duty Di set according to the output of the first temperature detection circuit. Setting the duty Di as the duty D means that the current that flows into the fixing device (heater) is restricted.

On the other hand, when the peak hold voltage value V2*f* does not exceed the threshold voltage V2*f*_th in Step S1041, the processing proceeds to Step S1049, and Dp or Df is selected.

In this manner, after the power duty D is stored in any one of Step S1045, S1051, and S1050, the processing proceeds to Step S1046. In Step S1046, based on the stored power duty D, the ON1 signal output portion 1903 and the ON2 signal output portion 1904 output the ON1 signal and the ON2 signal, respectively, thereby electrifying the heating members 1203 and 1220 with the power duty D. Next, the processing proceeds to Step S1047, and it is determined whether or not turn-on of the heater is requested. When the turn-on of the heater is requested, the processing proceeds to Step S1034, and the processing described above is repeated. When the turn-on of the heater is not requested, the processing proceeds to Step S1048, and the heater is turned off to finish the processing.

As described above, according to Embodiment 4, power is supplied to the heater in such a manner that the current supplied from the commercial power supply (alternating-current power supply) 1201 does not exceed the predetermined upper limit current. Further, during such a current restriction, if the temperature of the fixing device 1109 falls below a predetermined temperature (fixable lower limit temperature) that is lower than the control target temperature, similar to Embodiment 1, at least the adjustment operation at the second step (operation for extending the conveyance interval of the recording material conveyed to the fixing device 1109) may be executed. This applies to Embodiments 5 to 7 described below.

Embodiment 5

Next, described is a control sequence for the fixing device 1109, which is performed by an engine controller 1126 of an image forming apparatus according to Embodiment 5 of the present invention. It should be noted that the apparatus structure according to Embodiment 5 is the same as the aforementioned Embodiment 4, and thus, the description thereof is omitted.

Figure 25:
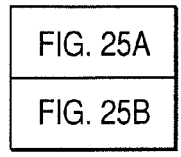
FIG. 25 including
Figure 25A:
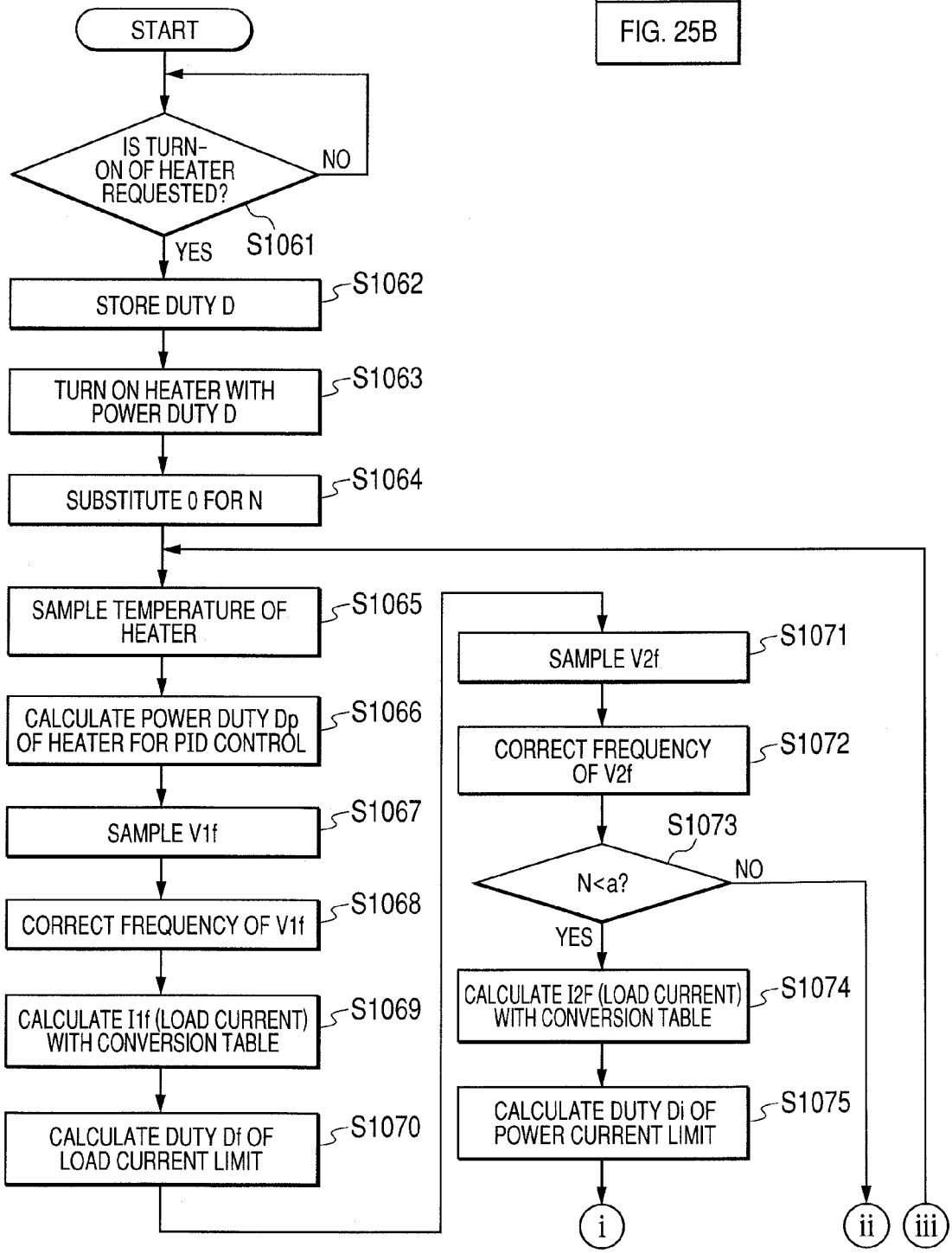
FIGS. 25A and 25B are flow charts describing a control sequence for the fixing device, which is performed by an engine controller according to Embodiment 5.
Figure 25B:
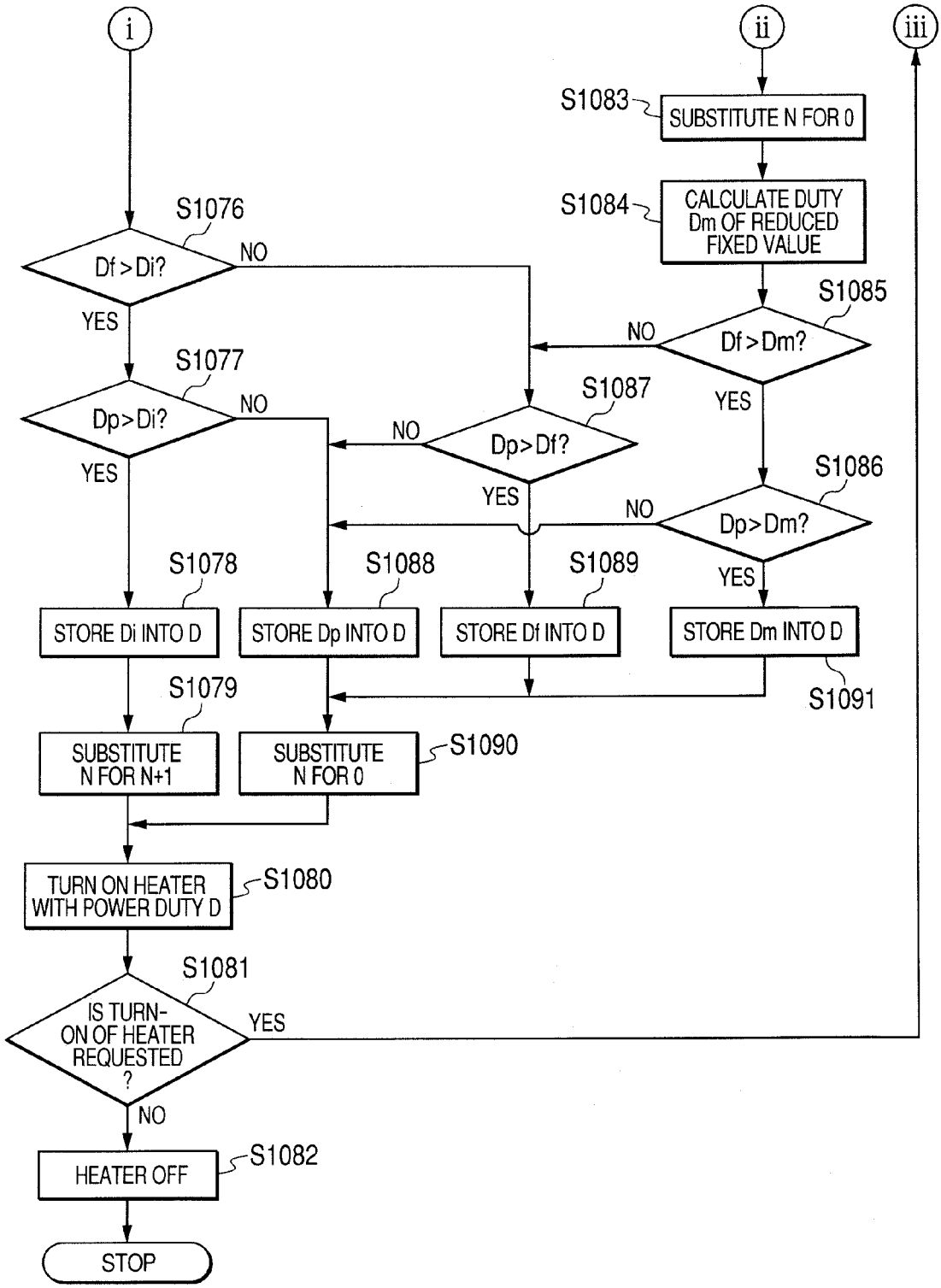
Figure 26:
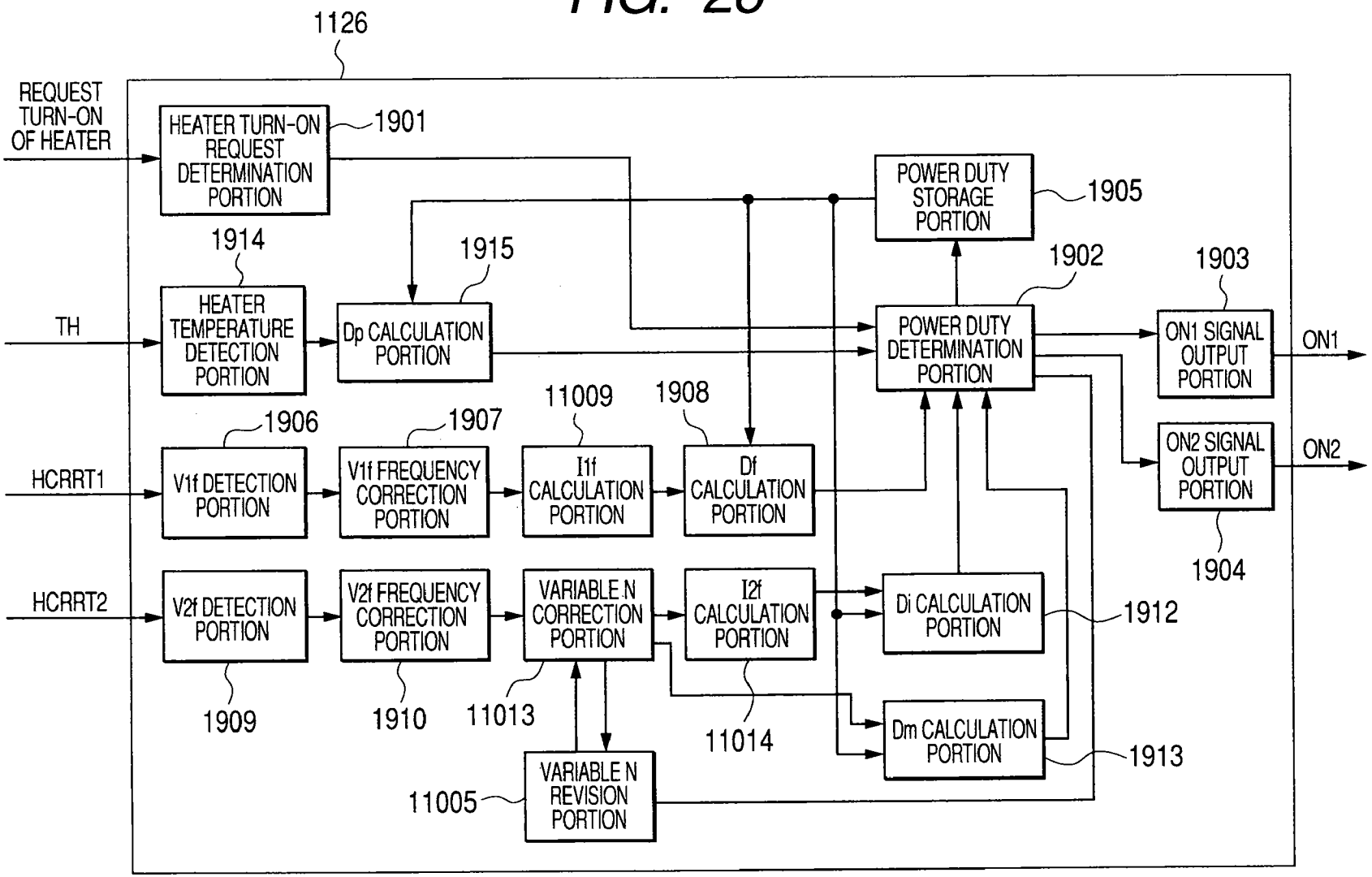
FIG. 26 is a block diagram illustrating a structure of the engine controller according to Embodiment 5.

FIGS. 25A and 25B are flow charts illustrating a control sequence for the fixing device 1109, which are performed by the engine controller 1126 according to Embodiment 5 of the present invention. FIG. 26 is a block diagram illustrating a structure of the engine controller 1126 according to Embodiment 5. Hereinbelow, referring to FIGS. 25A and 25B, and FIG. 26, processing according to Embodiment 5 is described in detail. It should be noted that Steps S1061 to S1063, S1065 to S1068, and S1070 to S1072 of FIG. 25A are essentially the same processing as Steps S1031 to S1040 of FIG. 23A.

In Step S1061, the heater turn-on request determination portion 1901 of the engine controller 1126 determines whether or not a heater turn-on request is input, and if the request is input, the processing proceeds to Step S1062, where a power duty D with a preset initial is stored in the power duty storage portion 1905. When the heater turn-on request is not generated, the processing of Step S1061 is repeated. Next, the processing proceeds to Step S1063, and the power duty determination portion 1902 causes, based on the power duty D stored in the power duty storage portion 1905, the ON1 signal output portion 1903 and the ON2 signal output portion 1904 to output the ON1 signal and the ON2 signal, respectively. Consequently, the heating members 1203 and 1220 are electrified with the power duty D. Next, the processing proceeds to Step S1064, where a variable N revision portion 11005 substitutes "0" for a variable N. The variable N represents how many times the duty Di is adopted as the duty D for the heater while the heater turn-on request exists. Adopting the duty Di instead of the duty Dp means that the input current from the commercial power supply to the image forming apparatus exceeds the limit Ilimit. Therefore, the variable N also represents how many times the input current from the commercial power supply to the image forming apparatus exceeds the limit Ilimit while the heater turn-on request exists. A large value of the variable N means that the input current has frequently exceeded the limit Ilimit while the heater turn-on request exists. In the case of the duty determination algorithm as described in Embodiment 4, when the heater is electrified with the determined duty D, the detection current of the first current detection circuit 1228 becomes approximately Ilimit. Accordingly, if the input current limit Ilimit is set to 15 A or an approximation value thereof, it is conceivable that the input current frequently exceeds the limit Ilimit. Therefore, in this embodiment, if N exceeds a predetermined value a, the present duty D is reduced by a relatively large fixed value, thereby setting a duty Dm. In this manner, when the duty Dm is adopted, the value N is not revised for a certain period of time.

Next, the processing proceeds to Step S1065, and the heater temperature detection portion 1914 detects the temperature of the heater 1109*c* based on the TH signal. Subsequently, in Step S1066, the Dp calculation portion 1915 calculates the power duty Dp of the heater. Next, in Step S1067, the V1*f* detection portion 1906 detects the voltage V1*f* with the heating members 1203 and 1220 being electrified with the duty D. After the voltage V1*f* is thus acquired, the processing proceeds to Step S1068, and the V1*f* frequency correction portion 1907 corrects the voltage value V1*f* according to the frequency of the alternating-current power supply 1201. Next, the processing proceeds to Step S1069, and an I1*f* calculation portion 11009 calculates the current value I1*f* from the voltage value V1*f* that has been subjected to frequency correction. For calculating the current value I1*f*, for example, such a conversion table as illustrated in Table 5 is provided to the engine controller 1126. Based on the conversion table, the current value I1*f* is calculated.

TABLE 5

| V1f(V) | I1f(A) |
|---|---|
| 0 | 0 |
| 0.1 | 3.39 |
| . | . |
| . | . |
| . | . |
| 0.8 | 9.60 |
| . | . |
| . | . |
| . | . |
| 1.6 | 13.58 |
| . | . |
| . | . |
| . | . |
| 2.4 | 16.63 |
| . | . |
| . | . |
| . | . |
| 3.2 | 19.20 |
| 3.3 | 19.50 |

Next, the processing proceeds to Step S1070, and, based on the voltage V1*f*, the Df calculation portion 1908 calculates the duty Df of the load current limit according to the expression (1) described above. Then, the processing proceeds to Step S1071, and the V2*f* detection portion 1909 detects and acquires the voltage V2*f* with the heating members 1203 and 1220 being electrified with the duty D. After the voltage V2*f* is acquired, the V2*f* frequency correction portion 1910 corrects the voltage value V2*f* according to the frequency of the alternating-current power supply 1201 in Step S1072.

Next, the processing proceeds to Step S1073, and the variable N comparison portion 11013 determines which of the variable N and the preset predetermined value a is larger. Here, when N is smaller than a, the processing proceeds to Step S1074, and an 12*f* calculation portion unit 11014 calculates the current value I2*f* from the voltage value V2*f*. The calculation of the current value I2*f* is performed using, for example, the conversion table as illustrated in the aforementioned Table 5. It should be noted that a common conversion table may be used for the conversion table for calculating I1*f* and the conversion table for calculating 12*f*, or that different conversion tables may be used.

Next, the processing proceeds to Step S1075, and the Di calculation portion 1912 calculates the duty Di of the power current limit according to the following expression (Expression 3), using the current value I2*f*, the current value I1*f*, and the preset current restriction value I2*f*_lim supplied from the alternating-current power supply 1201.

$$Di=(I1f-I2f+I2f_\mathrm{lim})\times D/I1f \quad \text{(Expression 3)}$$

After the duty Di of the power current limit is thus obtained, next, described is processing in which the power duty determination portion 1902 determines the power duty D. It should be noted that, in FIGS. 25A and 25B, the algorithm for determining the duty D with use of the duties Dp, Di, and Df is the same as Example 4.

First, in Step S1076, it is determined which of the duty Df of the load current limit and the duty Di of the power source current limit is larger. Here, when Df is larger than Di, the processing proceeds to Step S1077, and it is determined which of the power duty Dp of the heater and Di is larger. When Dp is larger than Di, the processing proceeds to Step S1078, and Di is stored in the power duty storage portion 1905. Then, the processing proceeds to Step S1079, and a variable N revision portion 11005 revises the variable N into (N+1), leading the processing to Step S1080. On the other hand, when Dp is smaller than Di, the processing proceeds to Step S1088, and Dp is stored in the power duty storage portion 1905. Then, in Step S1090, the variable N revision portion 11005 substitutes 0 for the variable N, and the processing proceeds to Step S1080.

Besides, when Df is smaller than Di in Step S1076, the processing proceeds to Step S1087, and it is determined which of Dp and Df is larger. When Dp is smaller than Df, the processing proceeds to Step S1088 described above, but when Dp is larger than Df, the processing proceeds to Step S1089. Then, Df is stored in the power duty storage portion 1905, and the processing proceeds to Step S1090.

In Step 1073, when the value of the variable N is larger than a, the processing proceeds to Step S1083, and the variable N revision portion 11005 substitutes 0 for the variable N. Subsequently, the processing proceeds to Step S1084, and a Dm calculation portion 1913 calculates the power duty Dm, which is obtained by subtracting a predetermined value from the present power duty D of the heater. Then, the processing proceeds to Step S1085, and it is determined which of Df and Dm is larger. When Df is smaller than Dm, the processing proceeds to Step S1087, but when Df is larger than Dm, the processing proceeds to Step S1086, and it is determined which of Dp and Dm is larger. When Dp is smaller than Dm, the processing proceeds to Step S1088, and when Dp is not smaller than Dm, the processing proceeds to Step S1091. Then, Dm is stored in the power duty storage portion 1905, and the processing proceeds to Step S1090 described above.

In this manner, if the power duty D is stored in any one of Steps S1078, S1088, S1089, and S1091, the processing proceeds to Step S1080. In Step S1080, based on the stored power duty D, the ON1 signal and the ON2 signal are output from the ON1 signal output portion 1903 and the ON2 signal output portion 1904, respectively, thereby electrifying the heating members 1203 and 1220 with the power duty D. Next, the processing proceeds to Step S1081, and it is determined whether or not the turn-on of the heater is requested. When the turn-on of the heater is requested, the processing proceeds to Step S1065, and the processing described above is repeated. On the other hand, when the turn-on of the heater is not requested, the processing proceeds to Step S1082, and the heater is turned off to finish the processing.

As described above, according to Embodiment 5, a current supplied to the heater is controlled in such a manner that the current supplied from the alternating-current power supply 1201 does not exceed the predetermined upper limit current.

Embodiment 6

Next, described is a control sequence for the fixing device 1109, which is performed by an engine controller 1126 of an image forming apparatus according to Embodiment 6 of the present invention. It should be noted the apparatus structure according to Embodiment 6 is the same as Embodiment 4 described above, and thus, the description thereof is omitted.

Figure 27:
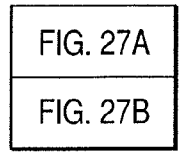
FIG. 27 including
Figure 27A:
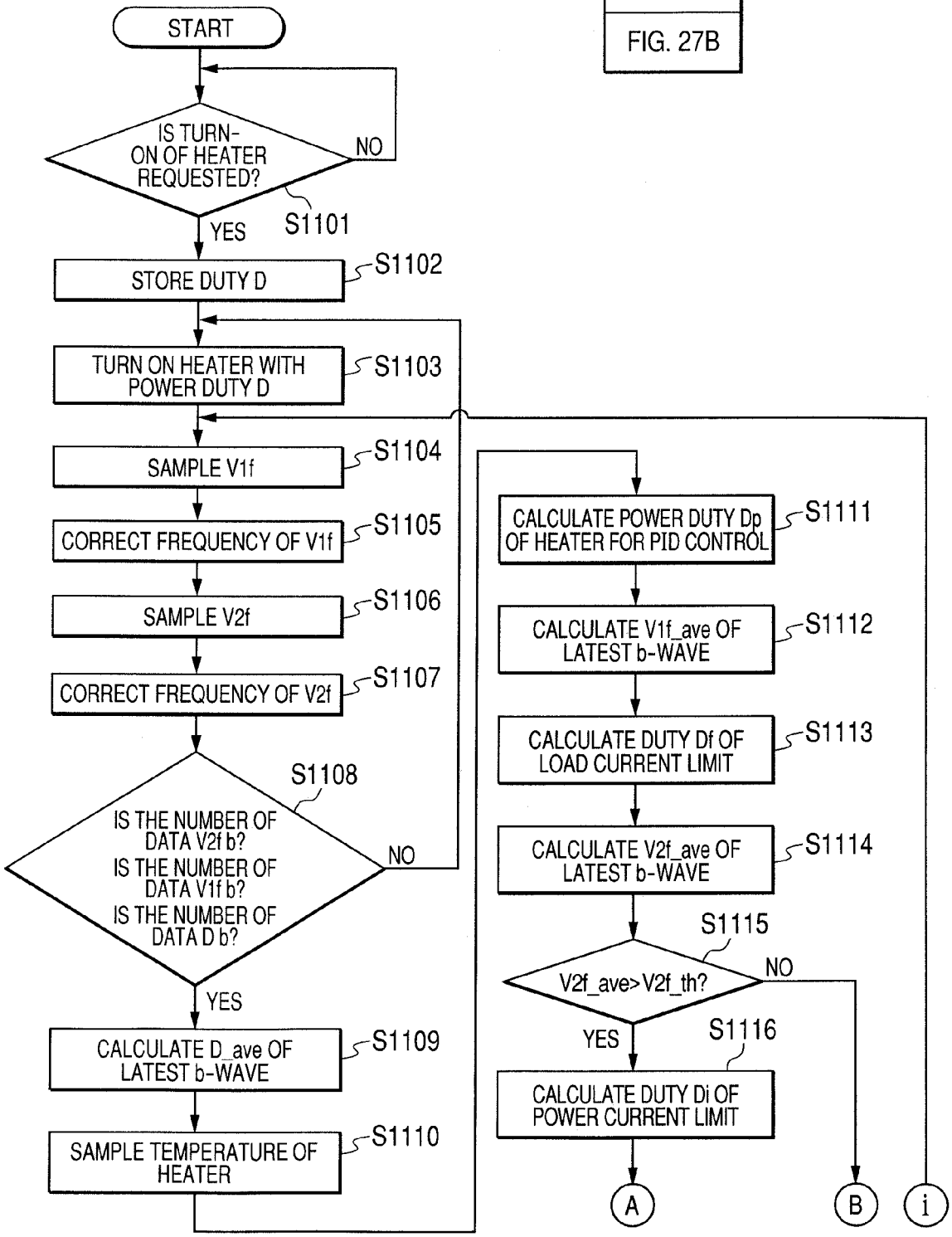
FIGS. 27A and 27B are flow charts describing a control sequence for the fixing device, which is performed by an engine controller according to Embodiment 6.
Figure 27B:
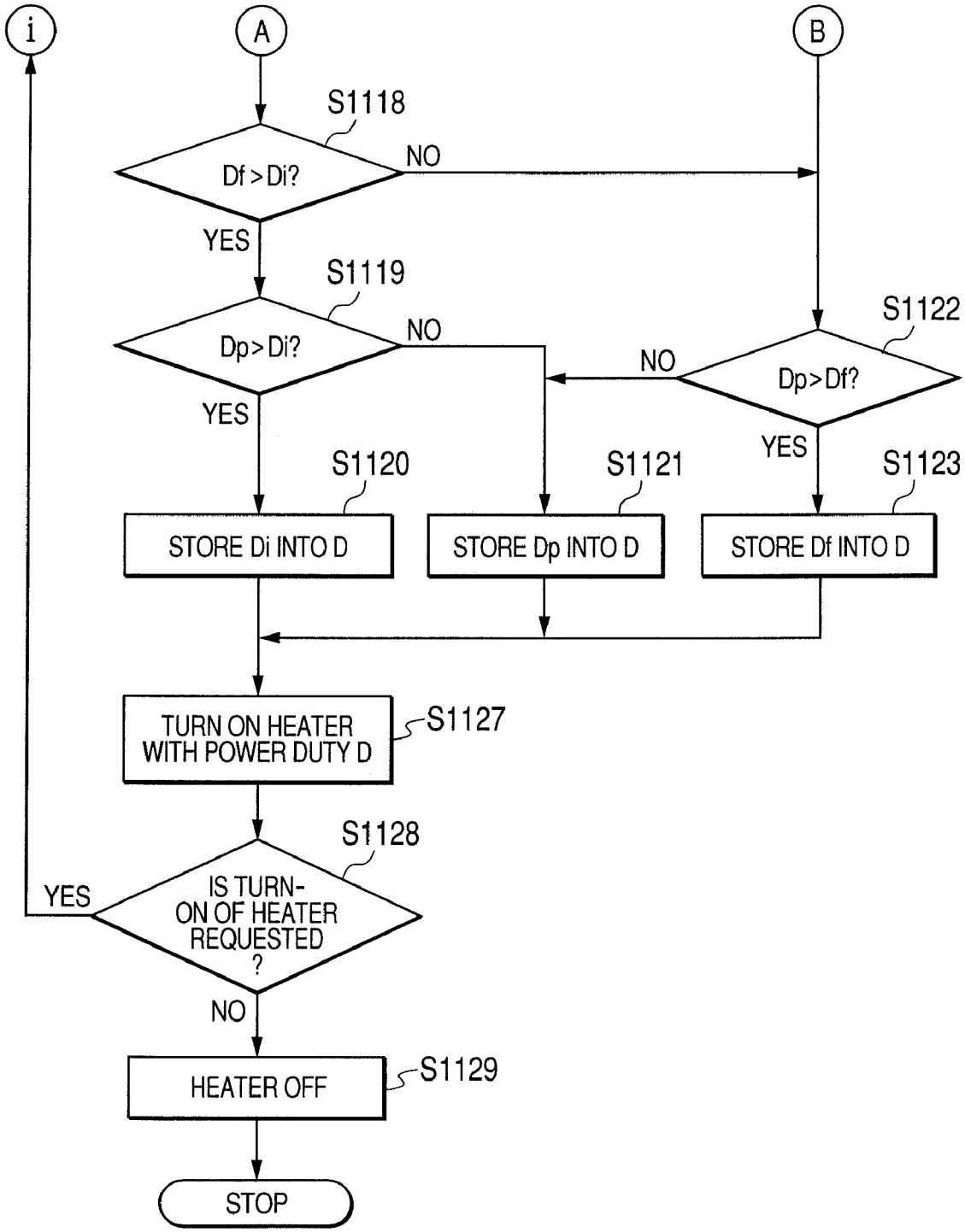
Figure 28:
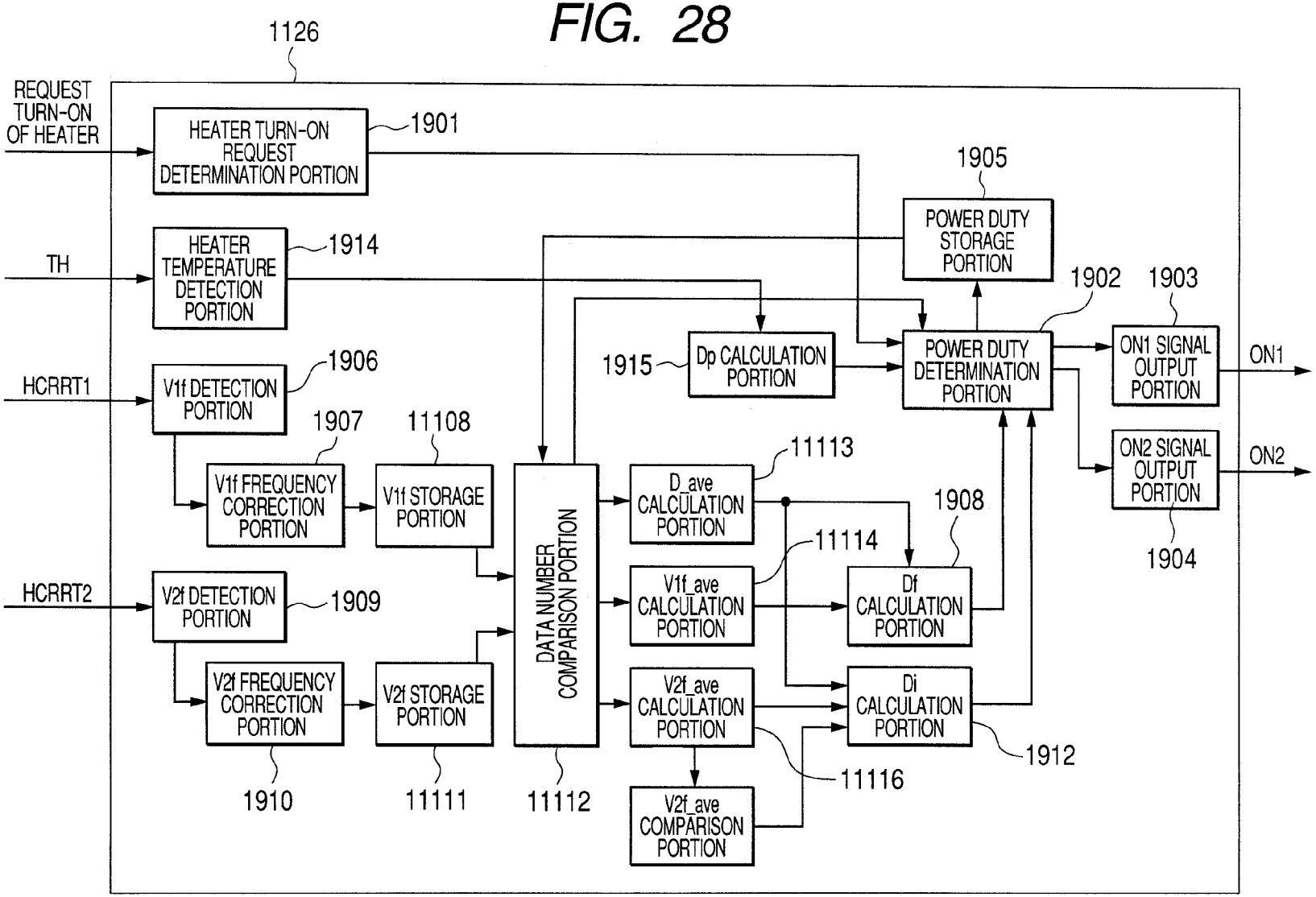
FIG. 28 is a block diagram illustrating a structure of the engine controller according to Embodiment 6.

FIGS. 27A and 27B are flow charts illustrating a control sequence for the fixing device 1109, which is performed by the engine controller 1126 according to Embodiment 6 of the present invention. Further, FIG. 28 is a block diagram illustrating a structure of the engine controller 1126 according to Embodiment 6.

First, in Step S1101, the heater turn-on request determination portion 1901 of the engine controller 1126 determines whether or not the heater turn-on request is input. If the heater turn-on request is input, the processing proceeds to Step S1102, and the preset power duty D is stored in the power duty storage portion 1905. If the heater turn-on request is not generated, the processing of Step S1101 is repeated. Next, in Step S1103, the power duty determination portion 1902 determines the power duty, with which the heater 1109*c* is turned on. Then, based on the determined power duty, the ON1 signal output portion 1903 and the ON2 signal output portion 1904 output the ON1 signal and the ON2 signal, respectively, thereby driving the heater elements 1203 and 1220 with the power duty D. Next, the processing proceeds to Step S1104, and, with the heating members 1203 and 1220 driven with the duty D, the voltage V1*f* is detected and acquired by the V1*f* detection portion 1906. Subsequently, the processing proceeds to Step S1105, and the frequency of the voltage V1*f* is corrected by the V1*f* frequency correction portion 1907. The result is stored in a V1*f* storage portion 11108. Next, the processing proceeds to Step S1106, and, with the heating members 1203 and 1220 driving with the duty D, the voltage V2*f* is acquired by the V2*f* detection portion 1909. Then, the processing proceeds to Step S1107, and the frequency of the voltage V2*f* is corrected by the V2*f* frequency correction portion 1910. The result is stored in a V2*f* storage portion 11111.

Next, the processing proceeds to Step S1108, and a data number comparison portion 11112 determines whether or not the number of pieces of data acquired for each of the duty D, the voltage V1*f*, and the voltage V2*f* has reached a preset number b. If the numbers of the acquired data pieces have not reached b, the processing returns to Step S1103 to repeat the processing described above.

Then, in Step S1108, if the respective numbers of the acquired data pieces have reached b, the processing proceeds to Step S1109, and a D_ave calculation portion 11113 calculates an average value (D_ave) of the power duties D of the heater for the latest b waves. Next, the processing proceeds to Step S1110, and the heater temperature detection portion 1914 detects the temperature of the heater based on the TH signal. Then, in Step S1111, the Dp calculation portion 1915 calculates the power duty Dp of the heater for PID control. The processing of Steps S1110 and S1111 is the same as that of Steps S1034 and S1035 of FIGS. 23A and 23B.

Next, the processing proceeds to Step S1112, and a V1*f*_ave calculation portion 11114 calculates an average value (V1*f*_ave) of the voltages V1*f* for the latest b waves. Then, in Step S1113, the Df calculation portion 1908 calculates, based on the average value V1*f*_ave, the duty Df of the load current limit according to the following expression (4).

$$Df=(V1f_\mathrm{lim}/V1f_\mathrm{ave})\times D \qquad \text{Expression (4)}$$

Next, the processing proceeds to Step S1114, and a V2*f*_ave calculation portion 11116 calculates an average value (V2*f*_ave) of the voltage values V2*f* for the latest b waves. Then, in Step S1115, it is determined which of the average value V2*f*_ave and the threshold voltage V2*f*_th is larger. When the average value V2*f*_ave is larger than V2*f*_th, the processing proceeds to Step S1116. Then, the Di calculation portion 1912 calculates the duty Di of the power current limit according to the following expression (5), and the processing proceeds to Step S1118.

$$Di=(V2f_\mathrm{lim}/V2f_\mathrm{ave})\times D \qquad \text{Expression (5)}$$

After the duty Di of the power current limit is thus obtained, next, the power duty D is determined by the power duty determination 1902. It should be noted that the subsequent determination algorithm for the duty D is common with FIGS. 23A and 23B, and thus, the description thereof is omitted. "First, the processing proceeds to Step S1118, and it is determined which of the duty Di of the power current limit obtained in Step S1116 and the duty Df of the load current limit obtained in Step S1116 is larger. When Df is larger than Di, that is, when the load current limit is larger than the power current limit, the processing proceeds to Step S1119, and it is determined which of the power duty Dp of the heater and the duty Di of the power current limit is larger. When Dp is larger than Di, that is, when the power of the heater is larger than the power current limit, the processing proceeds to Step S1120, and the duty Di of the power current limit, which is the smaller of the two, is stored in a power duty storage portion 1905. On the other hand, when Df is smaller than Di in Step S1118, that is, when the load current limit is larger than the power current limit, the processing proceeds to Step S1122, and it is determined which of the power duty Dp of the heater and the duty Df of the load current limit is larger. When Dp is larger than Df, the processing proceeds to Step S1123, where the duty Df of the load current limit, which is the smaller of the two, is stored in the power duty storage portion 1905, and then the processing proceeds to Step S1127. On the other hand, when Dp is smaller than Di in Step S1119, or when Dp is smaller than Df in Step S1122, the processing proceeds to Step S1121, where the power duty Dp of the heater, which is the smaller of the two, is stored in the power duty storage portion 1905, and then the processing proceeds to Step S1127. In this manner, when the voltage V2*f* exceeds the threshold voltage V2*f*_th, the smaller power duty D is obtained, and then stored in the power duty storage portion 1905.

Hence, when the power duty D is stored in any one of Steps S1120, S1121, and S1123, the processing proceeds to Step S1127. In Step S1127, based on the stored power duty D, the ON1 signal output portion 1903 and the ON2 signal output portion 1904 output the ON1 signal and the ON2 signal, respectively, causing the heating members 1203 and 1220 to be electrified with the power duty D. Next, the processing proceeds to Step S1128, and it is determined whether or not the turn-on of the heater is requested. When the turn-on of the heater is requested, the processing returns to Step S1104, and the processing described above is repeated. When the turn-on of the heater is not requested, the processing proceeds to Step S1129, and the heater is turned off to finish the processing.

As described above, according to Embodiment 6, a current supplied to the heater is controlled in such a manner that the current supplied from the alternating-current power supply does not exceed the predetermined upper limit current.

Further, the control of Embodiment 5 described above may be performed by obtaining D_ave, V1*f*_ave, and V2*f*_ave like Embodiment 6.

Embodiment 7

Embodiment 7 is characterized in that the number of revisions of the upper limit value for the duty of the current supplied to the heater is made fewer, using the average value within a predetermined period of the input current from the commercial power supply to the image forming apparatus and the average value within the predetermined period of the current supplied to the heater.

Next, described is a control sequence for the fixing device 1109, which is performed by the engine controller 1126 of an image forming apparatus according to Embodiment 7 of the present invention. It should be noted that the apparatus structure according to Embodiment 7 is the same as Embodiment 4 described above, and thus, the description thereof is omitted.

Figure 29:
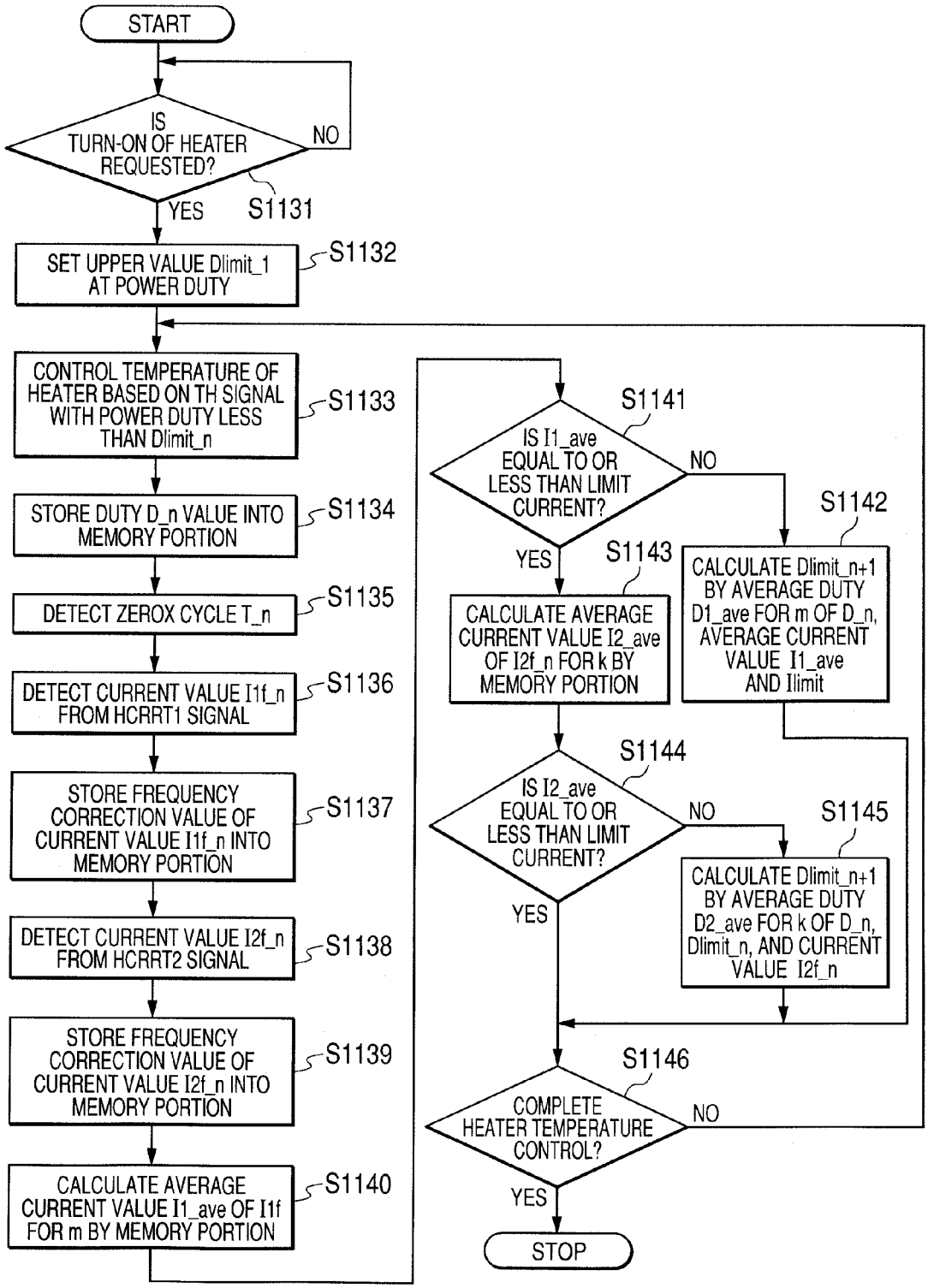
FIG. 29 is a flow chart describing a control sequence for the fixing device, which is performed by an engine controller according to Embodiment 7.

FIG. 29 is a flow chart illustrating the control sequence for the fixing device 1109, which is performed by the engine controller 1126 according to Embodiment 7 of the present invention. Further, FIG. 30 is a block diagram illustrating a structure of the engine controller 1126 according to Embodiment 7.

Figure 30:
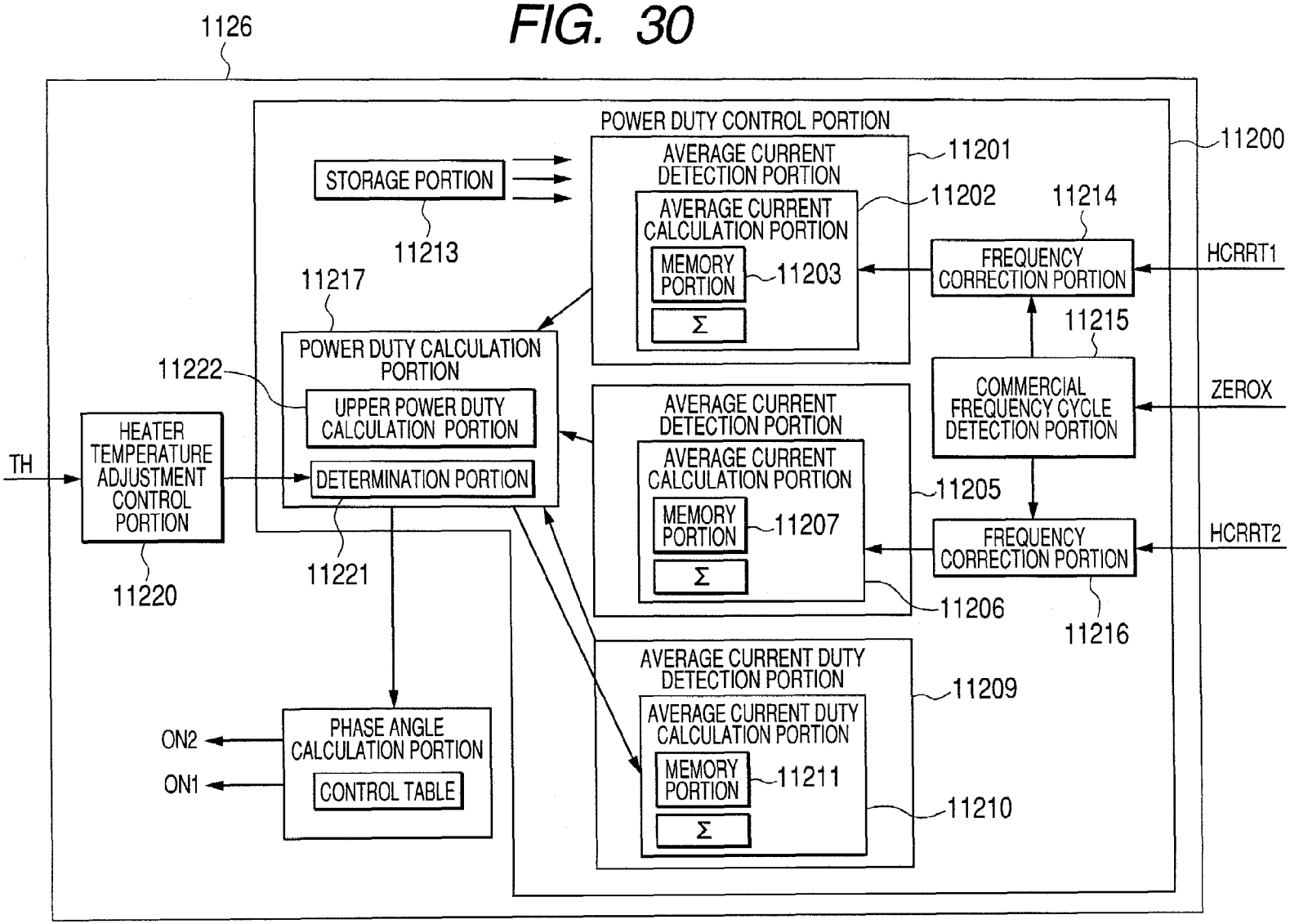
FIG. 30 is a block diagram illustrating a structure of the engine controller according to Embodiment 7.

In FIG. 30, a power duty control portion 11200 is realized as one function of the aforementioned engine controller 1126. The power duty control portion 11200 calculates, when the average of the predetermined period of the current values supplied from the alternating-current power supply 1201 to the image forming apparatus exceeds the upper limit value, an upper power duty, based on detection results of an average power duty detection portion 11209, average current detection portions 11201 and 11205. A commercial frequency cycle detection portion 11215 detects the frequency of the alternating-current power supply 1201.

The peak hold value of the HCRRT2 signal, which corresponds to the current value supplied from the alternating-current power supply 1201 to the image forming apparatus, is corrected by a frequency correction portion 11216, and the average current detection portion 11205 stores the corrected value in a memory portion 11207. The memory portion 11207 stores the current values over a predetermined time (within a predetermined period), and the average value thereof is calculated by the average current calculation portion 11206. The average current detection portion 11205 outputs the average current value to a power duty calculation portion 11217.

The peak hold value of the HCRRT1 signal, which corresponds to the current value supplied to the heater 1109*c*, is corrected by a frequency correction portion 11214, and the average current detection portion 11201 stores the corrected value in a memory portion 11203. The memory portion 11203 stores the current values over the predetermined time (within the predetermined period), and the average value thereof is calculated by the average current calculation portion 11202. With regard to the storage time of the average current detection portion 11201, a predetermined time different from the storage time of the average current detection portion 11205 may be stored. The average current detection portion 11201 outputs the average current value to the power duty calculation portion 11217.

The average power duty detection portion 11209 stores the value calculated by the power duty calculation portion 11217 in a memory portion 11211. The memory portion 11211 stores the power duties within the predetermined time that matches the storage time of the average current detection portion 11205, and the average value thereof is calculated by an average power duty calculation portion 11210. The average power duty detection portion 11209 outputs the calculated average power duty to the power duty calculation portion 11217. A storage portion 11213 holds an initial value of the power duty or the current value.

An upper power duty calculation portion 11222 of the power duty calculation portion 11217 calculates, according to the outputs from the average current detection portion 11201, the average current detection portion 11205, and the average power duty detection portion 11209, an upper power duty Dlimit_n, which is suppliable to the heater 1109*c*. The power duty, which is to be supplied to the heater 1109*c*, is determined by a determination portion 11221, based on the output from a heater temperature adjustment control portion 11220 and the calculation result of the upper power duty calculation portion 11222. The upper power duty Dlimit_n thus calculated is stored in the memory portion 11211 of the average power duty detection portion 11209.

Next, referring to the flow chart of FIG. 29, the control sequence for the fixing device 1109 according to Embodiment 7 is described.

First, in Step S1131, the engine controller 1126 determines whether or not a power supply start request (heater turn-on request) to the heater 1109*c* is generated, and when the turn-on request is generated, the processing proceeds to Step S1132. In Step S1132, taking into account a range of assumed input voltages, the resistant value of the heater 1109*c*, or the like, a preset power duty Dlimit_1 is set as a maximum power duty. Herein, for example, assuming a case where the input voltage is minimum and the resistant value is maximum, the power duty Dlimit_1 is set to be a power duty, with which a current does not exceed an allowable current that is suppliable to the heater 1109*c*.

Next, the processing proceeds to Step S1133, and heater temperature adjustment control is started with the aforementioned power duty Dlimit_1 being the upper duty. Here, in order to obtain a predetermined temperature set in the engine controller 1126, based on the TH signal, power to be supplied to the heating members 1203 and 1220 is controlled by means of, for example, the PID control. In the following processing, based on a difference between target temperature information (control target temperature) and temperature information by the TH signal, determined is a power duty D_n, with which the heater is driven. It should be noted that when the calculated power duty D_n exceeds the upper duty Dlimit_1, the upper duty Dlimit_1 is set as a power duty D_1. In other words, in Step S1133, the temperature adjustment control for the heater is performed with the power duty D_1 equal to or less than the upper duty Dlimit_1. Here, the on-pulses of the ON1 signal and the ON2 signal are transmitted from the engine controller 1126, using the ZEROX signal as a trigger, with the phase angle α_1 corresponding to the power duty D_1. Thus, a current is supplied to the heating members 1203 and 1220 with the phase angle α_1.

Next, the processing proceeds to Step S1134, the value of the power duty D_1 at the present time point is stored in the memory portion 11211. Here, the average current within a predetermined time L is obtained, and the control is performed based on the average value. Then, a sampling number k thereof is determined according to a minimum commercial frequency f of the alternating-current power supply 1201. For example, k=L×f. Accordingly, the memory 11211 can store the power duties for the number k, and the storage portion 11213 stores the upper power duty Dlimit_1, which is the initial value, and "0". In this manner, the power duties for the latest number k are held.

Next, the processing proceeds to Step S1135, and a ZEROX cycle T_1 is detected. Here, the frequency of the alternating-current power supply 1201 is detected by the commercial frequency detection portion 11215 detecting a time interval T from the rising edge to the trailing edge of the ZEROX signal.

Next, the processing proceeds to Step S1136, and, with the power duty D_1 being used for the electrification, acquired is a voltage V1*f*_1 (corresponding to current value I1*f*_1) based on the HCRRT1 signal transmitted from the current detection circuit 1227, which detects a current that flows into the heater. As described above, the voltage V1*f*_1 corresponds to the voltage value V1*f*_1 that is peak-held at the capacitor 1074*a*. In other words, the voltage V1*f*_1 is the peak hold value of the HCRRT1 signal illustrated in FIG. 21. In Embodiment 7, using the ZEROX signal as a trigger, this value is acquired within a period of time from the rising edge of the ZEROX signal until the DIS signal is transmitted, that is, the period Tdly. The period Tdly is set to be long enough for the engine controller 1126 to detect the peak hold value V1*f*_1.

It should be noted that, in the description of the flow chart of FIG. 29, after the current value is detected, the upper current value and the upper duty are obtained based on the current value, but, as described above, in actuality, detected is the peak-held voltage value. Then, the current value corresponding to the voltage value is obtained to execute the calculation.

Next, the processing proceeds to Step S1137, and a frequency correction value of the current value I1*f*_1 is obtained and stored in the memory portion 11203. It should be noted that the current values for m waves (m cycles of the alternating-current power supply) are stored in the memory portion 11203. For example, when the current that flows into the heater 1109*c* is detected for every one wave (one cycle of the alternating-current power supply) to set the restriction value of the current, m=1 is set. The storage portion 11213 stores the initial value "0" of the memory portion 11203. Here, the current value I1*f*_1, which is obtained from the HCRRT1 signal, is the integration value for a half-cycle of the squared wave pattern frequency of the alternating-current power supply 1201. If the frequency of the alternating-current power supply 1201 is preset to a particular frequency, for example, 50 Hz, the current value I1*f* represents a current value in the case of 50 Hz.

Assuming that a current value I1*f*_1 corresponding to 50 Hz is I150_1, I150_1 is expressed, using the ZEROX cycle T_1, as follows.

$$I150_1 = I1f_1 \times (1/T_1)/50$$

Next, the processing proceeds to Step S1138, and, with the power duty D_1 being used for the electrification, acquired is a voltage V2*f*_1 (corresponding to current value I2*f*_1) based on the HCRRT2 signal transmitted from the current detection circuit 1228, which detects an input current from the commercial power supply to the image forming apparatus. As described above, this corresponds to the voltage V2*f* that is peak-held at the capacitor 1074*b*. In other words, the voltage V2*f*_1 is the peak hold value of the HCRRT2 signal illustrated in FIG. 22.

Next, the processing proceeds to Step S1139, and a frequency correction value of the current value I2*f*_1 obtained in Step S1138 is obtained. Then, the result is stored in the memory portion 11207. Like the power duties stored in Step S1134, the memory portion 11207 can store the current values for the number k, and the storage portion 11213 stores the initial value "0". Here, as described above, the current value I2*f*_1, which is obtained from the HCRRT2 signal, is the integration value for a half-cycle of the squared wave pattern frequency. If the frequency of the alternating-current power supply 1201 is preset to a particular frequency, for example, 50 Hz, the current value I2*f* represents a current value in the case of 50 Hz.

Assuming that a current value I2*f*_1 corresponding to 50 Hz is I250_1, I250_1 is expressed, using the ZEROX cycle T_1, as follows.

$$I250_1 = I2f_1 \times (1/T_1)/50$$

Next, the processing proceeds to Step S1140, and the engine controller 1126 calculates an average current value I1_ave of the frequency-corrected current values I1*f*_1 for a number m, based on the current value I1*f* corresponding to 50 Hz, which is stored in the memory portion 11203 in Step S1137.

Next, the processing proceeds to Step S1141, and a comparison is made between a current restriction value (first current value) Ilimit1, which is suppliable to the heating members 1203 and 1220, and the average current value I1_ave, which is calculated in Step S1139. Here, the current restriction value Ilimit1 is, for example, a current restriction value in the case of 50 Hz. It should be noted that the reason why the processing of Step S1141 is performed is that, even in the case where the current supplied from the alternating-current power supply 1201 to the image forming apparatus is supplied within the allowable range, the upper limit value of the power supplied to the heating members 1203 and 1220 varies depending on the ratings of devices used in the circuit of FIG. 16. Accordingly, the current has to be controlled to be equal to or less than the restriction value Ilimit1. However, taking into account the assumed voltage range of the alternating-current power, the resistant value of the heater 1109*c*, or the like, in a case where the current value I1*f* does not exceed the allowable current value when the control is performed with the power duty Dlimit_1, which is the duty limit for the heater, Steps S1136 to 1137, and S1140 to S1142 may be omitted.

Then, in Step S1141, when it is determined that I1_ave≧Ilimit1, the processing proceeds to Step S1142, and in a case of I1_ave<Ilimit1, the processing proceeds to Step S1143. In the case where the processing proceeds to Step S1142, the current supplied to the heating members 1203 and 1220 exceeds the preset current restriction value suppliable to the heater. Thus, the average power duty calculation portion 11210 calculates the average value D1_ave of the power duties D_n for the number m, which are stored in the memory portion 11211 in Step S1134 (k≧m). Then, based on the average power duty D1_ave, the average current value I1_ave of the current values I1*f* calculated in Step S1140, and the predetermined current restriction value Ilimit1 suppliable to the heating members 1203 and 1220, Dlimit_2 is calculated (Dlimit_n+1 is calculated). It should be noted that the power duty Dlimit_2 is obtained according to the following expression.

$$Dlimit_2 = (Ilimit1/I1_ave) \times D1_ave$$

On the other hand, in Step S1141, when it is determined that I1_ave<Ilimit1, the processing proceeds to Step S1143, and the average current value I2_ave for the number k is calculated based on the current value I2*f* corresponding to 50 Hz, which is stored in the memory portion 11207 in Step S1139. Then, in Step S1144, a comparison is made between the preset current restriction value (second current value) Ilimit2 suppliable from the alternating-current power supply 1201 and the average current value I2_ave calculated in Step S1143. Here, the current restriction value Ilimit2 is set to, for example, a current restriction value in the case of 50 Hz.

In Step S1144, in the case of I2_ave≧Ilimit2, the processing proceeds to Step S1145, and in the case of I2_ave<Ilimit2, the processing branches to Step S1146. Step S1145 is performed when the average current supplied from the alternating-current power supply 1201 exceeds the preset current restriction value. Accordingly, in this case, the average power duty calculation portion 11210 calculates an average value D2_ave of the power duties for the number k, based on the power duties stored in the memory portion 11211 in Step S1134. Hence, based on the average power duty D2_ave thus calculated and the current value I2*f*_1 corresponding to 50 Hz, calculated is an upper limit power duty Dlimit_2, which can be used for electrifying the heating members 1203 and 1220. It should be noted that the power duty Dlimit_2 is obtained according to the following expression.

$$Dlimit_2 = (Ilimit2/I2_ave) \times D2_ave$$

Thus, when the current value I2*f*_1 corresponding to 50 Hz, that is, I250_1 satisfies I250_1≧Ilimit2, the upper power duty Dlimit_2 satisfies Dlimit_2=min(D_ave, Dlimit_1-X). On the other hand, when I250_1<Ilimit2 is satisfied, the upper power duty Dlimit_2 satisfies Dlimit_2=min(D_ave, Dlimit_1). It should be noted that "min(,)" indicates the smaller one in parentheses. The value of X indicates a reduction rate of the upper power duty in a case where both the current value I2*f* and the average current value for the number k exceed the current restriction value Ilimit 2. The value of X is set to a predetermined value according to the amount of the current that flows through the entire circuit (LVPS) excluding the heater 1109*c* and the variation rate of the current value on one wave basis.

Thus, when the upper power duty Dlimit_2 is obtained, by referring to the average power duty D2_ave, it is possible to deal with the variation of the power duty caused by the heater temperature adjustment control or the variation of the current value that flows through the entire circuit (LVPS) excluding the heater 1109*c*. In addition, it is possible to perform the temperature adjustment control without lowering the upper limit of the power duty more than necessary.

The processing described above is performed repeatedly for every cycle of the alternating-current power supply 1201 until the temperature adjustment control for the heater 1109*c* is finished in Step S1146, and the power duty to be supplied to the heating members 1203 and 1220 is calculated by the engine controller 1126. It should be noted that, for the value of the upper power duty Dlimit_n, the value of the upper power duty Dlimit_n−1 is held without any change unless the value is revised in S1142 and in S1145.

As described above, according to Embodiment 7, in Step S1133, the heater temperature adjustment control is performed with the power duty D_n, which is equal to or less than the upper power duty Dlimit_n. Then, in Step S1136, the voltage value V1*f*_n (current value I1*f*_n) is acquired from the HCRRT1 signal, and in Step S1138, the voltage value V2*f*_n (current value I2*f*_n) is acquired from the HCRRT2 signal. Then, in Steps S1137 and S1139, the frequency-corrected values are stored in the memory portions 11203 and 11207, respectively.

Next, the average value of the current values I1*f*_n for m waves and the average value of the current values I2*f*_n for k waves are obtained, and it is determined whether or not each of those average values exceeds the corresponding restriction values Ilimit1 and Ilimit2, respectively. Subsequently, when the average value exceeds the restriction value, the upper power duty Dlimit_n+1 is calculated by the upper power duty calculation portion 11222. It should be noted that the upper power duty is calculated based on the values calculated by the average current detection portion 11201, the average current detection portion 11205, and the average power duty detection portion 11209.

It should be noted that, in the aforementioned description, the description is made using the case where the two heating members 1203 and 1220 constitute the heater 1109*c*, but the present invention is not limited thereto, and similar control can be performed even in a case of one heating member.

It should be noted that there is an occasion where currents, which can be used for heating the heater, differ widely between a case where the heater temperature adjustment is performed to a necessary temperature prior to printing and a case where the heater temperature adjustment is performed while driving the motors and the like during printing. According to Embodiment 7, the upper power duty is reset for the power duty Dlimit_1, which is preset at the time of start of the heater temperature adjustment. Thus, prior to printing, the maximum current can be input when the heater temperature adjustment is performed, and control with an optimum current set value can be performed during printing as well.

Besides, apart from the time of the heater temperature adjustment prior to printing, during printing, a predetermined set value may be provided as the power duty (if the value of Dlimit_n exceeds the predetermined set value when sequences are shifted from pre-printing temperature adjustment into a printing state, Dlimit_n+1 is controlled to become equal to or less than the aforementioned set value).

As described above, according to Embodiment 7, used is the average value of the current values calculated by the average current detection portion 11201, the average current detection portion 11205, and the average power duty detection portion 11209. Accordingly, even if there occurs temporary current increase due to noise, inrush current, instantaneous load fluctuation, or the like, the upper limit value can be set with accuracy, responding to the voltage or the power factor of the input power supply, variation in resistance value, or the form factor of the current wave pattern. Accordingly, under every condition, it is possible to optimize the power performance.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Applications No. 2007-092441, filed Mar. 30, 2007, No. 2007-115992, filed Apr. 25, 2007, and No. 2008-086955, filed Mar. 28, 2008, which are hereby incorporated by reference herein in their entirety.

What is claimed is:

1. An image forming apparatus, comprising:

an image forming portion that forms an image on a recording material;

a fixing portion that fixes the image on the recording material by heating, the fixing portion being controlled to maintain a control target temperature; and a current detection circuit that detects an input current from a commercial power supply to the apparatus, wherein in a case where a current detected by the current detection circuit exceeds a predetermined value, a maximum current suppliable to the fixing portion is restricted, and in a case where a temperature of the fixing portion falls below, in a situation where the maximum current suppliable to the fixing portion is restricted, a predetermined temperature lower than the control target temperature, a conveyance interval of the recording material conveyed to the fixing portion is extended.

2. An image forming apparatus according to claim 1, wherein in a case where the temperature of the fixing portion falls below the predetermined temperature in a situation where the conveyance interval of the recording material conveyed to the fixing portion is extended, the conveyance interval of the recording material conveyed to the fixing portion is further extended.

3. An image forming apparatus according to claim 2, wherein in a case where the temperature of the fixing portion falls below the predetermined temperature in a situation where the conveyance interval of the recording material conveyed to the fixing portion is extended to a predetermined limit, at least one of operations of multiple option devices provided to the apparatus is restricted.

4. An image forming apparatus according to claim 1, further comprising a temperature detection element for detecting the temperature of the fixing portion, wherein:

in a case where a detection current of the current detection circuit is equal to or less than the predetermined value, the fixing portion is electrified with a duty according to a detection temperature of the temperature detection element; and in a case where the detection current exceeds the predetermined value, the fixing portion is electrified with a smaller duty of a duty Dp set according to the detection temperature of the temperature detection element and a duty Di set according to an output of the current detection circuit.

5. An image forming apparatus according to claim 1, further comprising:

a temperature detection element that detects the temperature of the fixing portion; and a second current detection circuit that detects a current to the fixing portion, wherein:

in a case where a detection current of the current detection circuit that detects the input current from the commercial power supply to the apparatus is equal to or less than the predetermined value, the fixing portion is electrified with a duty according to a detection temperature of the temperature detection element; and in a case where the detection current of the current detection circuit that detects the input current from the commercial power supply to the apparatus exceeds the predetermined value, the fixing portion is electrified with a smallest duty of a duty Dp set according to the detection temperature of the temperature detection element, a duty Di set according to an output of the current detection circuit for detecting the input current from the commercial power supply to the apparatus, and a duty Df set according to an output of the second current detection circuit.

* * * * *